US009027541B2

(12) United States Patent
Huebl

(10) Patent No.: US 9,027,541 B2
(45) Date of Patent: May 12, 2015

(54) TOY LAUNCHER FOR LAUNCHING PROJECTILES AND METHODS THEREOF

(71) Applicant: Easebon Services Limited, Kwun Tong (HK)

(72) Inventor: Steven J. Huebl, Jordan, MN (US)

(73) Assignee: Easebon Services Limited, Kwun Tong (HK)

( * ) Notice: Subject to any disclaimer, the term of this patent is extended or adjusted under 35 U.S.C. 154(b) by 0 days.

(21) Appl. No.: 14/223,208

(22) Filed: Mar. 24, 2014

(65) Prior Publication Data

US 2014/0283809 A1 Sep. 25, 2014

Related U.S. Application Data

(63) Continuation-in-part of application No. 13/740,808, filed on Jan. 14, 2013, now Pat. No. 8,695,579, which is a continuation of application No. 12/854,739, filed on Aug. 11, 2010, now Pat. No. 8,353,277.

(51) Int. Cl.

| | |
|---|---|
| ***F41B 11/54*** | (2013.01) |
| ***F41B 11/64*** | (2013.01) |
| ***F41B 11/60*** | (2013.01) |
| ***F41A 9/26*** | (2006.01) |
| ***F41A 9/72*** | (2006.01) |
| ***F41B 4/00*** | (2006.01) |
| ***F41B 11/89*** | (2013.01) |
| ***F41B 11/681*** | (2013.01) |

(52) U.S. Cl.

CPC ..... *F41B 11/54* (2013.01); *F41B 11/64* (2013.01); *F41B 11/60* (2013.01); *F41A 9/26* (2013.01); *F41A 9/72* (2013.01); *F41B 4/00* (2013.01); *F41B 11/89* (2013.01); *F41B 11/681* (2013.01)

(58) Field of Classification Search

CPC ..... F41B 11/54
USPC ..... 42/54; 124/58, 56, 65, 48, 51.1
See application file for complete search history.

(56) References Cited

U.S. PATENT DOCUMENTS

| | | | | |
|---|---|---|---|---|
| 3,304,928 | A | 2/1967 | Darrell | |
| 5,283,970 | A * | 2/1994 | Aigner | 42/57 |
| 5,564,964 | A * | 10/1996 | Chin-Chien | 446/406 |
| 5,722,384 | A | 3/1998 | Cox | |
| 5,724,955 | A | 3/1998 | Johnson | |
| 6,067,975 | A | 5/2000 | Ginn | |
| 7,458,371 | B2 * | 12/2008 | Ong et al. | 124/65 |
| 7,677,232 | B2 * | 3/2010 | Rosenblum et al. | 124/16 |
| 8,353,277 | B2 | 1/2013 | Huebl | |

(Continued)

*Primary Examiner* — Reginald Tillman, Jr.
(74) *Attorney, Agent, or Firm* — Amster, Rothstein & Ebenstein, LLP

(57) ABSTRACT

According to an exemplary embodiment, a toy dart launcher comprises a housing defining an interior recess and a launch assembly. The launch assembly is at least partially disposed within the interior recess and comprises: a projectile feed, a slidable frame, and a launch mechanism. The projectile feed is rotatably disposed within the interior recess and comprises a plurality of receiving chambers each adapted to receive one or more projectiles. The slidable frame has at least one engagement finger rotatably disposed thereon, and is movable with respect to the projectile feed so that the at least one engagement finger can engage and move at least one projectile through at least one receiving chamber. The launch mechanism is disposed rearwardly of the projectile feed and is configured to create a pressure differential about the at least one projectile so that the at least one projectile can be launched from the housing.

17 Claims, 38 Drawing Sheets

(56) References Cited

U.S. PATENT DOCUMENTS 8,695,579 B2 4/2014 Huebl
2002/0166551 A1 11/2002 Lee
2011/0041824 A1* 2/2011 Jablonski et al. ..... 124/65

* cited by examiner

TOY LAUNCHER FOR LAUNCHING PROJECTILES AND METHODS THEREOF

CROSS-REFERENCE TO RELATED APPLICATIONS

The present application is a continuation-in-part application, and claims the benefit and priority of, U.S. patent application Ser. No. 13/740,808, filed on Jan. 14, 2013, which is a continuation application that claims the benefit and priority of U.S. patent application Ser. No. 12/854,739 (now U.S. Pat. No. 8,353,277), filed on Aug. 11, 2010, the entire contents of each of which is incorporated by reference in its entirety.

FIELD

The present invention relates to a toy launcher capable of substantially safely launching a substantially large number of projectiles without reloading.

BACKGROUND

Many children and young adults enjoy playing with toy guns. Some toy guns are designed to launch a projectile at a target (i.e., an inanimate object). One example of such a toy gun is a BB gun. BB guns shoot out BBs that are, typically speaking, small spheroid substantially hard metal objects capable of traveling at a substantially high rate of speed. Due to their size, shape, and speed of travel it is generally recommended that BB guns not be fired at another as this can cause substantial injury. Although BB guns are typically only fired at a target, one of the benefits of BB guns is that they can store a substantially large quantity of BBs thereby increasing the number of BBs that can be shot between reloading. To house this large quantity of BBs, BB guns typically include a surplus of BBs stored somewhat arbitrarily in a reservoir.

Other toy guns are designed to substantially safely launch a projectile at an individual. In this scenario the shape, physical constraints, and/or speed of travel of the projectile can be of concern. That is, unlike a BB gun, for this type of toy it is desirable that an individual hit by the projectile not be substantially injured. These shape, physical constraints, and/or speed of travel of the projectile can require a user to reload this type of toy gun after launching a single projectile and/or after launching a substantially small number of projectiles. Thus, although safe enough to be used against another individual during play, these toy guns are typically limited to a small quantity of projectiles and therefore require a user to repeatedly reload.

SUMMARY

In exemplary embodiments, a toy launcher for launching projectiles can comprise a rotatable projectile feed assembly that can include a plurality of receiving bodies having an opening extending a predetermined length from a proximal end to a distal end of the projectile feed assembly. Thee plurality of openings can be designed to receive a plurality of projectiles that may be housed sequentially along the length of the projectile feed assembly. The toy launcher can also comprise a projectile launching assembly that can include at least one accelerator that may be located substantially near the distal end of at least one of the receiving bodies. Further, the toy launcher can also comprise a user interface assembly that can include at least one user interface capable of being activated by a user, for example, causing the projectile feed assembly to rotate and at least one of the projectiles housed in at least one of the receiving bodies to advance toward the distal end of the receiving body and interact with the accelerator such that at least one projectile can be launched from the toy launcher.

In exemplary embodiments, the projectile can be a three dimensional object that can have a substantial length, substantial width, and/or substantial depth such that the three dimensional object can frictionally interact with a rotating body. These dimensions can also be selected to substantially reduce the risk of injury to an individual struck by the projectile.

In exemplary embodiments, the projectile can be a dart, a spheroid object, an ovoid object, a polygonal object, and/or an object with a suction cup or magnetic object.

In exemplary embodiments, the predetermined length of the receiving bodies can be determined based on the length of the projectile and the desired number of projectiles received in the receiving body. Also, in exemplary embodiments, the number of receiving bodies can be determined based on the length of the projectile and the number of projectiles desired to have received in the projectile feed assembly.

In exemplary embodiments, the plurality of receiving bodies can be a plurality of tubes. Further, the projectile feed assembly can be constructed from a plurality of projectile feed assemblies combined together and/or the projectile feed assembly can further comprise about 2 to about 100 receiving bodies.

In exemplary embodiments, the plurality of receiving bodies can be arranged in a substantially circular pattern. Further, the circular pattern can have an exterior surface and an interior surface and a projectile interfacing region can be located on the exterior surface and/or interior surface. In exemplary embodiments, the plurality of receiving bodies can be arranged in a substantially linear pattern in the receiving bodies. Further, in exemplary embodiments, the plurality of receiving bodies can be arranged such that more than one projectile can be launched, for example, at substantially the same time and/or in rapid succession.

In exemplary embodiments, the user interface can be a handle and/or trigger.

In exemplary embodiments, the receiving body can further comprise at least one projectile interfacing region that can be a slot extending at least some length of the receiving body. The user interface assembly can further comprise a slide rack capable of translating in a direction substantially parallel to at least one receiving body and at least one engagement mechanism can be coupled to the slide rack. Further, when the slide rack translates, at least one engagement mechanism can engage at least one projectile via the at least one projectile interfacing region and can advance at least one projectile toward the distal end of the receiving body such that at least one projectile interfaces with the accelerator causing it to be propelled from the toy launcher.

In exemplary embodiments, the plurality of receiving bodies can rotate when the user interfaces translates the slide rack. The plurality of receiving bodies can rotate about 30 degrees.

In exemplary embodiments, at least one of the engagement mechanism can at least partially extend through the slot to engage at least one projectile and at least one projectile can at least partially extend through the slot to engage the engagement mechanism.

In exemplary embodiments, the accelerator can further comprise at least one rotating body. Also, in exemplary embodiments, the accelerator can comprise a first flywheel that may be spaced a distance from a second flywheel and the spaced can be about just slightly less than the cross-sectional length of the projectile. Interacting with the first and second flywheel, at least one projectile can be accelerated out of the toy.

In exemplary embodiments, the accelerator can comprise a first flywheel spaced a distance from a surface and the spaced can be about just slightly less than the cross-sectional width of the projectile. Interacting with the first flywheel and the surface, the projectile can be accelerated out of the toy.

In exemplary embodiments, the accelerator can comprise a tread/track driven about a flywheel. In exemplary embodiments, the accelerator can be a flywheel powered by a motor and/or can be located substantially near the distal most end of the toy launcher such that the projectile speed may not be substantially reduced by frictional interaction with remaining elements of the toy launcher.

In exemplary embodiments, a toy launcher for launching projectiles can comprise a projectile feed assembly that can include at least one receiving body that can have an opening extending a predetermined length from a proximal end to a distal end of the projectile feed assembly, the opening can be designed to receive a plurality of projectiles housed sequentially along the length of the projectile feed assembly. The toy launcher can further comprise a projectile launching assembly that can include at least one accelerator and the launcher can further comprise a user interface assembly that can include at least one user interface capable of being activated by a user causing at least some element of the projectile feed assembly and/or projectile launching assembly to rotate and/or translate and causing at least one of the projectiles housed in at least one receiving body to advance toward the distal end of the receiving body and interact with the accelerator such that at least one projectile is launched from the toy launcher.

In exemplary embodiments, the projectile feed assembly can rotate and/or translate relative to the projectile launching assembly. Also, the projectile launching assembly can rotate and/or translate relative to the projectile feed assembly.

In exemplary embodiments, the projectile feed assembly can comprise a single receiving body.

In exemplary embodiments, the projectile can be a three dimensional object that can have a substantial length, substantial width, and/or substantial depth such that the three dimensional object can frictionally interact with a rotating body. These dimensions can also be selected to substantially reduce the risk of injury to an individual struck by the projectile.

In exemplary embodiments, the projectile can be a dart, a spheroid object, an ovoid object, a polygonal object, and/or an object with a suction cup or magnetic object.

In exemplary embodiments, the predetermined length of the receiving bodies can be determined based on the length of the projectile and the desired number of projectiles received in the receiving body. Also, in exemplary embodiments, the number of receiving bodies can be determined based on the length of the projectile and the number of projectiles desired to have received in the projectile feed assembly.

In exemplary embodiments, the at least one receiving body can be at least one tube. Further, the projectile feed assembly can be constructed from a plurality of projectile feed assemblies combined together and/or the projectile feed assembly can further comprise about 2 to about 100 receiving bodies.

In exemplary embodiments, a plurality of receiving bodies can be arranged in a substantially circular pattern. Further, the circular pattern can have an exterior surface and an interior surface and a projectile interfacing region can be located on the exterior surface and/or interior surface. In exemplary embodiments, a plurality of receiving bodies can be arranged in a substantially linear pattern in the receiving bodies. Further, in exemplary embodiments, the plurality of receiving bodies can be arranged such that more than one projectile can be launched, for example, at substantially the same time and/or in rapid succession.

In exemplary embodiments, the user interface can be a handle and/or trigger.

In exemplary embodiments, the receiving body can further comprise at least one projectile interfacing region that can be a slot extending at least some length of the receiving body. The user interface assembly can further comprise a slide rack capable of translating in a direction substantially parallel to at least one receiving body and at least one engagement mechanism can be coupled to the slide rack. Further, when the slide rack translates, at least one engagement mechanism can engage at least one projectile via the at least one projectile interfacing region and can advance at least one projectile toward the distal end of the receiving body such that at least one projectile interfaces with the accelerator causing it to be propelled from the toy launcher.

In exemplary embodiments, at least one receiving body can rotate when the user interfaces translates the slide rack. The at least one receiving body can rotate about 30 degrees.

In exemplary embodiments, at least one of the engagement mechanism can at least partially extend through the slot to engage at least one projectile and at least one projectile can at least partially extend through the slot to engage the engagement mechanism.

In exemplary embodiments, the accelerator can further comprise at least one rotating body. Also, in exemplary embodiments, the accelerator can comprise a first flywheel that may be spaced a distance from a second flywheel and the spaced can be about just slightly less than the cross-sectional length of the projectile. Interacting with the first and second flywheel, at least one projectile can be accelerated out of the toy.

In exemplary embodiments, the accelerator can comprise a first flywheel spaced a distance from a surface and the spaced can be about just slightly less than the cross-sectional width of the projectile. Interacting with the first flywheel and the surface, the projectile can be accelerated out of the toy.

In exemplary embodiments, the accelerator can comprise a tread/track driven about a flywheel. In exemplary embodiments, the accelerator can be a flywheel powered by a motor and/or can be located substantially near the distal most end of the toy launcher such that the projectile speed may not be substantially reduced by frictional interaction with remaining elements of the toy launcher.

According to an exemplary embodiment, a toy dart launcher comprises a housing defining an interior recess and a launch assembly. The launch assembly is at least partially disposed within the interior recess and comprises: a projectile feed, a slidable frame, and a launch mechanism. The projectile feed is rotatably disposed within the interior recess and comprises a plurality of receiving chambers each adapted to receive one or more projectiles therein. The slidable frame has at least one engagement finger rotatably disposed thereon, and is movable with respect to the projectile feed so that the at least one engagement finger can engage and move at least one projectile through at least one receiving chamber. The launch mechanism is disposed rearwardly of the projectile feed and is configured to create a pressure differential about the at least one projectile so that the at least one projectile can be launched from the housing.

In an exemplary embodiment, the launch mechanism comprises a fluid chamber with a piston and associated piston spring disposed therein.

In an exemplary embodiment, the piston includes a forward plunger head having an outer diameter that approximates an inner diameter of the fluid chamber so that movement of the piston within the fluid chamber causes fluids disposed in a direction of movement to be pressurized therein.

In an exemplary embodiment, each of the plurality of receiving chambers comprises a channel along an outer surface thereof for receiving a portion of the at least one engagement finger.

In an exemplary embodiment, the fluid chamber comprises a forward portion having a forward diameter and a rearward portion having a smaller, rearward diameter.

In an exemplary embodiment, the forward portion is movable relative to the rearward portion of the fluid chamber in a telescoping manner.

In an exemplary embodiment, the slidable frame is configured to engage and move the forward portion of the fluid chamber relative to the rearward portion of the fluid chamber.

In an exemplary embodiment, the launch assembly further comprises an elevator assembly configured to align the at least one projectile with the launch mechanism.

In an exemplary embodiment, the elevator assembly includes an elevator mechanism pivotably coupled to the housing in the interior recess and an elevator chamber movably disposed in the interior recess and configured to receive the at least one projectile.

In an exemplary embodiment, the elevator mechanism is configured to pivot upwardly and engage the elevator chamber to move the elevator chamber into vertical alignment with the launch mechanism.

In an exemplary embodiment, the slidable frame includes a claw protruding therefrom so that movement of the slidable frame causes the claw to engage and pivot the elevator mechanism upwardly within the interior recess.

In an exemplary embodiment, the launch assembly further comprises a rotation gear rotatably coupled with the projectile feed and operably coupled with the slidable frame so that movement of the slidable frame along the rotation gear causes subsequent rotation of the projectile feed.

In an exemplary embodiment, the rotation gear includes one or more cam ledges configured for engagement with a forward actuator of the slidable frame.

In an exemplary embodiment, the launch assembly further comprises a rack movably coupled along the slidable frame.

In an exemplary embodiment, the rack comprises a plurality of chambers that defines respective recesses with corresponding ledges extending horizontally thereabove.

In an exemplary embodiment, the respective recess of each of the plurality of chambers is configured to receive a portion of the at least one engagement finger and each of the corresponding ledges is configured to engage a portion of the at least one engagement finger so that relative movement of the rack and the slidable frame causes the at least one engagement finger to rotate in at least one of a first and second rotational direction.

According to an exemplary embodiment, a method of launching a projectile from a toy launcher, comprises: (a) providing a toy assembly comprising a housing and a launch assembly at least partially disposed within the housing, the launch assembly comprising: a projectile feed including at least one projectile movably disposed along a portion thereof; a slidable frame movable relative to the projectile feed; and a launch mechanism that includes a telescoping fluid chamber with a spring-actuated piston disposed therein; (b) moving the slidable frame along the housing so that at least one engagement finger rotatably disposed on the slidable frame engages and move the at least one projectile rearwardly along the projectile feed; (c) moving the slidable frame along the housing so that a rear portion of the slidable frame engages and moves a forward portion of the fluid chamber rearwardly to telescope over a rearward portion of the fluid chamber and cause a spring associated with the actuated piston to compress; and (d) releasing the spring associated with the plunger so that the piston moves forwardly along the fluid chamber to cause a pressure differential to form about the at least one projectile and propel forwardly from the toy launcher.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying drawings and figures wherein.

DETAILED DESCRIPTION OF THE EXEMPLARY EMBODIMENTS

Figure 1A:
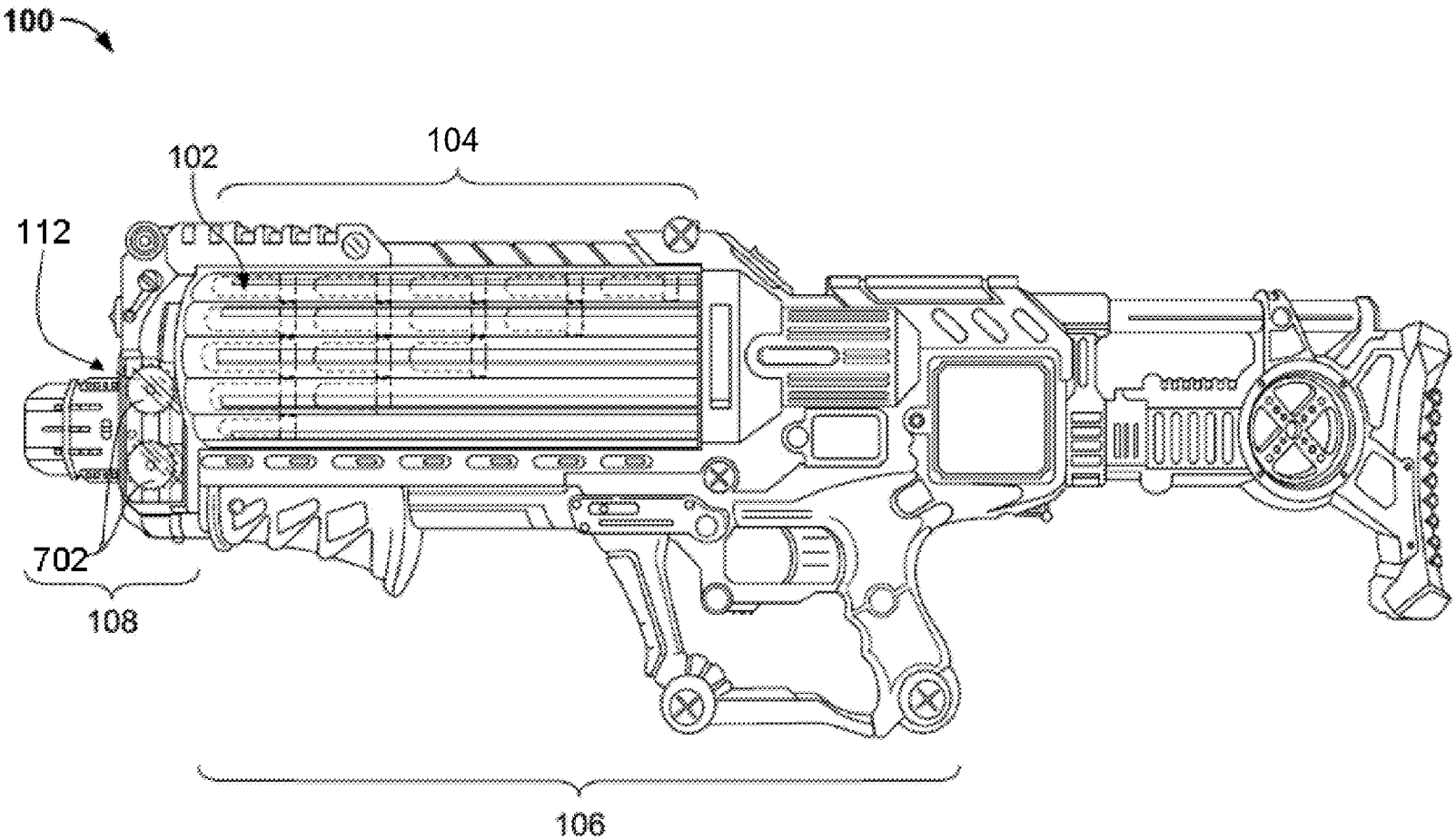
FIGS. 1A-1B illustratively depict a toy launcher for launching projectiles in an open and closed configuration, in accordance with exemplary embodiments of the present invention.
Figure 1B:
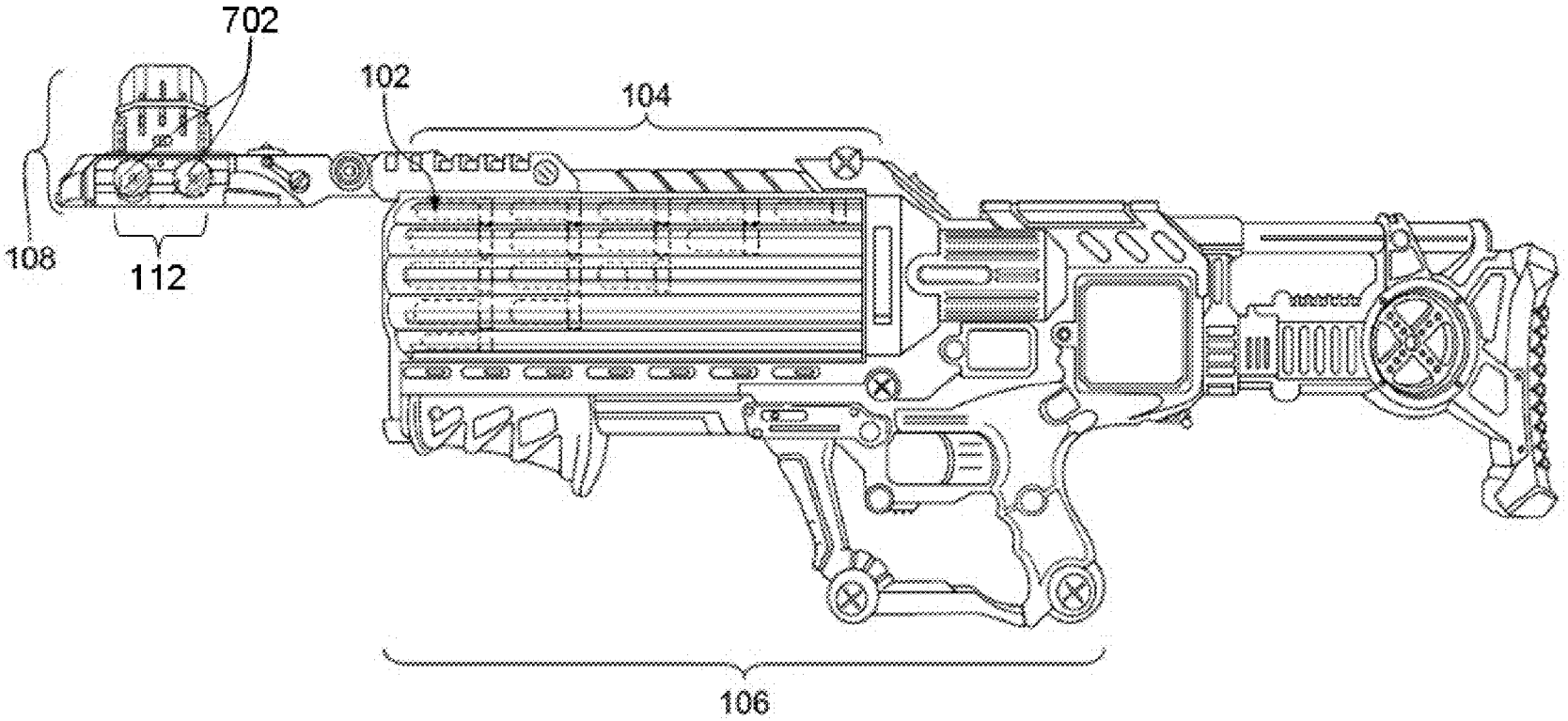

The invention generally relates to a toy launcher that can substantially safely launch a substantially large number of projectiles thereby reducing the number of times needed to reload the toy launcher. To increase the number of projectiles that can be launched, projectiles may be housed sequentially along the length of a plurality of receiving bodies of a rotatable projectile feed assembly. These housed projectiles can be launched out of the toy launcher in substantial synchronization with the rotation of the projectile feed assembly. This combination, inter alia, can allow the toy launcher to house a substantially large number of projectiles reducing the number of times needed to reload the toy launcher.

Referring to FIGS. 1A-1D, in exemplary embodiments, toy launcher 100 can house a substantially large amount (e.g., 40, 48, 60, 72, 100, 144, 200, 1000, etc.) of projectiles 102 in a projectile feed assembly 104 and a user, for example, interacting with a user interface assembly 106, can cause at least one projectile 102 to advance from projectile feed assembly 104 to a projectile launch assembly 108. At projectile launch assembly 108, at least one projectile 102 can interact with an at least one accelerator 112 causing at least one projectile 102 to be launched out of toy launcher 100.

Figure 1C:
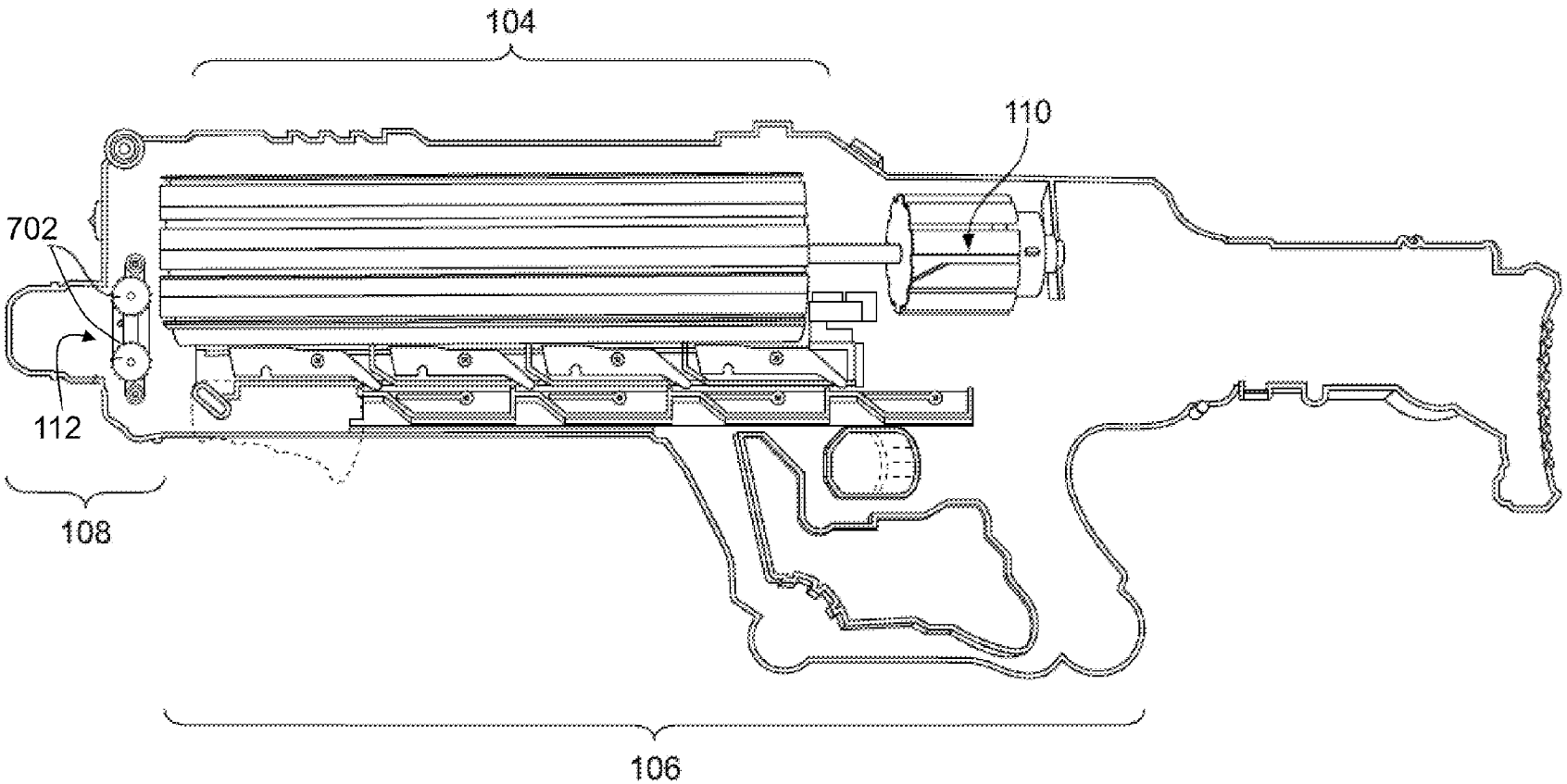
FIGS. 1C-1D illustratively depict various elements of the toy launcher, in accordance with exemplary embodiments of the present invention.
Figure 1D:
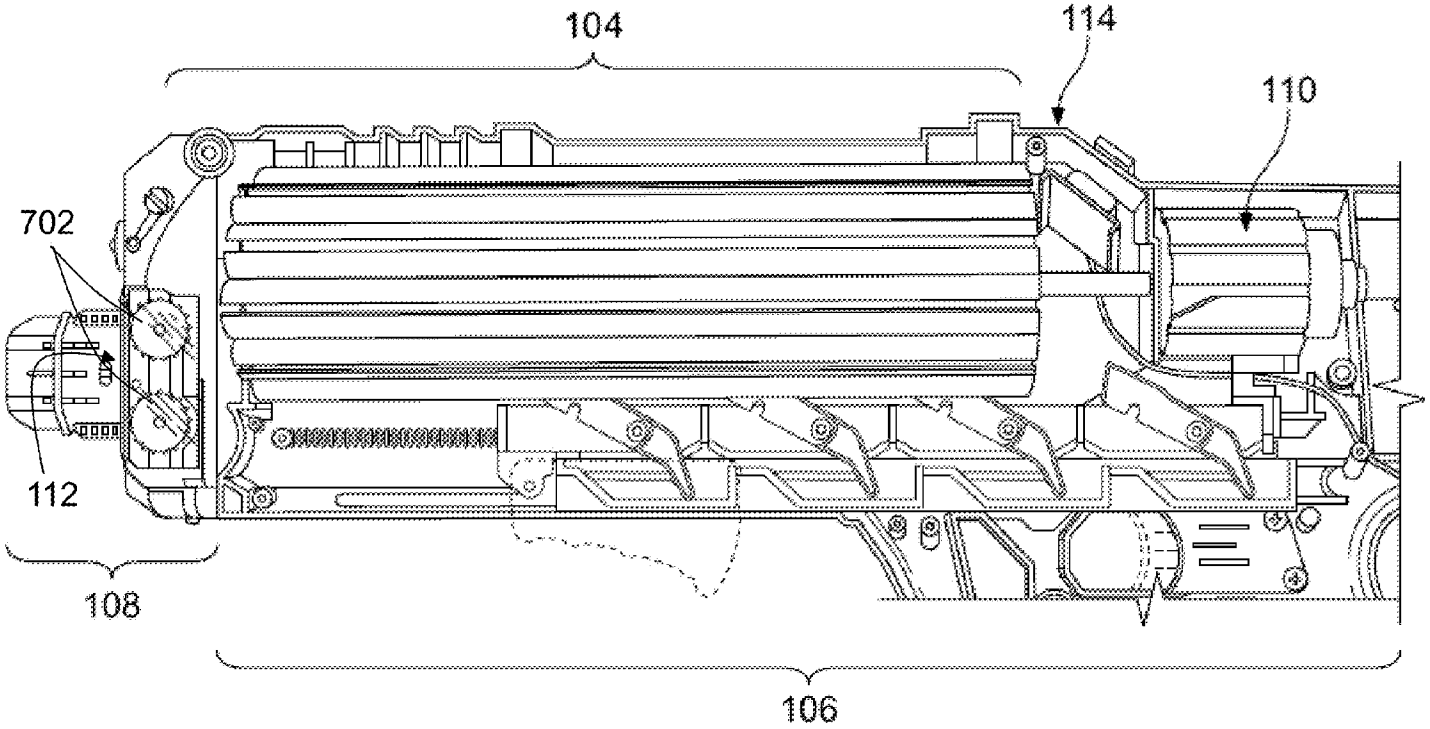

Referring to FIGS. 1C-1D, in exemplary embodiments, a plurality of projectiles 102 (not shown) can be stored sequentially along the length of projectile feed assembly 104 and projectile feed assembly 104 can rotate, for example, about its axis. This rotation can occur when user interface assembly 106 engages rotation mechanism 110 causing projectile feed assembly 104 to rotate. As pointed out above, the combination of being able to rotate and storing a plurality of projectiles 102 sequentially along the length of projectile feed assembly 104 can substantially increase the number of projectiles that can be safely launched out of toy launcher 100 thereby reducing the number of times needed to reload toy launcher 100.

Projectile feed assembly 104, user interface assembly 106, projectile launch assembly 108, rotation mechanism 110, and/or any other reasonable component of toy launcher 100 can be at least partially retained by a housing 114. Housing 114 alone, or in combination with feed assembly 104, user interface assembly 106, projectile launch assembly 108, rotation mechanism 110, and/or any other reasonable element of toy launcher 100 can be configured substantially to the shape of a gun and/or launcher, such as, but not limited to, a rocket launcher, grenade launcher, shoulder-launcher, and/or any reasonable form of launcher and/or can be constructed at least partially of plastic material, a metallic material, any combination thereof, and/or any other reasonably material for constructing a toy launcher.

Referring back to FIGS. 1A-1B, projectile launch assembly 108 can substantially separate from the remaining elements of toy launcher 100 (e.g., projectile feed assembly 104, user interface assembly 106, rotation mechanism 110, etc.) allowing access to projectile feed assembly 104 and/or projectile launch assembly 108. This separation can be for unclogging jammed projectiles 102 and/or substantially reducing the time required to reload toy launcher 100. It will be understood that toy launcher 100 can be reloaded without separating projectile launch assembly 108 from the remaining elements of toy launcher 100. For example, at least one element of projectile feed assembly 104 may be accessed by a user for reloading toy launcher 100.

Figure 2A:
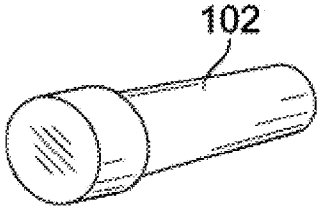
FIGS. 2A-2E illustratively depict various projectiles, in accordance with exemplary embodiments of the present invention.
Figure 2B:
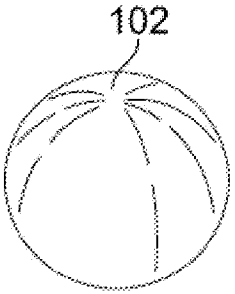
Figure 2C:
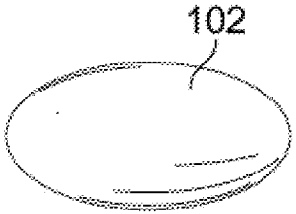
Figure 2D:
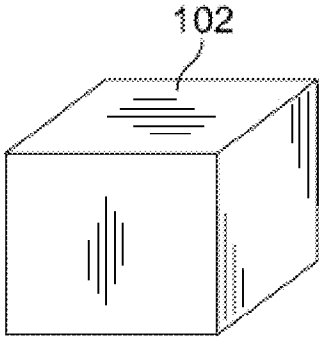
Figure 2E:
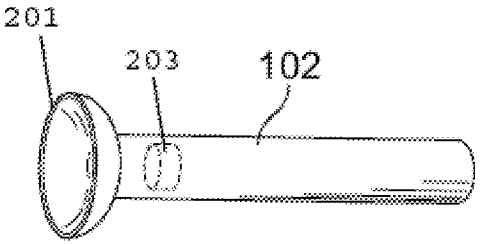

Referring to FIGS. 2A-2E, in exemplary embodiments, projectile 102 can be, but is not limited to, a dart such as dart/projectile 102 illustratively depicted in FIG. 2A; a round object such as round object/projectile 102 illustratively depicted in FIG. 2B; an ovoid object such as ovoid object/projectile 102 illustratively depicted in FIG. 2C; a polygonal object such as polygonal object/projectile illustratively depicted in FIG. 2C; an object including a suction cup 201 and/or a magnet 203 such as the object/projectile 102 illustratively depicted in FIG. 2D; and/or any reasonable object capable of being launched from toy launcher 100.

In exemplary embodiments, projectile 102 can be constructed of at least one material that may be rigid enough to be launched from toy launcher 100 and/or soft enough to avoid substantially injuring others. For example, projectiles 102 can be constructed of a substantially solid spongy cellular material such as, but not limited to, closed-cell polyethylene foam, open-cell polyethylene foam, ethylene vinyl acetate closed-cell foam, ethylene vinyl acetate open-cell foam, and/or any other reasonable material that may be rigid enough to be launch from toy launcher 100 and/or soft enough to avoid injuring others.

In exemplary embodiments, the dimensions of projectile 102 such as, but not limited to, length, width, and depth can be selected to substantially reduce the risk of injury. For example, the dimensions can be selected to reduce the chances of injuring a human eye. Further, materials used and/or methods for dimensioning projectile 102, toy launcher 100, and/or any element of toy launcher 100 may be based on safety standards such as, but not limited to, International Standardization Organization (ISO) 8124, European Union EN71, Hong Kong's Toys and Children's Products Safety Regulation, and the American Society for Testing and Materials (ASTM), to name a few.

Referring to FIGS. 3A-5, in exemplary embodiments, projectile feed assembly 104 can include a plurality of receiving bodies 302 arranged in a geometric pattern such that projectiles 102 (not shown) can be sequentially located along the length of receiving body 302. In exemplary embodiments, the length of receiving body 302, projectile 102's dimensions, and/or the number of receiving bodies can be selected to, for example, increase the quantity of projectiles that can be launched from toy launcher 100 without reloading. By way of example, projectile feed assembly 104 can include twelve (12) receiving bodies, each having a length of about ten and a half inches (10.5"), and projectiles 102 housed sequentially therein can have a length of about two and a half inches (2.5"). Thus, toy launcher 100 can have about forty-eight (48) projectiles 102.

Figure 3A:
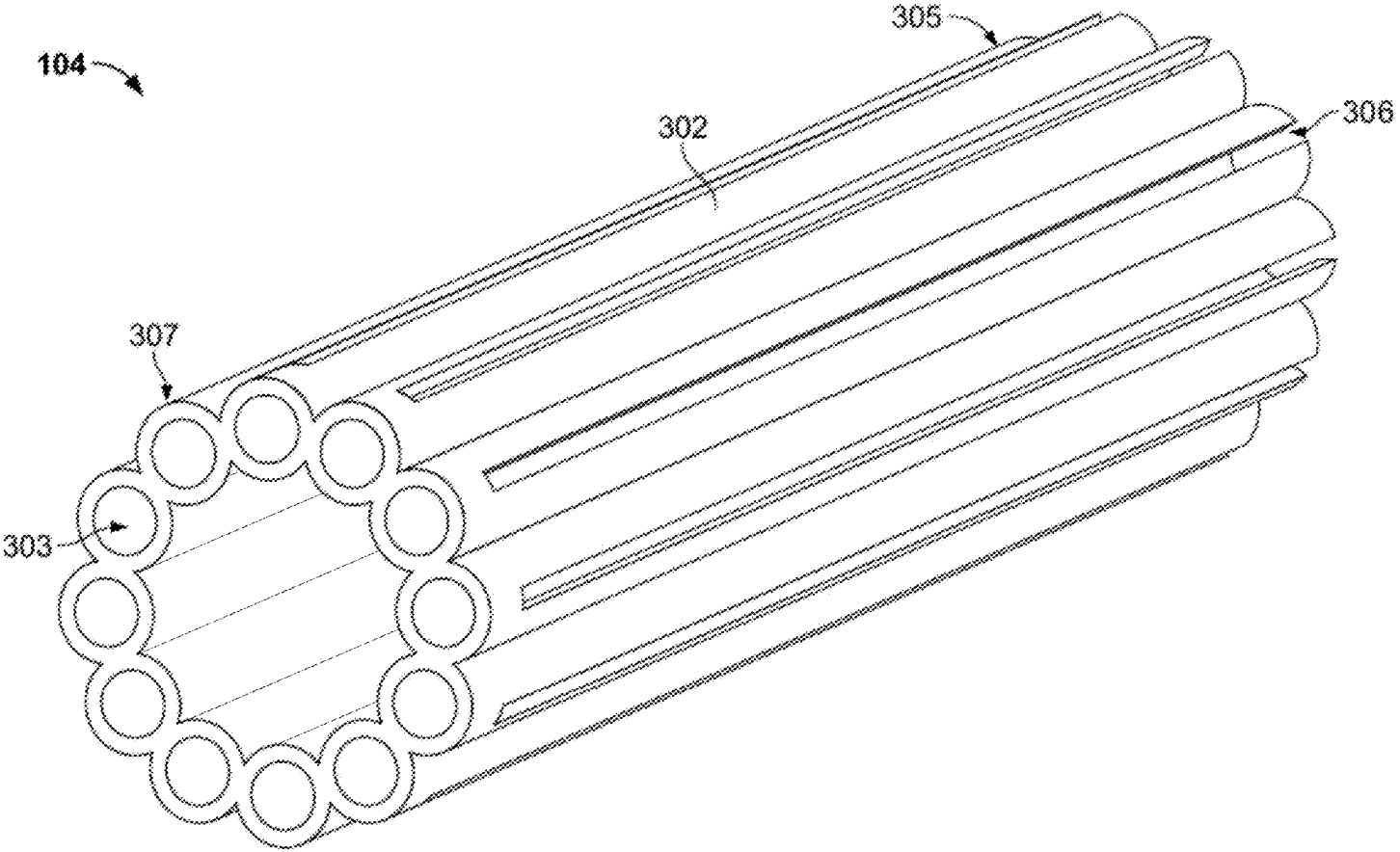
FIGS. 3A-5B illustratively depict various configurations for projectile feed assemblies, in accordance with exemplary embodiments of the present invention.

Referring to FIG. 3A, in exemplary embodiments, projectile feed assembly 104 can include a plurality of receiving bodies 302 having an opening 303 extending from a proximal end 305 (i.e., the end nearer to the user when located in toy launcher 100) to a distal end 307 (i.e., the end further from the user when located in toy launcher 100) of projectile feed assembly 104. In exemplary embodiments, projectile feed assembly 104 can be constructed of a plurality of receiving bodies 302 affixed and/or coupled together. It will be understood that any reasonable technique can be used to create projectile feed assembly 104 and receiving bodies 302. For ease, projectile feed assembly 104 is, at times, described as being constructed from a plurality of receiving bodies 302. This is merely for ease and is in no way meant to be a limitation.

In exemplary embodiments, the cross-sectional shape of receiving body 302 and/or the cross-sectional shape of opening 303 can be, but is not limited to, round, square, polygonal, triangular, star shaped, any combination thereof, or any other reasonable shape capable of receiving projectile 102. For ease, the cross-sectional shape of each receiving body 302 and opening 303 are, at times, depicted as round and/or receiving body 302 is depicted as a tube/tubular. This is merely for ease and is in no way meant to be a limitation.

Figure 3B:
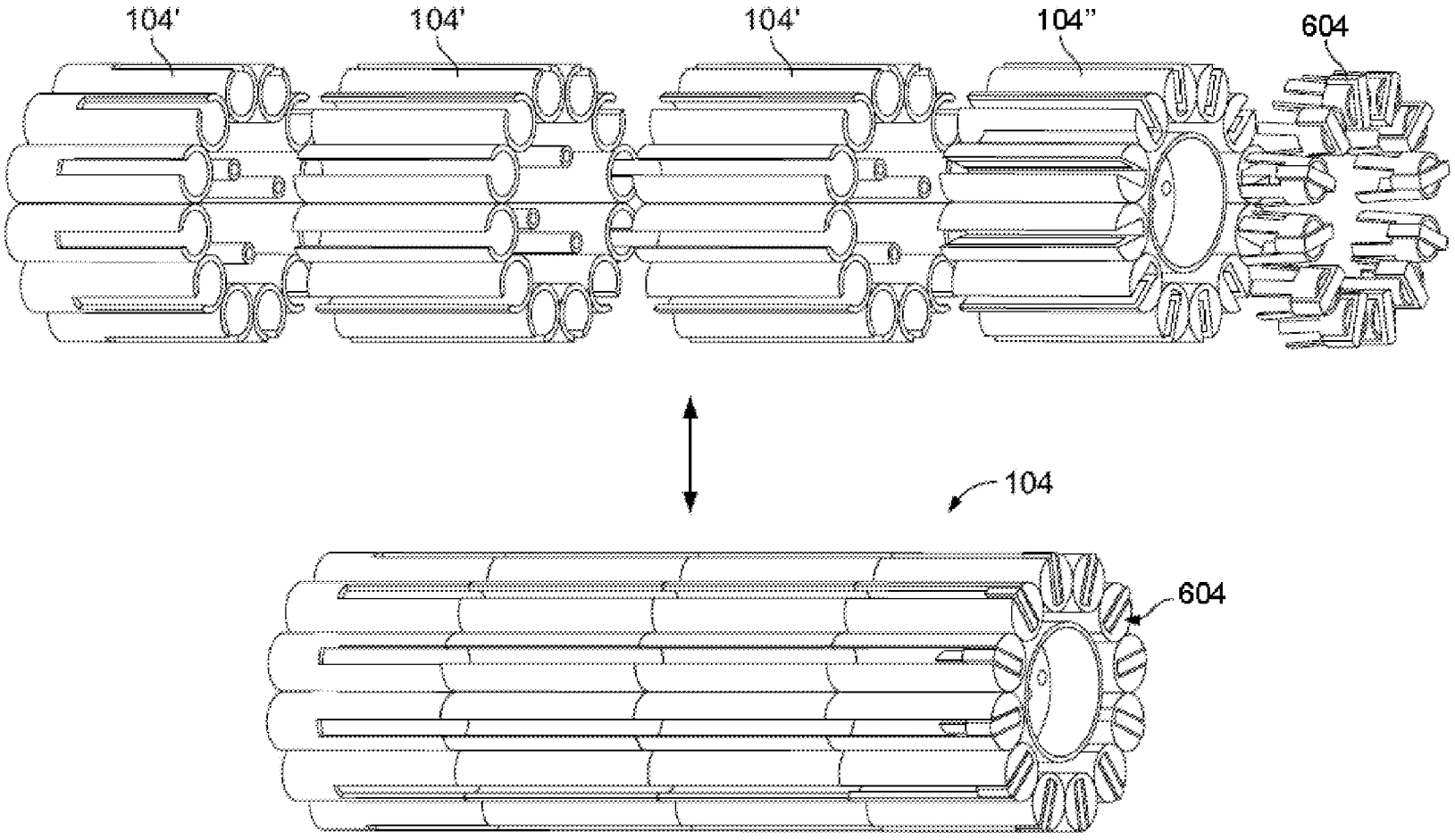
Figure 4A:
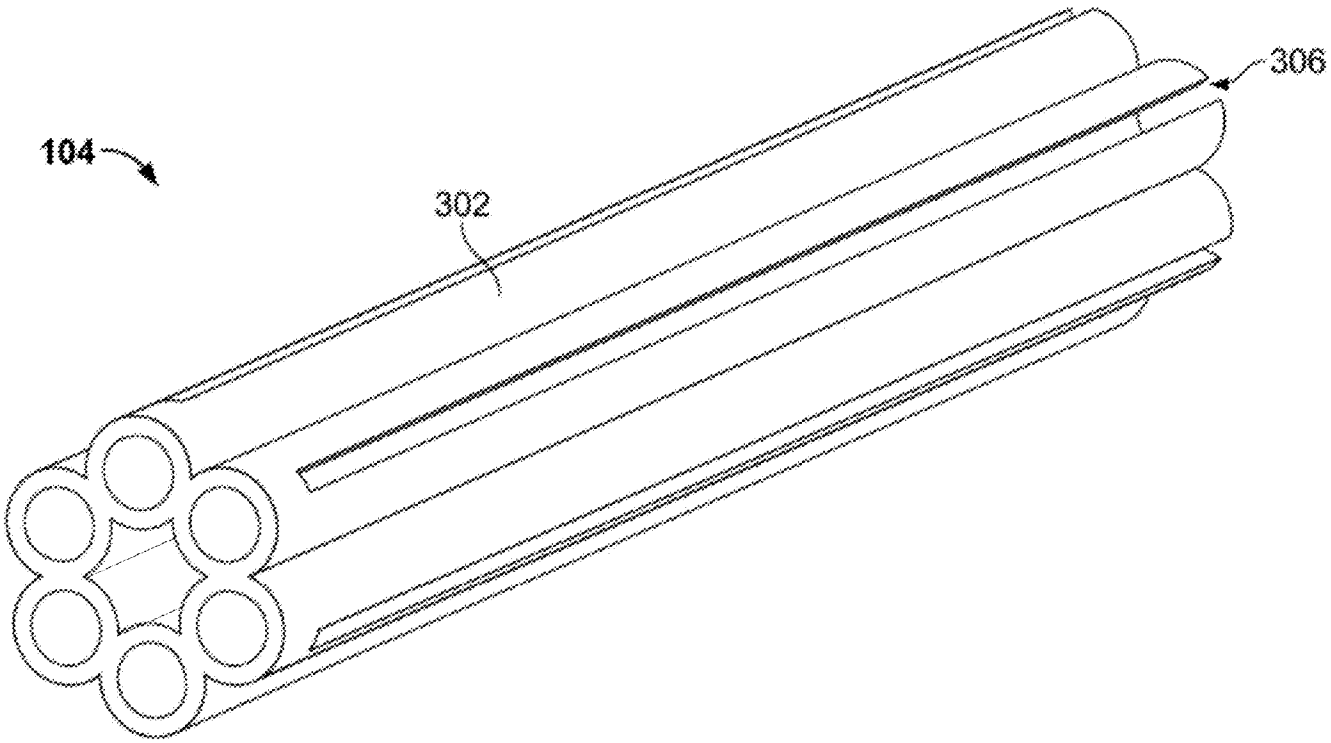
Figure 4B:
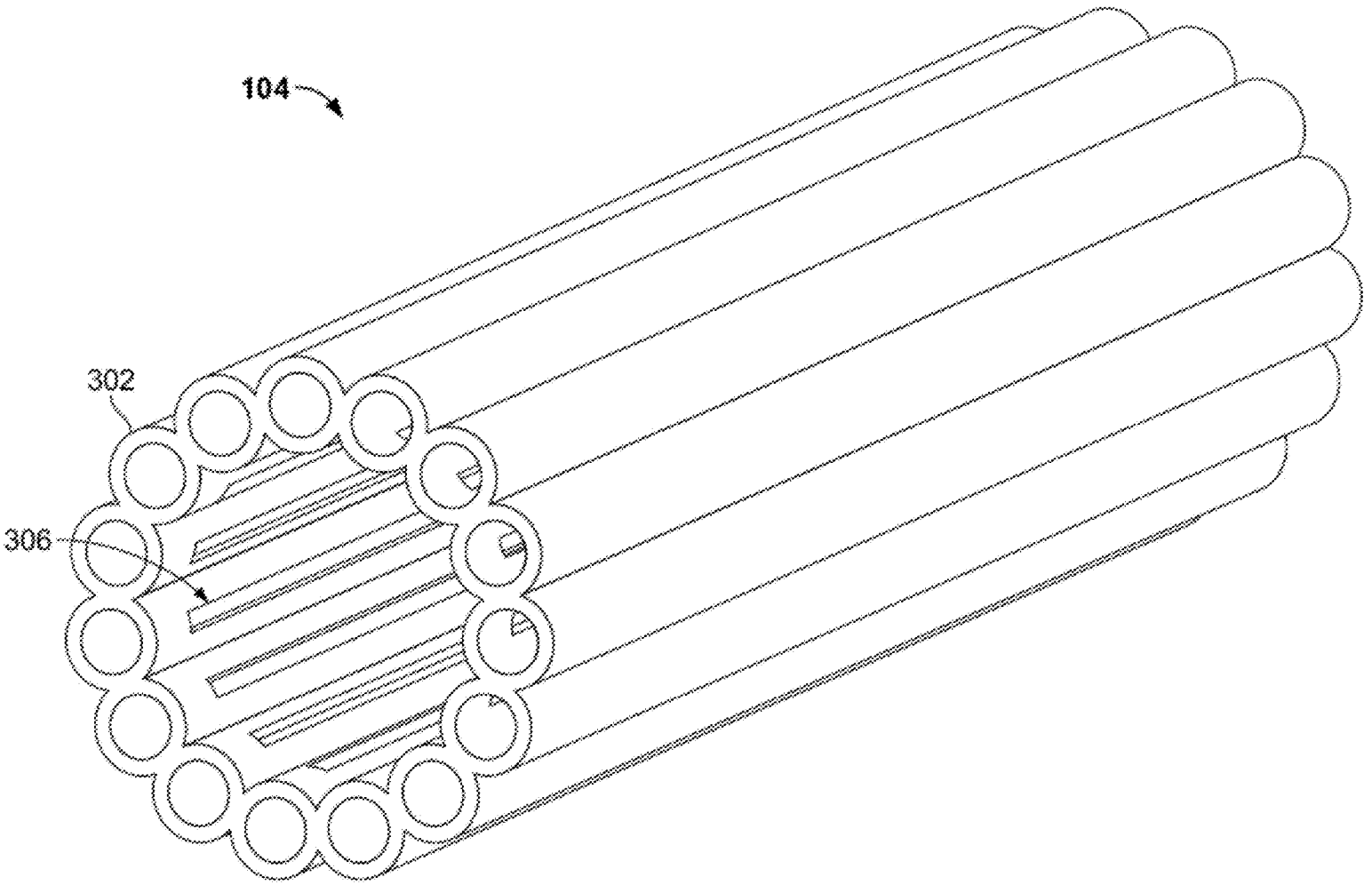
Figure 5A:
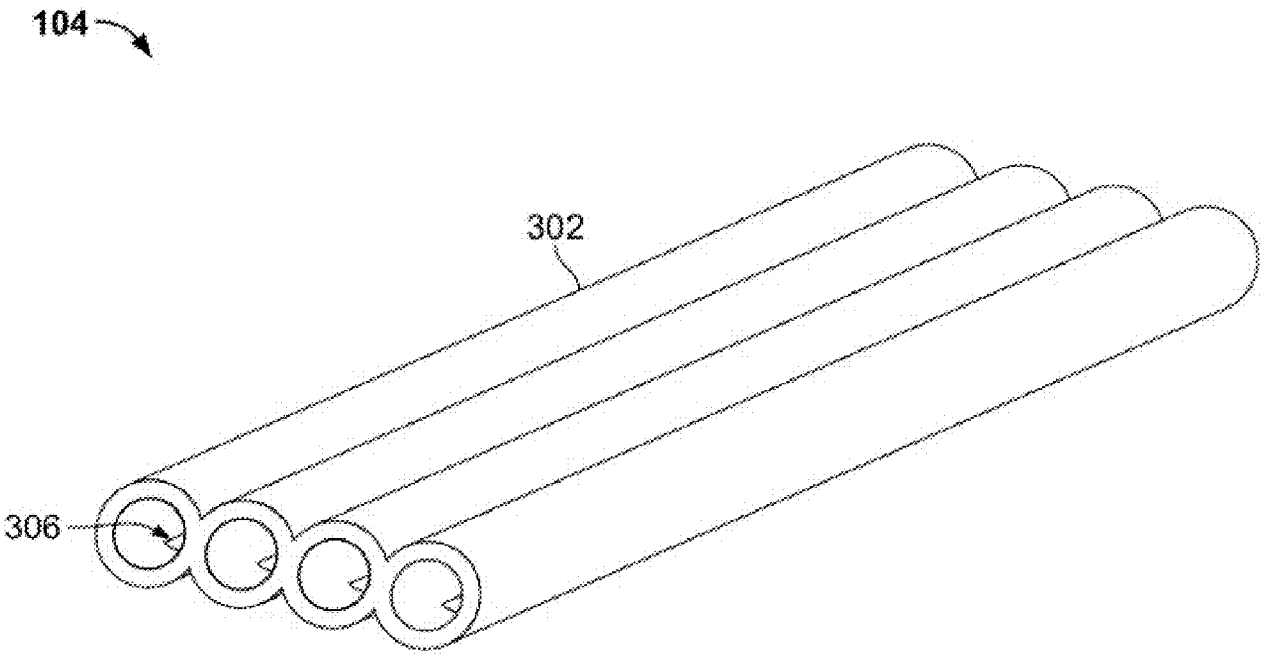
Figure 5B:
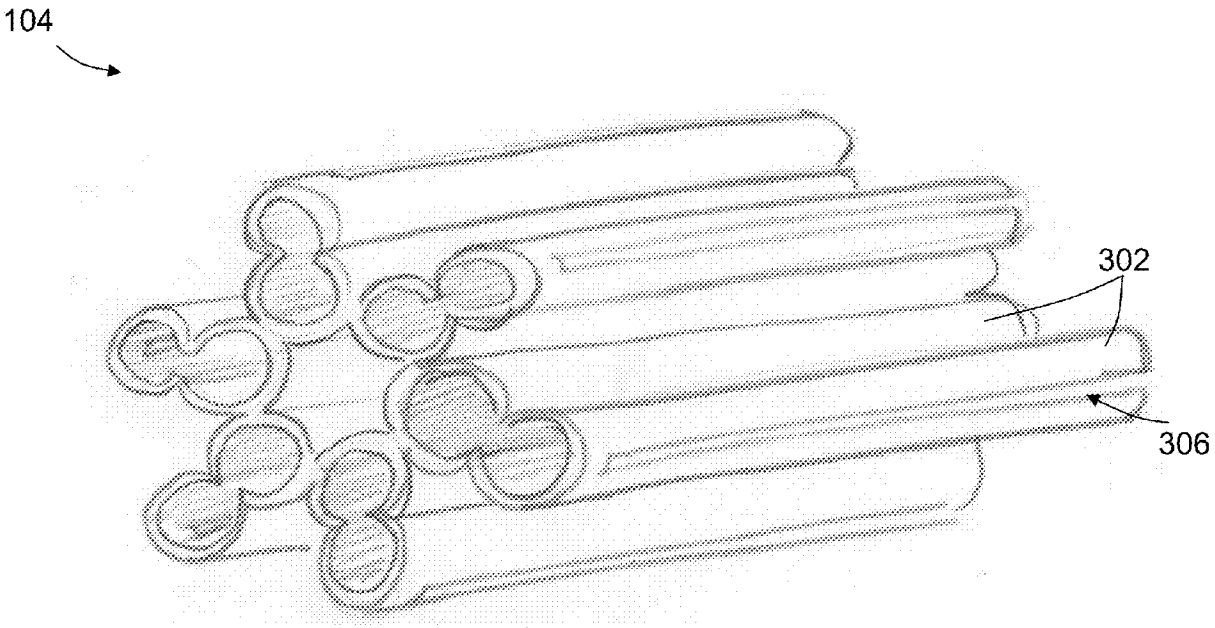

Referring to FIG. 3B, in exemplary embodiments, one or more projectile feed sub-assemblies 104' and/or sub-assemblies 104" can be combined together to create a substantially singular projectile feed assembly 104. Further, at least one projectile advancer 604 (discussed in more detail below) can be placed into one or more projectile feed sub-assemblies 104' and/or sub-assemblies 104" combined together to create a substantially singular projectile feed assembly 104. A plurality of projectile feed sub-assemblies 104' and/or sub-assemblies 104'" can be combined to create projectile feed assembly 104 to, for example, reduce construction costs and/or ease construction. Further, in exemplary embodiments, additional projectile feed assemblies may be added to increase the length of projectile feed assembly 104 such that additional projectiles 102 can be housed in projectile feed assembly 104.

In exemplary embodiments, projectile feed assembly 104 can include any reasonable quantity of receiving bodies 302. For example, referring to FIG. 3A projectile feed assembly 104 is illustratively depicted having twelve (12) receiving bodies 302; referring to FIG. 4A, projectile feed assembly 104 is illustratively depicted having six (6) receiving bodies 302; referring to FIG. 4B, projectile feed assembly 104 is illustratively depicted having fifteen (15) receiving bodies 302; and referring to FIG. 5A, projectile feed assembly 104 is illustratively depicted having four (4) receiving bodies 302. It will be understood that projectile feed assembly can include as few receiving bodies as one to as many hundreds and/or thousands of receiving bodies. The quantity of receiving bodies 302 may be increased such that additional projectiles can be housed in toy launcher 100.

In exemplary embodiments, the arrangement of a plurality of receiving bodies 302 can form a geometric pattern such as, but not limited to, circular, polygonal, linear, star-shaped, and/or any other reasonable shape capable of being used in toy launcher 100. For example, referring to FIGS. 3A-4B, a plurality of receiving bodies 302 are illustratively depicted forming a substantially circular shape; referring to FIG. 5A, a plurality of receiving bodies 302 are illustratively depicted forming a substantially linear shape; and referring to FIG. 5B, a plurality of receiving bodies 302 are illustratively depicted forming a star shape.

It will be understood that any of the techniques described herein can be used and/or modified such that toy launcher 100 can function with different shaped receiving bodies 302 and/or projectile feed assembly 104 without deviating from the scope of the invention. For example, rather than rotating projectile feed assembly 104, as described at times herein, projectile feed assembly 104 may translate back and forth, up and down, any combination thereof, and/or move by any reasonable technique and/or in any reasonable direction that can allow projectiles to advance through a plurality of receiving bodies.

In exemplary embodiments, receiving body 302 can include at least one interfacing region 306 and interfacing region 306 can be located at any reasonable location along receiving body 302. For example, referring to FIGS. 3A-4A interfacing region 306 is illustratively depicted on the outside facing surface of receiving bodies 302 and referring to FIG. 4B interfacing region 306 is illustratively depicted on the inside facing surface of receiving bodies 302. For ease, at times, interfacing region 306 is only illustratively depicted on the outside facing surface of receiving bodies 302. This is merely for ease and is in no way meant to be a limitation.

Further, interfacing region 306 can be, but is not limited to, at least one slot that can extend at least some length of receiving body 302, at least one opening in receiving body 302, and/or any reasonable gap, opening, and/or passage that can allow projectiles housed in receiving body 302 to be engaged. For ease, at times, interfacing region 306 is illustratively depicted as slot extending substantially the length of receiving body 302. This is merely for ease and is in no way meant to be a limitation.

Further still, in exemplary embodiments, at least one receiving body 302 can be accessed by at least one interfacing region 306 such that at least one projectile 102 housed in a receiving body can be accessed and/or such that a plurality of projectiles 102 housed in a plurality of receiving bodies can be accessed and/or such that a plurality of projectiles 102 housed in a single receiving body can be accessed. In exemplary embodiments, a plurality of receiving bodies can be arranged such that more than one projectile can be launched at substantially the same time and/or in rapid succession. For example, referring to FIGS. 4A-5A, a single receiving body 302 can be accessed via a single interfacing region 306 such that only projectiles housed in that receiving body can be accessed. As another example, referring to FIG. 5B, a plurality of receiving bodies 302 can be accessed via a single interfacing region 306 such that a plurality of projectiles housed in a plurality of receiving bodies can be accessed.

It will be understood that any number of receiving bodies can be accessed by any number of interfacing regions. For ease, at times, only one or two receiving bodies are described as being accessed. This is merely for ease and is in no way meant to be a limitation. Further, it will be understood that any of the techniques used for one receiving body being accessed can similarly be used for two or more receiving bodies being accessed and any of the techniques used for two receiving bodies being accessed can similarly be used for one receiving body being accessed.

In exemplary embodiments, projectiles 102 can be housed sequentially along the length of a projectile receiving body 302 such that when force is applied on a proximally located projectile 102 a distally located projectile 102 housed in that same projectile receiving body can be driven forward. This forward driving can cause at least one projectile 102 nearer to the exit of toy launcher 100 (i.e., the most distally located projectile 102 housed in that projectile receiving body 302) to be launched from toy launcher 100. Further, between, before, and/or after at least one projectile 102 is launched from toy launcher 100, projectile feed assembly 104 can rotate. For ease, at times, this rotation is not described and/or described separately. This is merely for ease and is in no way meant to be a limitation.

In exemplary embodiments, projectiles 102 housed in projectile receiving bodies 302 can be advanced using any reasonable technique such as, but not limited to, air compression, at least one engagement mechanism, a plurality of rotating bodies, a rotating tread/track assembly, and/or by any reasonable technique capable of imparting a force directly and/or indirectly on projectile 102 causing at least one projectile 102 to advance through projectile feed assembly 104. For example, using air compression, at least one projectile 102 housed in a projectile receiving body 302 can be advanced by applying a positive air pressure behind projectile 102 and/or a negative air pressure in front of projectile 102. This positive air pressure may be provided by at least one of a compressed air chamber and/or air compressor.

As another example, using a plurality of rotating bodies, at least one projectile 102 housed in a projectile receiving body 302 can be advanced by, for example, a plurality of mechanically driven rollers located along at least some of the length of projectile receiving body 302. As yet another example, using a tread/track assembly, at least one projectile 102 housed in a projectile receiving body 302 can be advanced by being placed on a mechanically driven tread/track extending along at least some of the length of projectile receiving body 302.

As still another example, using at least one engagement mechanism, at least one projectile 102 housed in a projectile receiving body 302 can be advanced by having a force applied behind and/or along at least some length of projectile 302 by at least one engagement mechanism. Further, using at least one engagement mechanism, a plurality of projectiles 102 housed in a plurality of projectile receiving bodies 302 can be advanced, for example, substantially simultaneously, by having a force applied behind and/or along at least some length of projectile 302 by at least one engagement mechanism. The engagement mechanism can, for example, extend from the proximal end 305 of an opening 303 to the rear of a projectile 302; extend at least partially through interfacing region 306 to the rear and/or side of projectile 302; and/or extend at least partially through interfacing region 306 to the rear and/or side of projectile 302.

Figure 6A:
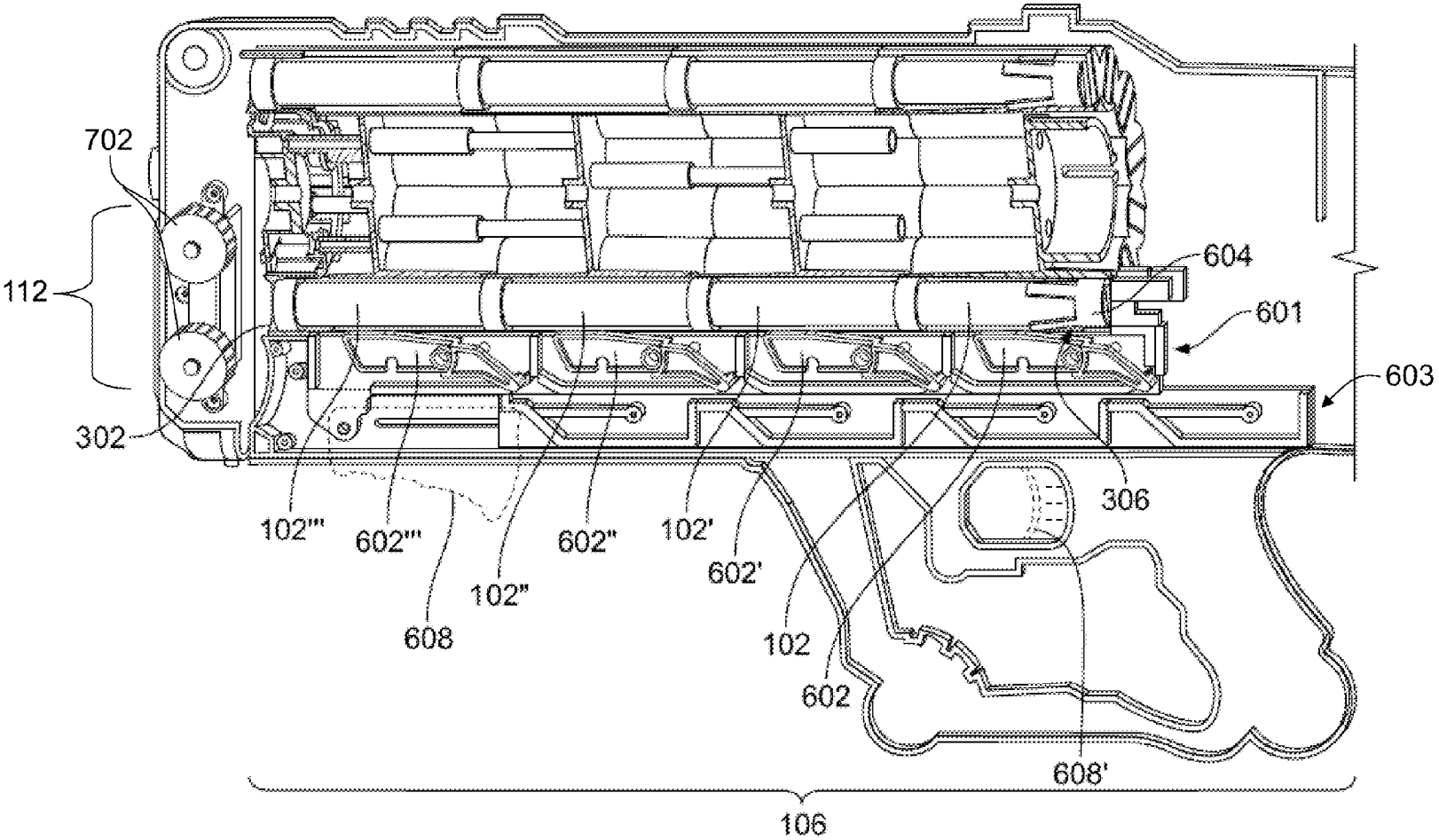
FIGS. 6A-6L illustratively depict projectiles advanced in a receiving body of a projectile feed assembly, in accordance with exemplary embodiments of the present invention.
Figure 6B:
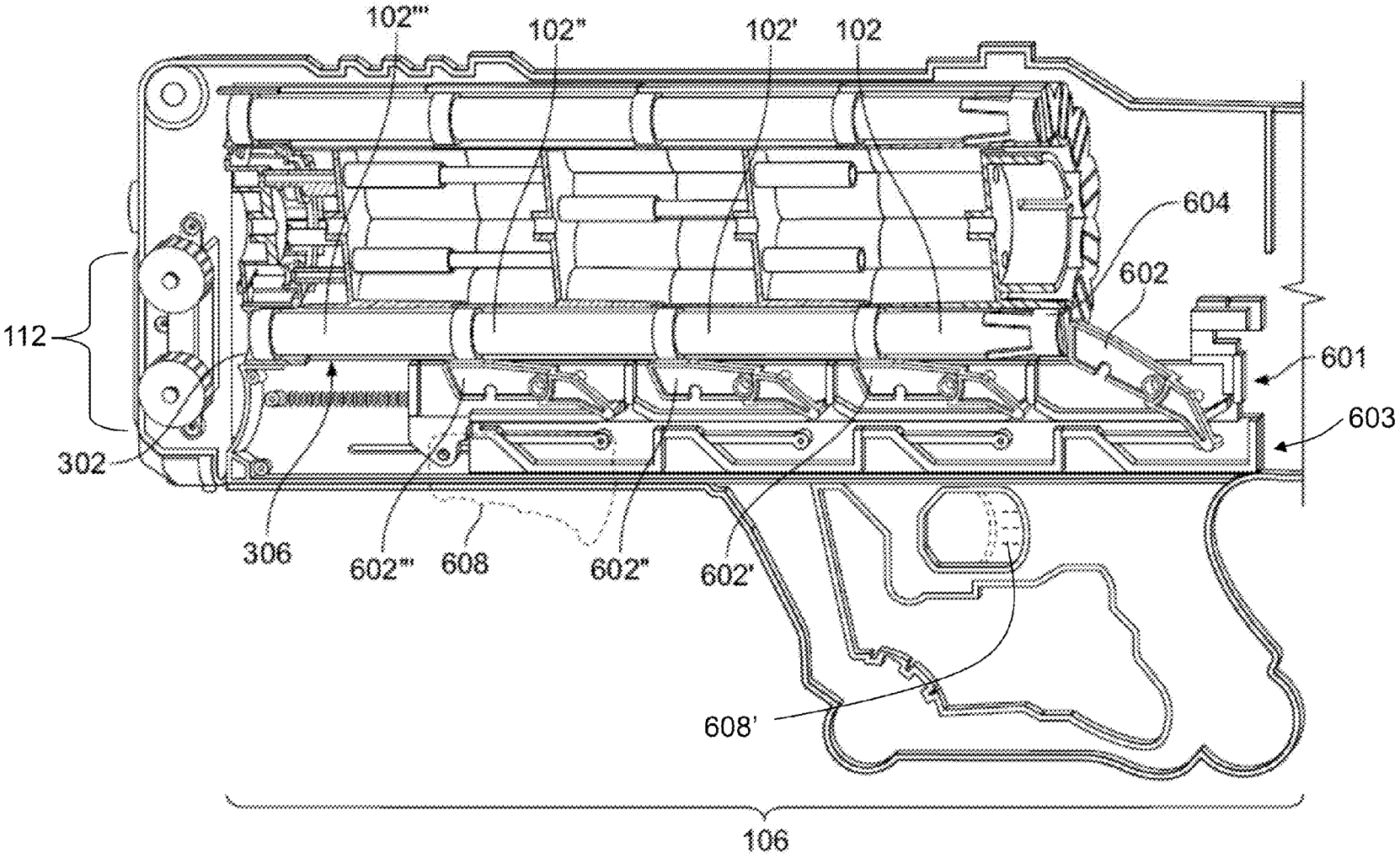
Figure 6C:
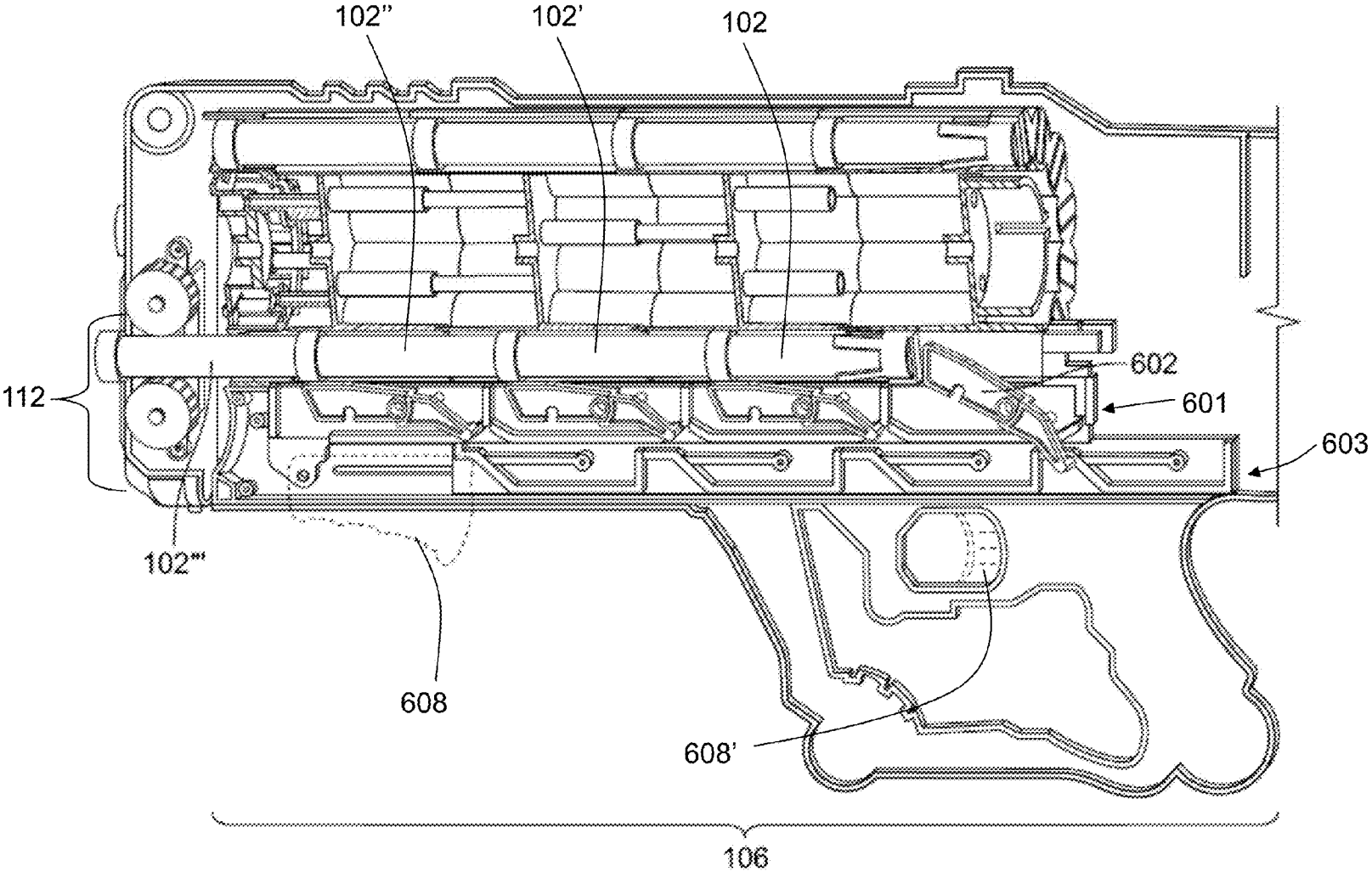
Figure 6D:
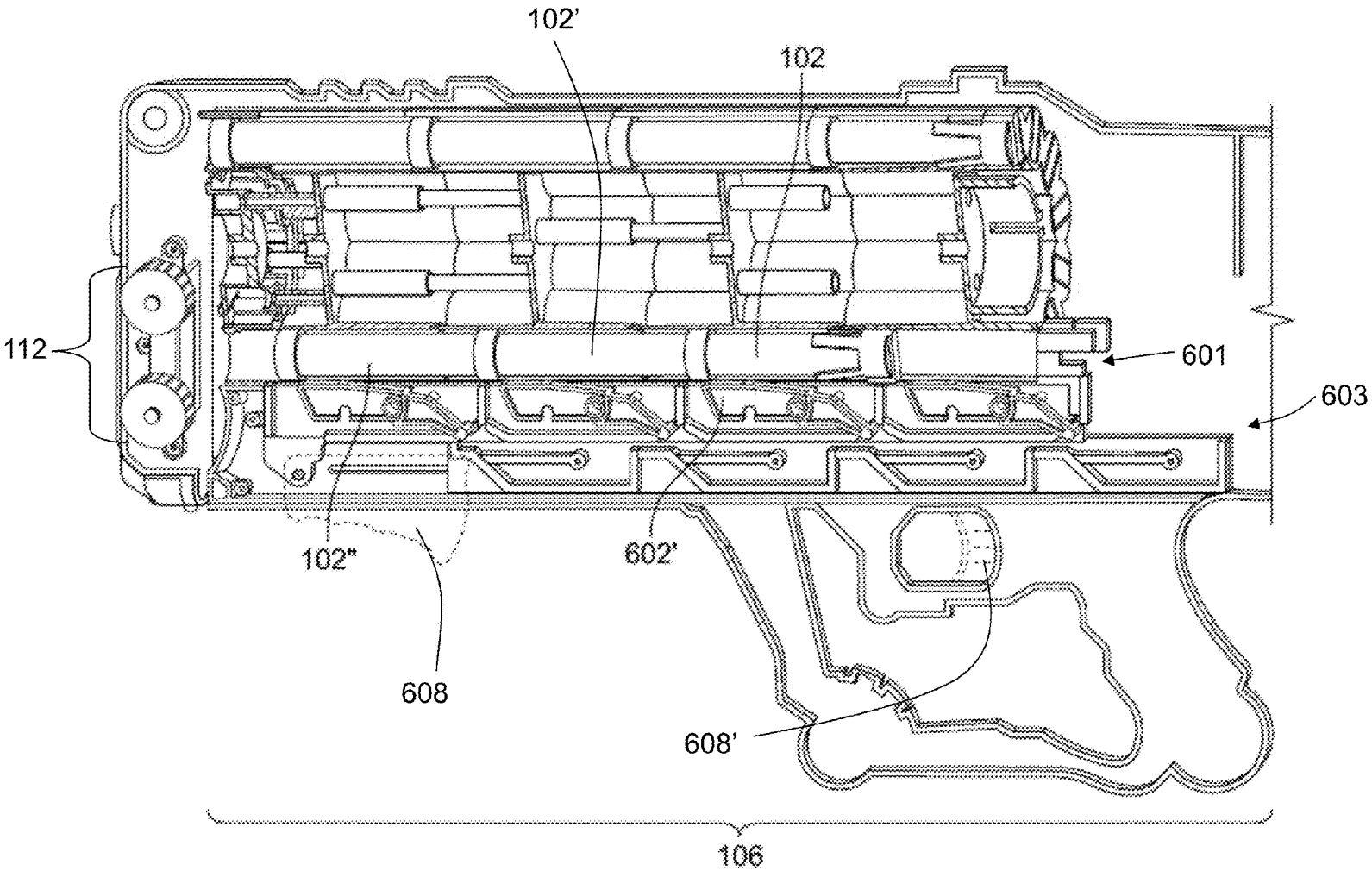
Figure 6E:
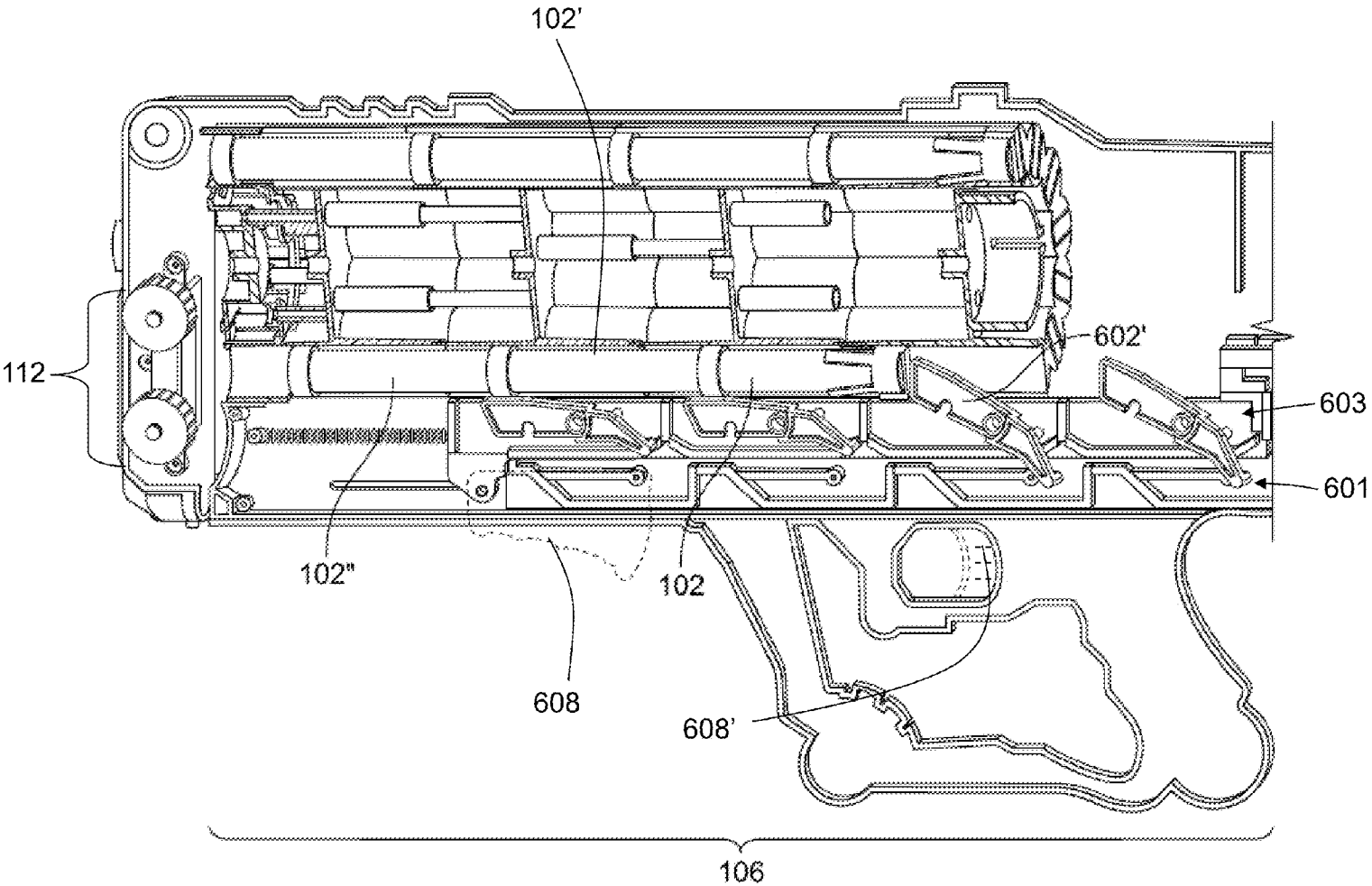

Referring to FIGS. 6A-6L, in exemplary embodiments, at least one technique for advancing projectiles 102 through projectile feed assembly 104 using a plurality of engagement mechanisms 602 extending at least partially through interfacing region 306 is illustratively depicted. By way of example, referring to FIG. 6A-6B, during use slide rack assembly 601 can be driven in a proximal/rearward direction (e.g., by the user moving user interface 608 in a reward proximal/direction) causing engagement mechanisms 602 to pivot/rotate in a first direction. Referring to FIG. 6B, when pivoted, engagement mechanism 602 can extend substantially through interfacing region 306 and engage projectile advancer 604 at a first location. Referring to FIG. 6C, with projectile advancer 604 engaged, slide rack assembly 601 can be driven in a distal/forward direction advancing projectiles 102 to a second location thereby causing projectile 102''' to interact with accelerator 112 such that projectile 102''' can be launched from toy launcher 100. Referring to FIG. 6D, after advancing projectile 102 to the second location, engagement mechanisms 602 can then pivot/rotate in a second direction thereby restarting the process such that at least one more projectile 102 can be launched from toy launcher 100.

It will be understood that before restarting the process, as discussed below, projectile feed assembly 104 can rotate and/or translate such that a different receiving body 302 can be accessed to advance projectiles 102. Further, these different projectiles may be at any location along the length of receiving body 302 and can be accessed and advanced using the techniques described herein and/or using any other reasonable technique. Further, any reasonable number of engagement mechanisms can be used to advance projectile 102. For ease, at times, only four engagement mechanisms are depicted. This is merely for ease and is in no way meant to be a limitation.

It will be understood that any number of projectiles 102 can be advanced and/or launched from toy launcher 100 between rotations and/or translations of projectile feed assembly 104. For example, one, more than one and/or all of the projectiles housed in at least one receiving body 302 can be advanced and/or launched from toy launcher 100 between rotations and/or translations of projectile feed assembly 104. Further, a user may have the option of advanced and/or launched one, more than one and/or all of the projectiles housed in at least one receiving body 302 from toy launcher 100 between rotations and/or translations of projectile feed assembly 104. For ease, it is depicted, at times, that a single projectile 102 is launched between rotations and/or translations of projectile feed assembly 104. This is merely for ease and is in no way meant to be a limitation.

It will be understood that either of projectile feed assembly 104 and any remaining number of elements of launcher 100 can rotate and/or translate relative to each other. For example, projectile feed assembly 104 can rotate and/or translate relative to accelerator 112, accelerator 112 can rotate and/or translate relative to projectile feed assembly 104, and/or any remaining element(s) of launcher 100 can rotate and/or translate relative to projectile feed assembly 104 and/or any other remaining element(s) of launcher 100. For ease, projectile feed assembly 104 is depicted, at times, as rotating and/or translating relative to accelerator 112. This is merely for ease and is in no way meant to be a limitation.

Figure 6F:
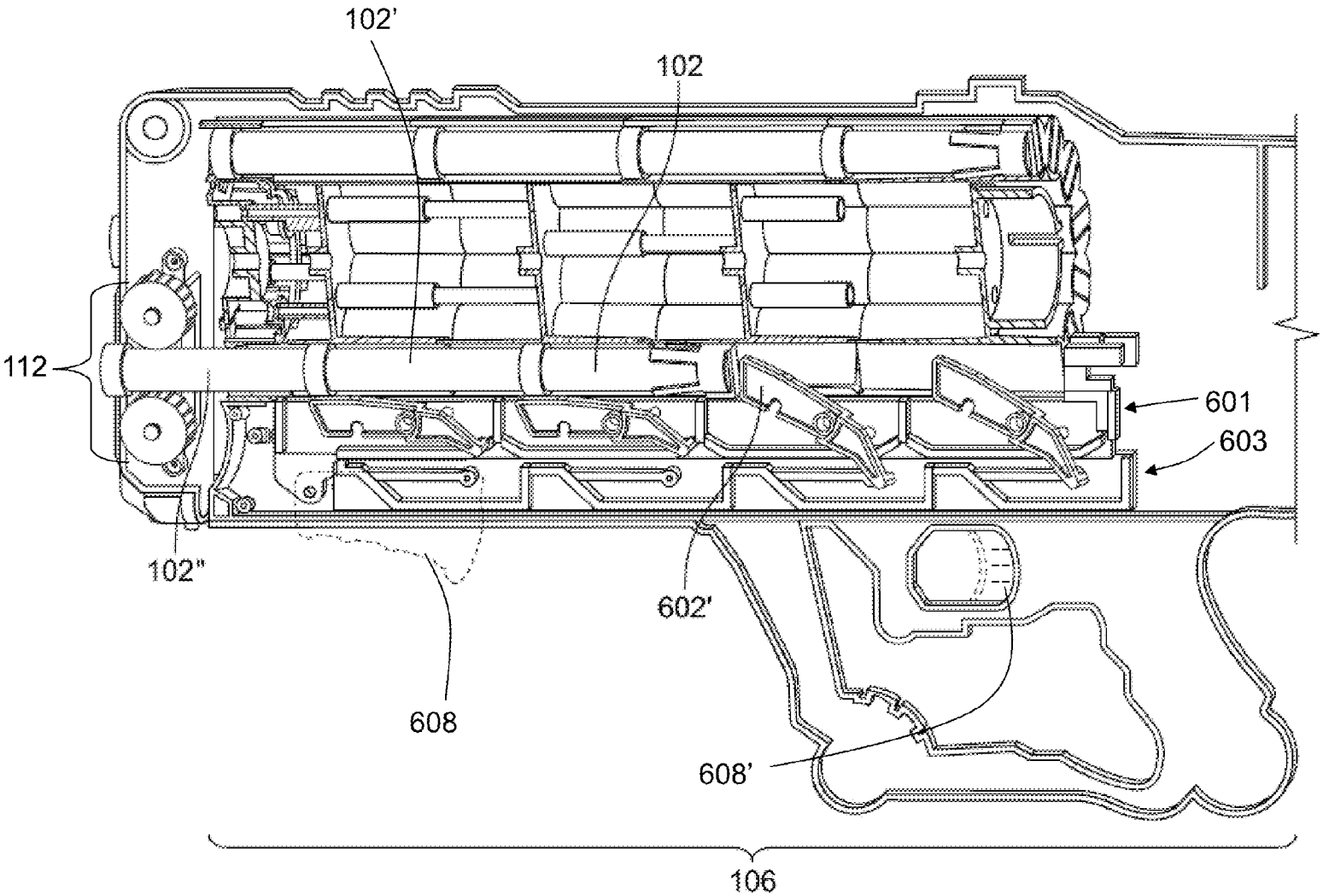
Figure 6G:
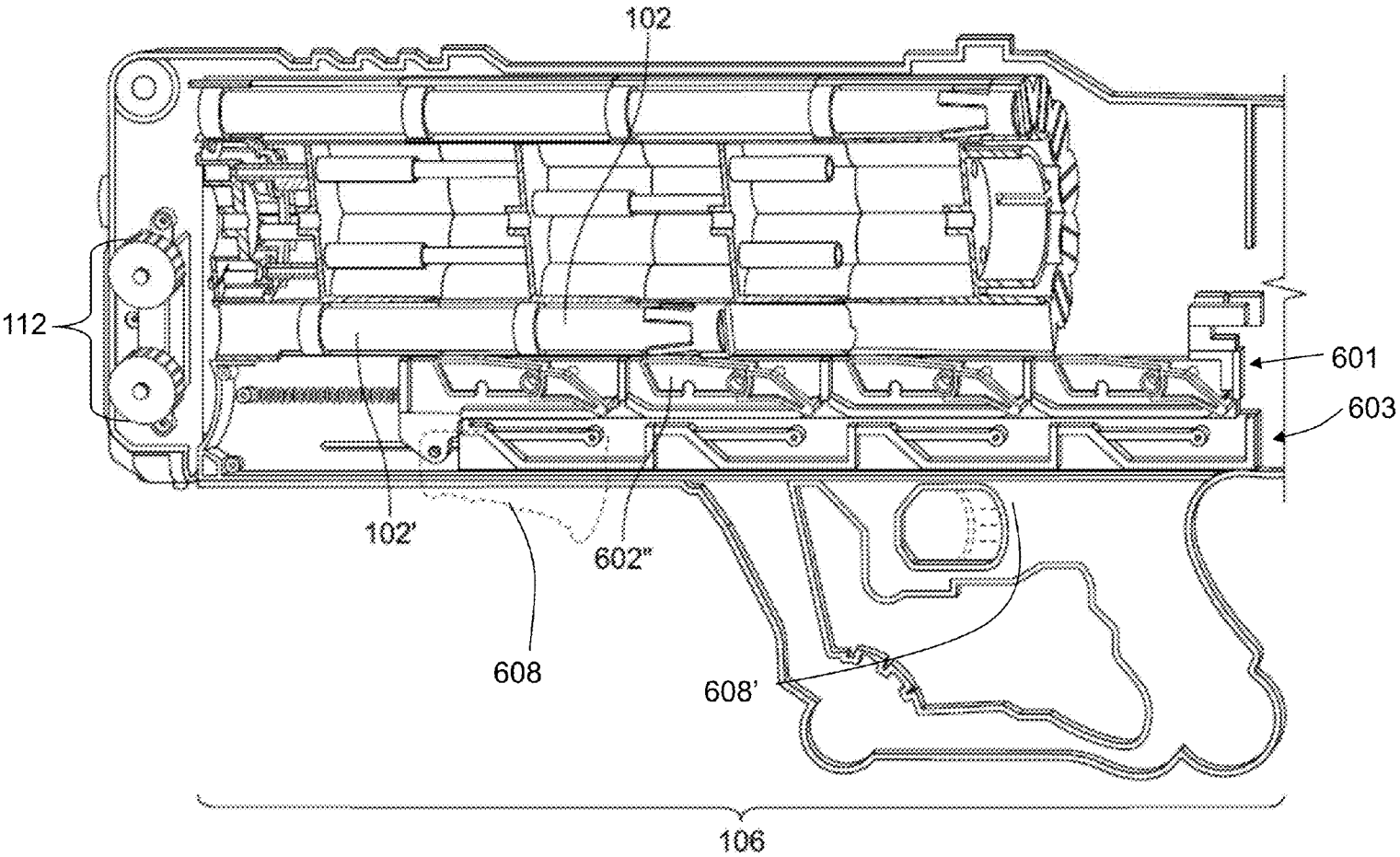

Referring to FIGS. 6D-6G, in some instances, when the process is restarted a different second engagement mechanism 602' can engage projectile advancer 604 which has advanced to second location. For example, referring to FIG. 6E, slide rack assembly 601 can be driven in a proximal/rearward direction (e.g., by rearward movement of user interface 608_) causing a second engagement mechanisms 602' to pivot/rotate in the first direction into engagement with projectile advancer 604. Referring to FIG. 6F, when pivoted the second engagement mechanism 602' can engage projectile advancer 604 which has advanced to second location. With projectile advancer 604 engaged, slide rack assembly 601 can be driven in the distal/forward direction driving projectile 102 to a third position thereby causing projectile 102" to interact with accelerator 112 such that projectile 102" can be launched from toy launcher 100. Referring to FIG. 6G, after advancing projectile 102 to a third position, the second engagement mechanisms 602' can then pivot/rotate in the second direction thereby restarting the process such that at least one more projectile 102 can be launched from toy launcher 100.

Figure 6H:
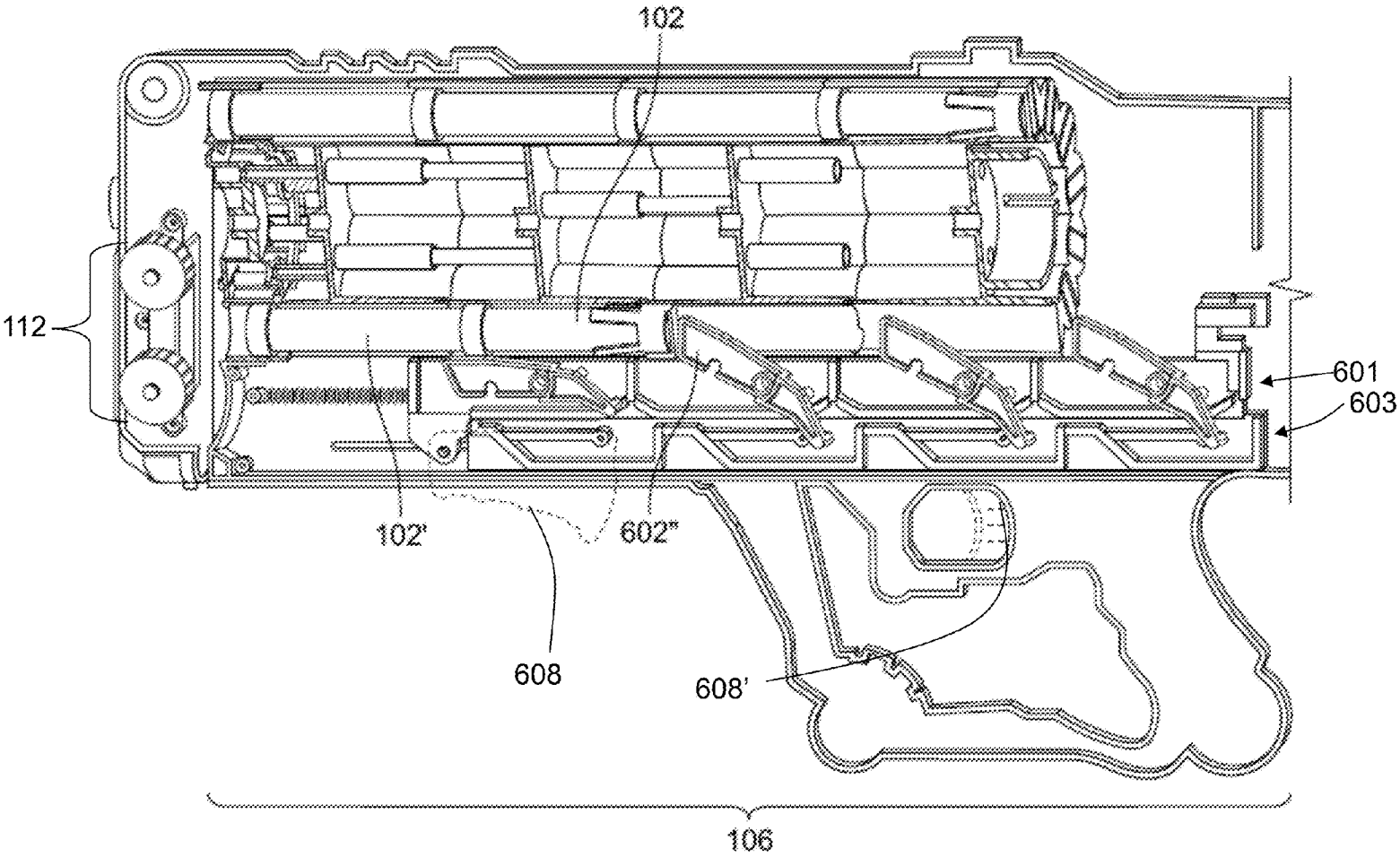
Figure 6I:
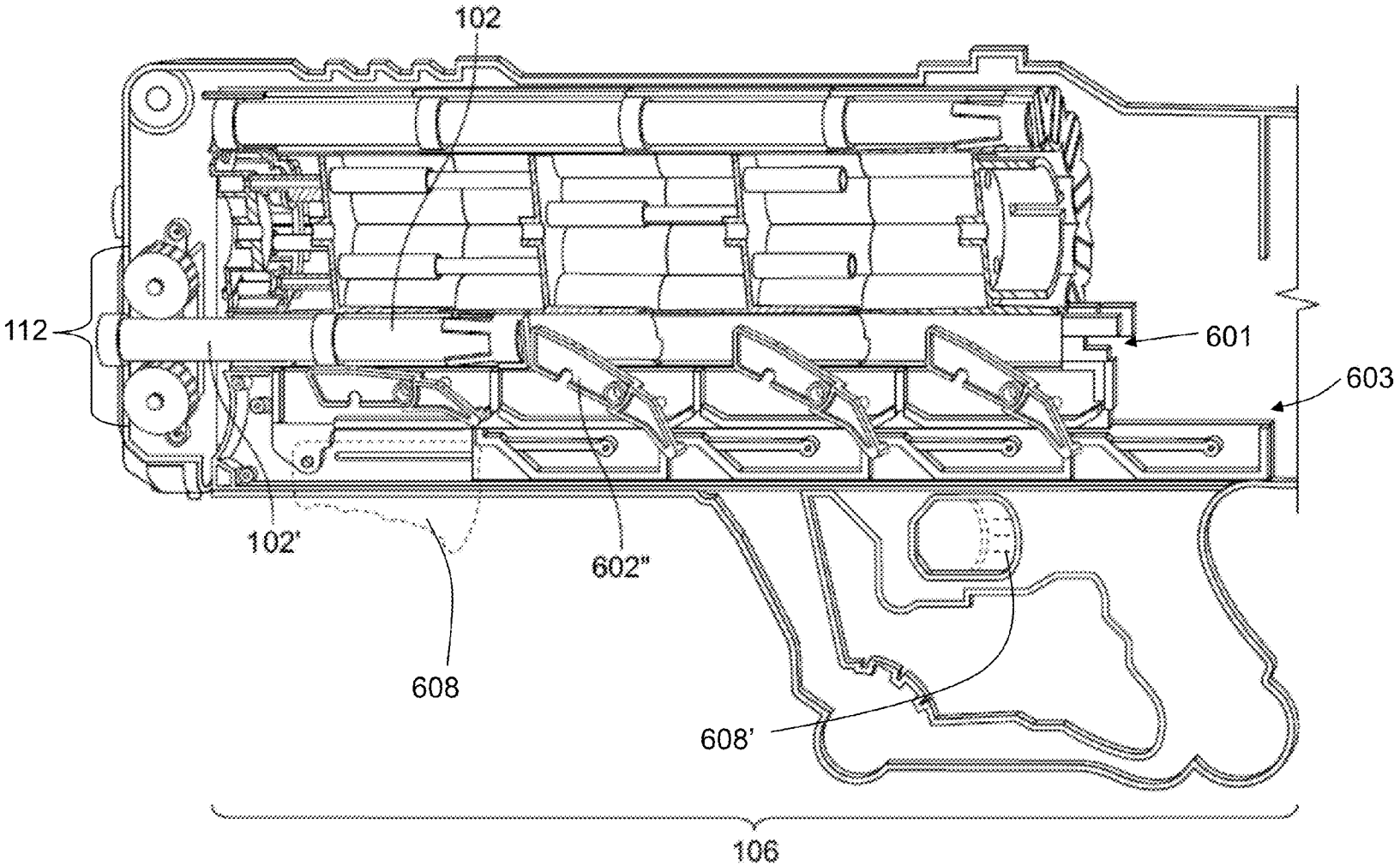
Figure 6J:
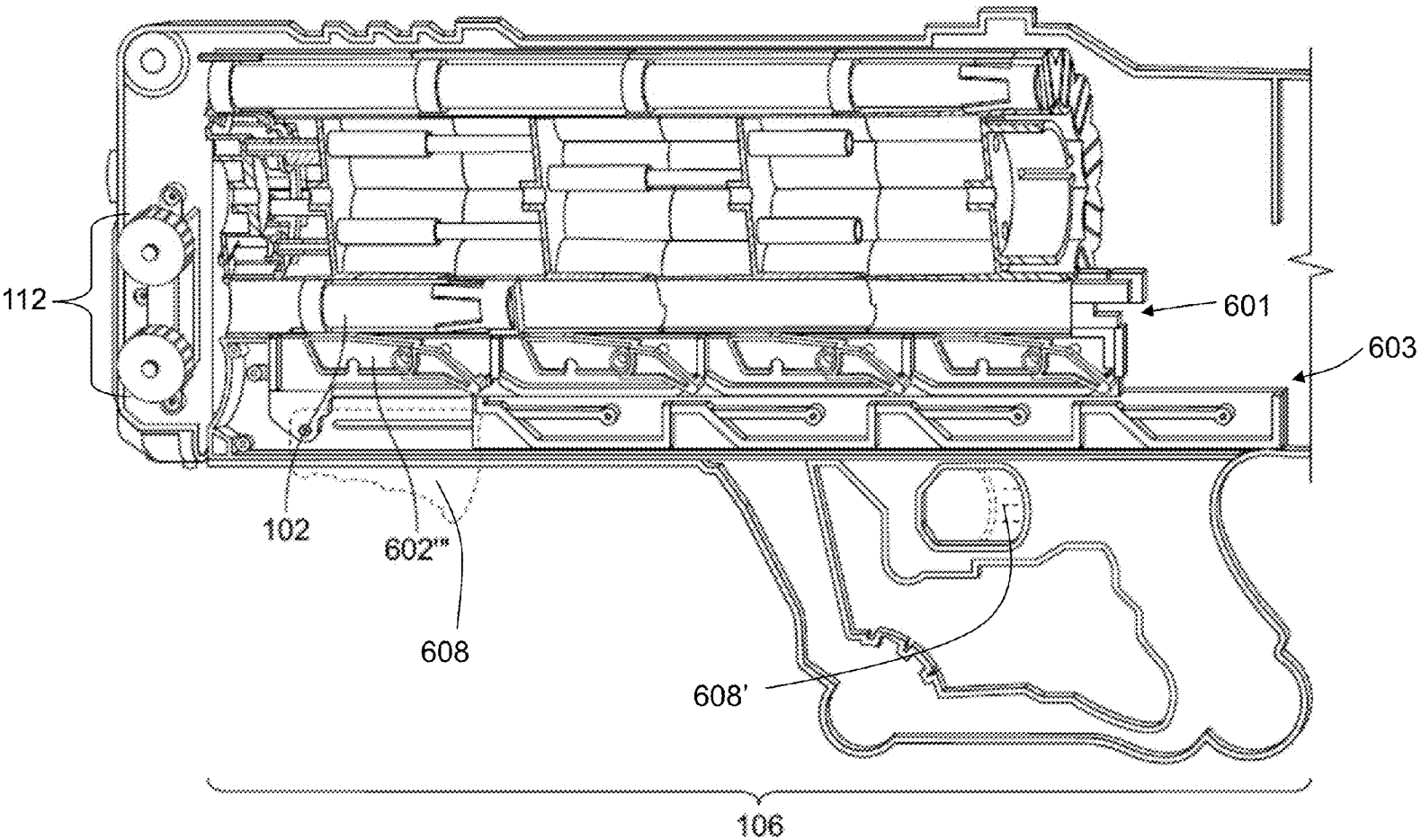

Referring to FIGS. 6G-6J, in some instances, when the process is restarted yet another different third engagement mechanism 602" can engage projectile advancer 604 which has advanced to third position. For example, referring to FIGS. 6G-6H, slide rack assembly 601 can be driven in a proximal/rearward direction causing third engagement mechanisms 602" to pivot/rotate in the first direction into engagement with projectile advancer 604. Referring to FIGS. 6H-6I, when pivoted third engagement mechanism 602" can engage projectile advancer 604 which has advanced to third position. With projectile advancer 604 engaged, slide rack assembly 601 can be driven in the distal/forward direction advancing projectile 102 to a fourth position thereby causing projectile 102' to interact with accelerator 112 such that projectile 102' can be launched from toy launcher 100. Referring to FIG. 6J, after advancing projectile 102 to the fourth position, third engagement mechanisms 602" can then pivot/rotate in the second direction thereby restarting the process such that at least one more projectile 102 can be launched from toy launcher 100.

Figure 6K:
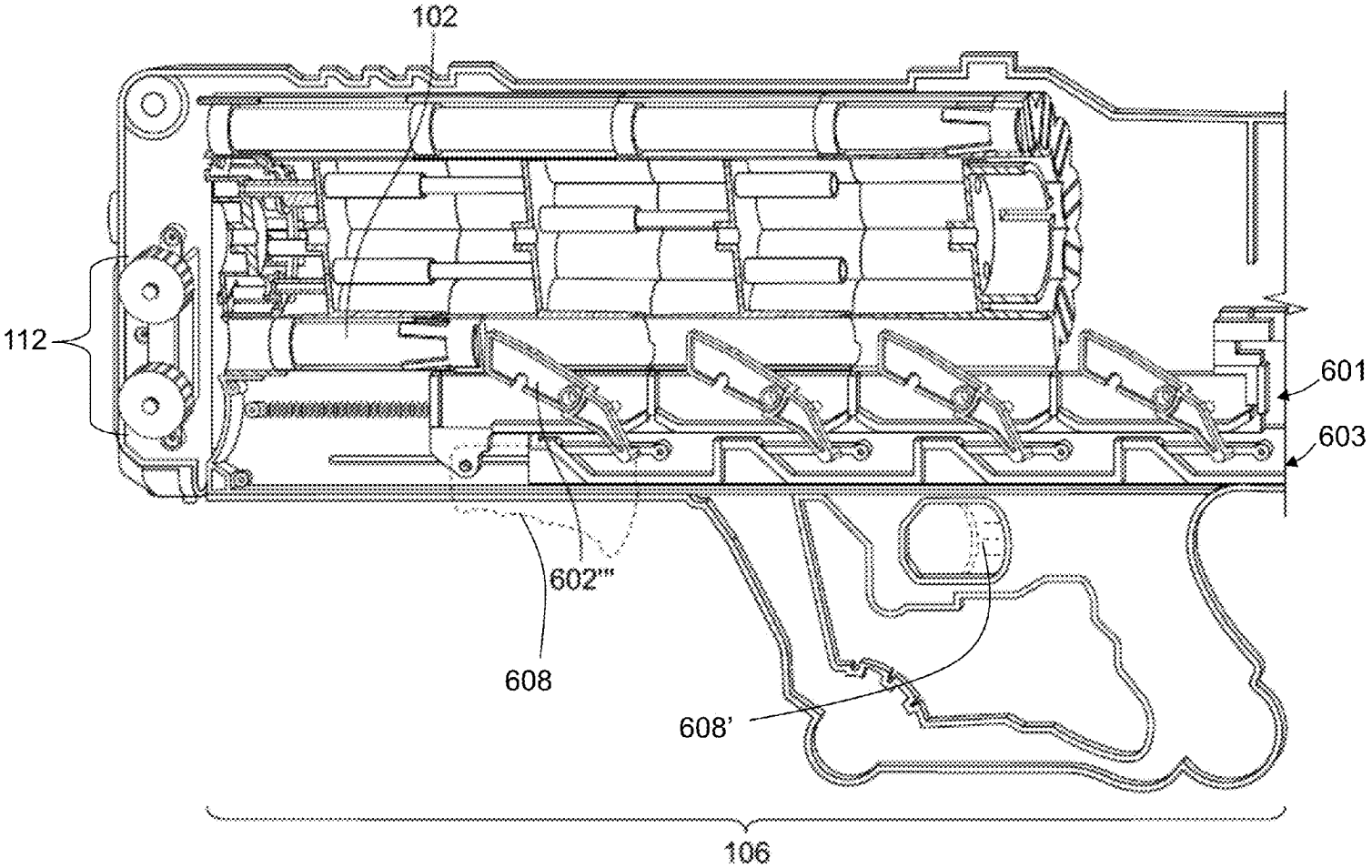
Figure 6L:
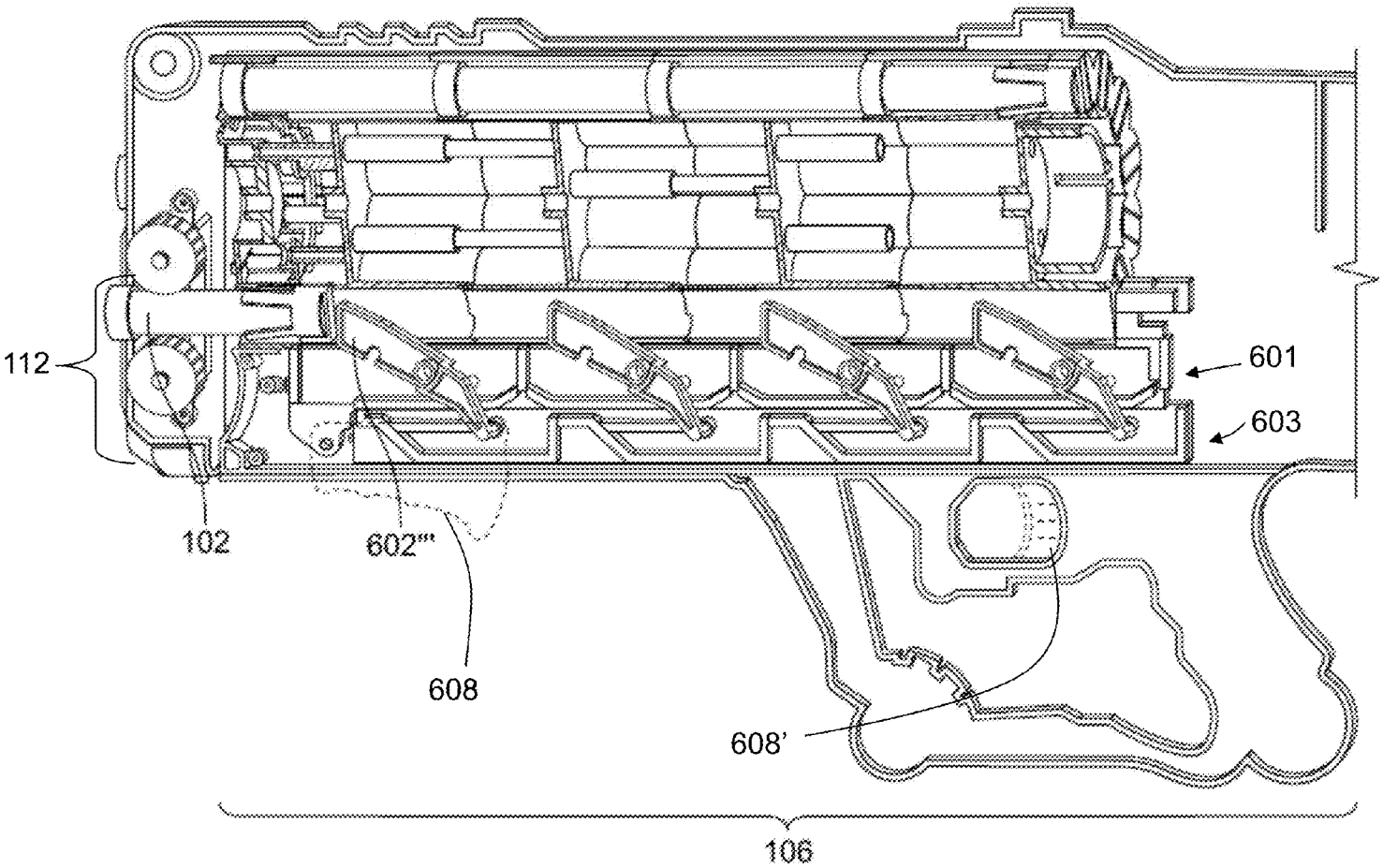

Referring to FIGS. 6J-6L, in some instances, when the process is restarted another different fourth engagement mechanism 602''' can engage projectile advancer 604 which has advanced to fourth position. For example, referring to FIGS. 6J-6K, slide rack assembly 601 can be driven in a proximal/rearward direction causing fourth engagement mechanisms 602''' to pivot/rotate in the first direction into engagement with projectile advancer 604. Referring to FIGS. 6K-6L, when pivoted the fourth engagement mechanism 602''' can engage projectile advancer 604. With projectile advancer 604 engaged, slide rack assembly 601 can be driven in the distal/forward direction advancing projectiles 102 forward thereby causing projectile 102 to interact with accelerator 112 such that projectile 102 can be launched from toy launcher 100. After advancing at least one projectile 102, fourth engagement mechanisms 602''' can then pivot/rotate in the second direction thereby restarting the process.

In exemplary embodiments, the distance which slide rack assembly 601 translates in a distal/forward and proximal/backward direction can be substantially equal to and/or slightly larger than the length of a single projectile 602. This can substantially reduce the amount of force required to move slide rack assembly 601 and/or reduce mechanical wear on toy 100.

It will be understood that engagement mechanism 602 may be able to engage projectile 102 directly rather than, for example, engaging projectile advancer 604. For ease, at times, engagement mechanism 602 is depicted as engaging projectile advancer 604. This is merely for ease and is in no way meant to be a limitation. Further, projectile advancer 604 can be designed to reduce stress concentration on projectile 102 when advanced. This may be done to reduce damage that may be caused to projectile 102 such as, but not limited to, tearing and/or ripping of projectile 102.

Further, to engage projectile 102 and/or projectile advancer 604, engagement mechanism 602 can substantially extend through interfacing region 306; projectile 102 and/or projectile advancer 604 can substantially extend through interfacing region 306; and/or projectile 102, projectile advancer 604, and/or engagement mechanism 602 can partially extend through interfacing region 306. For ease, engagement mechanism 602 is illustratively depicted, at times, as substantially extending through interfacing region 306. This is merely for ease and is in no way meant to be a limitation.

It will be understood that engagement mechanism 602 can be engaged by any number of mechanical element(s), electromechanical element(s), and/or any combination thereof that can cause engagement mechanism 602 to pivot/rotate. This rotating/pivoting can be driven by any element such as, but not limited to, a spring, a track assembly, a chord, a pusher, a puller, a motor, gearing assembly, piston, any combination or further separation thereof, and/or any element capable of causing engagement mechanism to rotate/pivot. For ease, at times, not all techniques and elements that can cause rotation/pivoting of engagement mechanism 602 are described. This is merely for ease and is in no way meant to be a limitation.

For example, engagement mechanism 602 can be rotatably/pivotably coupled to slide 601 and engagement mechanism 602 can be forcibly engaged by a torsion spring (not shown). Further, launcher 100 can include a slide interfacing region 603 constructed such that as slide 601 translates relative to a slide interfacing region 603 engagement mechanism can move between a confined position wherein engagement mechanism is forcibly confined in first position, a rotably/pivotable position wherein engagement mechanism 602 is capable of rotating/pivoting to a second position, and back to a confined position wherein engagement mechanism 602 is forced back to the first position. As another example, engagement mechanism 602 can be rotatably/pivotably coupled to slide 601 and engagement mechanism 602 can be engaged on a track (not shown) in, for example, interfacing region 603 such that as slide 601 translates engagement mechanism 602 rides the track causing it to rotate/pivot. As yet another example, engagement mechanism 602 can pivot/rotate when force is applied from a motor.

Slide rack assembly 601 can be driven by a user applying force on and/or interacting with user interface 608 and/or interface 608'. For example, slide rack assembly 601 can be manually operated by a user applying substantial enough force to drive user interface 608 in a forward and backward direction. As another example, slide rack assembly 601 can motorized such that it can shuttle in a forward and backward direction when a user applies force on and/or interacts with user interface 608' and/or user interface 608.

Referring to FIGS. 7A-7D, in exemplary embodiments, projectile launch assembly (not fully shown) can be constructed of at least one accelerator 112 that can receive projectile 102 exiting and/or about to exit receiving body 302 and accelerate projectile 102 out of toy launcher 100. It will be understood that accelerator 112 can be, but is not limited to, at least one rotating body, a pressurized gas, a pressurized liquid, a spring like device, and/or any reasonable device capable of accelerating projectile 102. For ease, accelerator 112 is, at times, depicted and/or described as at least one rotating body 702. This is merely for ease and is in no way meant to be a limitation.

Figure 7A:
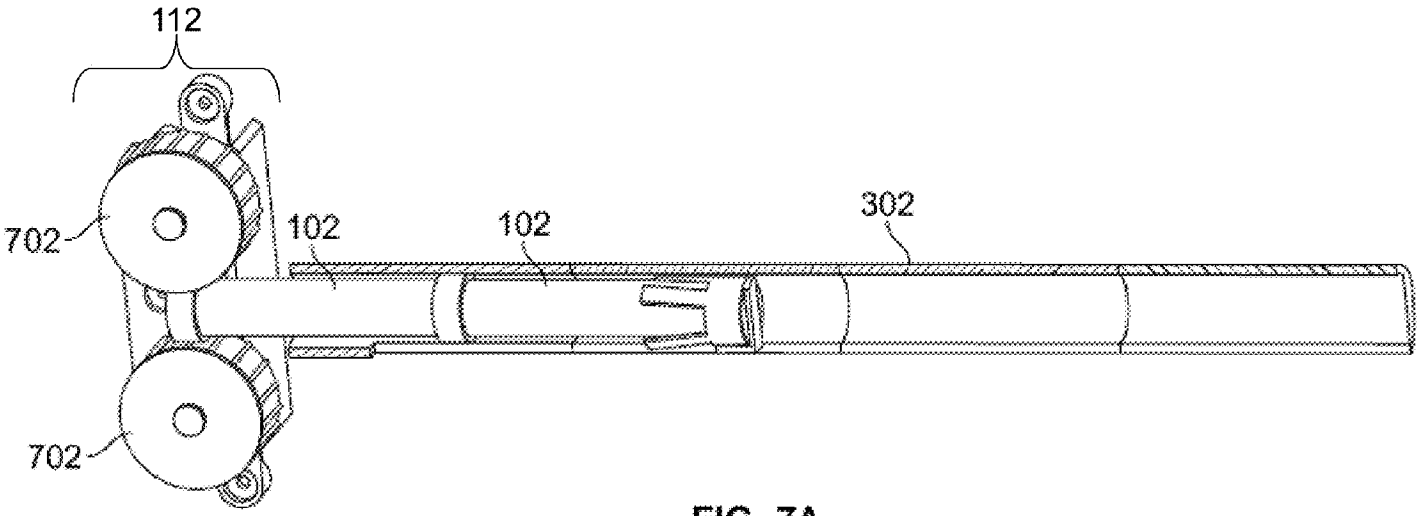
FIGS. 7A-7F illustratively depict projectiles accelerated by various projectile launch assemblies, in accordance with exemplary embodiments of the present invention.
Figure 7B:
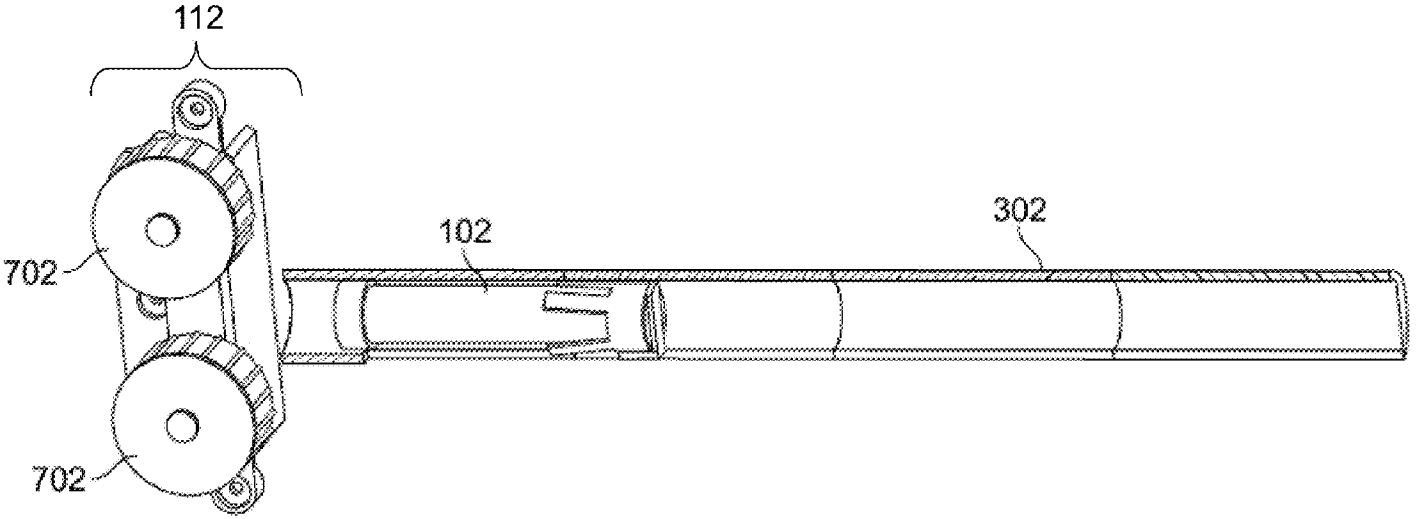
Figure 7C:
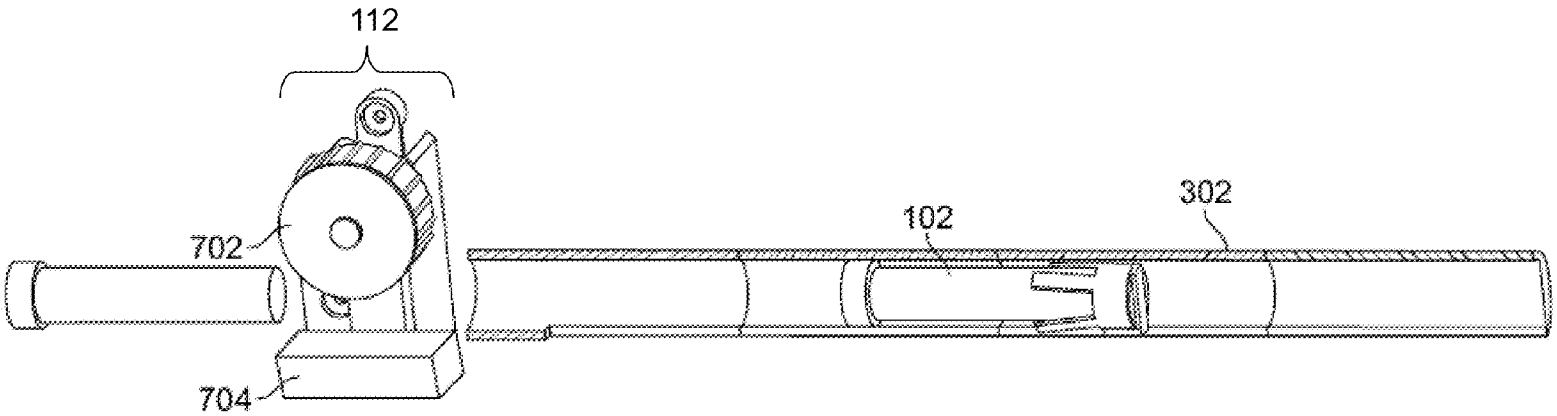

Referring to FIG. 7A-7B, accelerator 112 can include at least one rotating body such that when at least some of projectile 102 has exited the distal end of receiving body 302 at least some portion of projectile 102 can contact at least one rotating body 702 causing projectile 102 to accelerate out of the receiving body 302 and/or toy launcher 100.

Figure 7D:
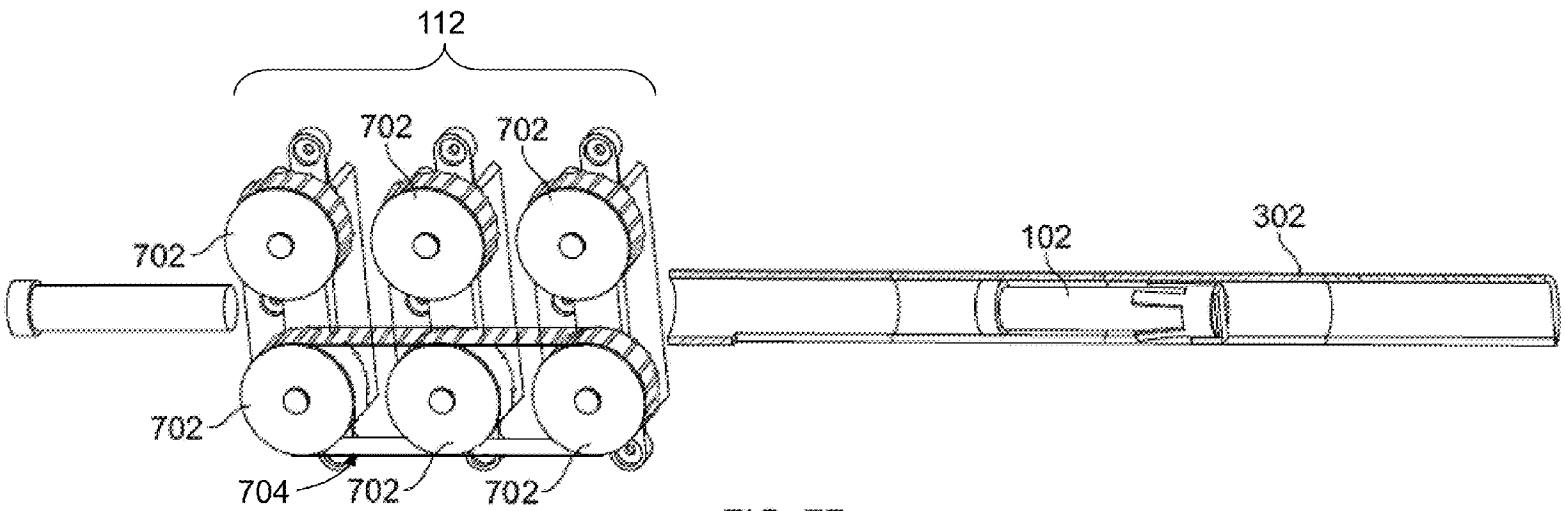

It will be understood that any reasonable number rotating bodies 702 can be used to accelerate projectile 102 from launcher 100. For example, referring to FIG. 7C, only one rotating body 702 may be required to accelerate projectile 102 from toy launcher 100. As another example, referring to FIG. 7D, more than two rotating bodies 702 can be used to accelerate projectile 102 from launcher 100. Further, in exemplary embodiments, accelerator 102 can include at least one tread/track 704. It will be understood that at least one tread/track 704 can be located on any number of rotating bodies. For ease, as shown in FIG. 7D tracker/tread 704 is illustratively depicted on one set of rotating bodies 702. This is merely for ease and is in no way meant to be a limitation.

Figure 7E:
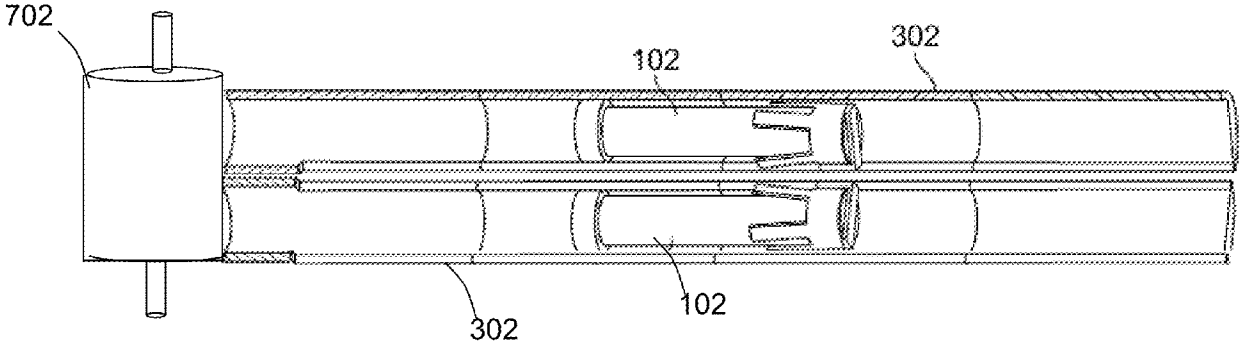
Figure 7F:
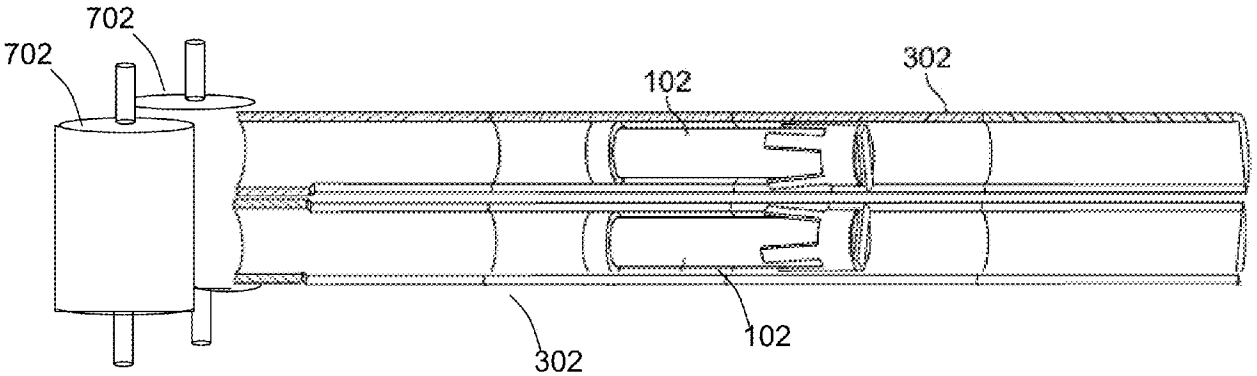

It will be understood that at least one rotating body 702 can located at any reasonable position such that projectile 102 can be launched from launcher 100. For example, referring to FIGS. 7A-7D, at least one rotating body 702 can be positioned such that the upper and/or lower regions of the projectile interface with at least one rotating body and/or referring to FIGS. 7E-7F, at least one rotating body can be positioned such that at least one sidewall of the projectile can interface with at least on rotating body. In some instances, the positioning of at least one rotating body may be selected such that more than one projectile may be launched at substantially the same time and/or in rapid sucession.

In exemplary embodiments, rotating body 702 can be, but is not limited to, a flywheel, a tread/track driven about a flywheel, a roller, a roller at least partially covered by foam, and/or any other reasonable object capable of accelerating projectile 102 from launcher 100.

Further, rotating body 702 can be driven, for example, by a motor. In some instances this motor may be substantially loud and may act, for example, as a safety feature alerting a user and/or others that the toy launcher 100 is activated (e.g., rotating). Further, rotating body 702 can be activated by, for example, a user interface such as a switch, movement of toy 100, and/or a user contacting toy 100. In exemplary embodiments, rotating body 702 may be located substantially near the exit from toy launcher 100 to, for example, reduce frictional slowing of a launched projectile 102. Further, the speed at which rotating body 702 is set can be based on a desired launch speed for projectile 102 and may be controlled by the user and/or set by another. This may be done to reduce the risk of injury caused by a launched projectile.

In exemplary embodiments, the distance between a plurality of rotating bodies and/or at least one rotating body and another object can be sized based on physical dimensions of the projectile such as, but not limited to, the cross-sectional dimension of projectile 102 and/or mechanical properties of projectile 102 and/or rotating body 702 such as, but not limited to, the rigidity and/or compressibility of projectile 102 and/or rotating body 702.

Figure 8A:
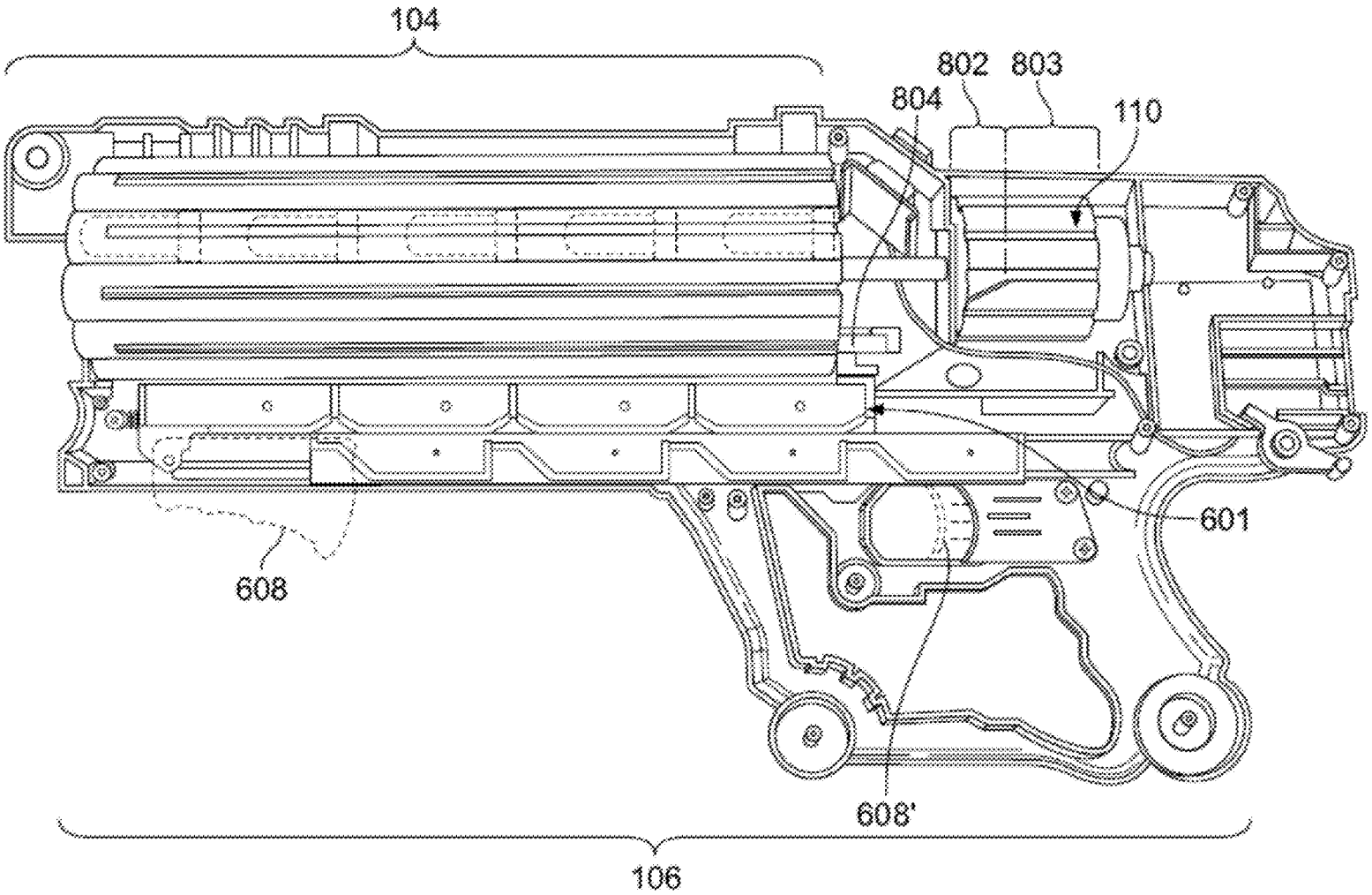
FIGS. 8A-8C illustratively depict rotation mechanisms for rotating a projectile feed assembly, in accordance with exemplary embodiments of the present invention.
Figure 8B:
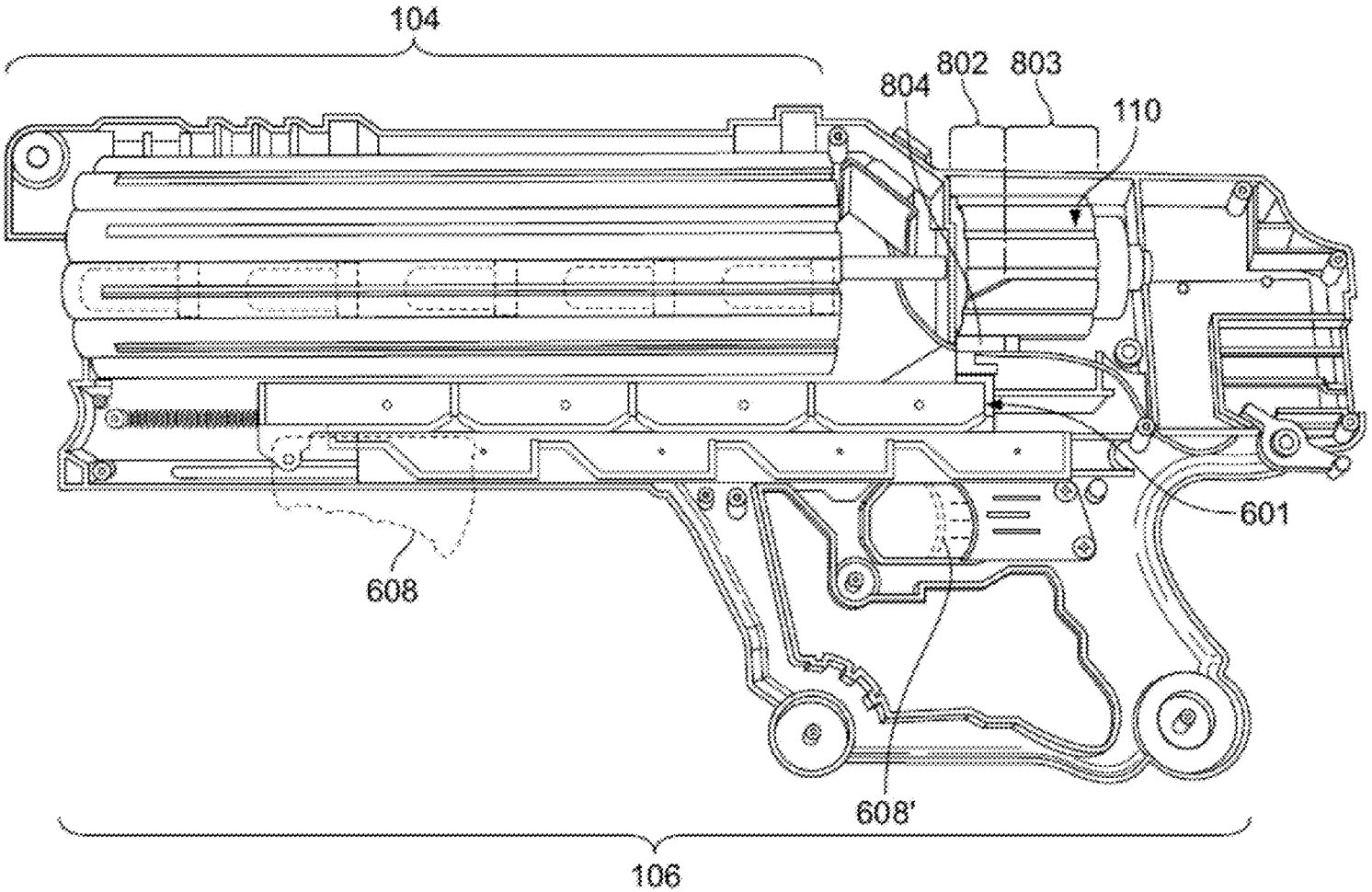
Figure 8C:
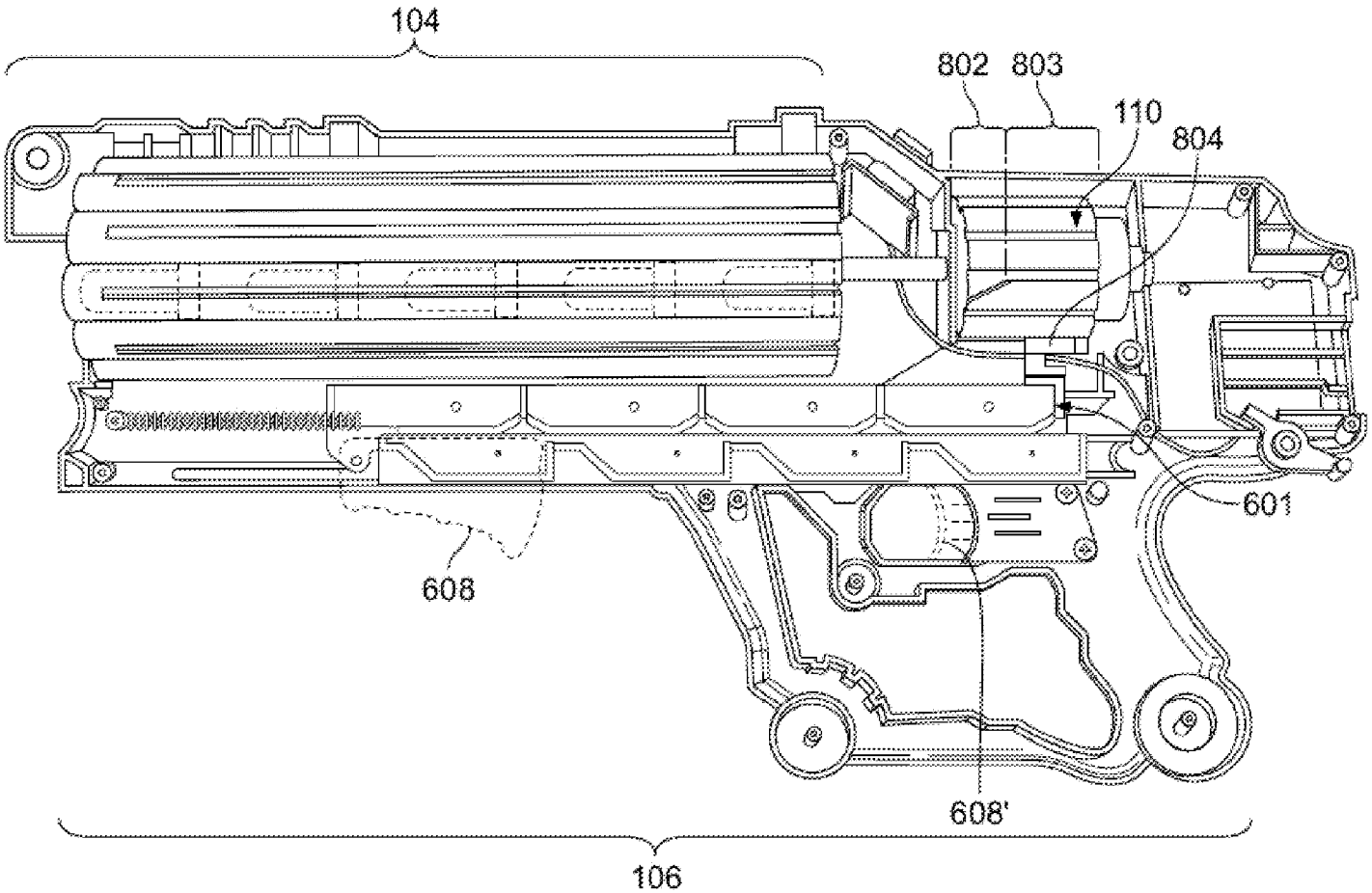

Referring to FIG. 8A-8C, projectile feed assembly 104 can be coupled to rotating mechanism 110 such that causing rotating mechanism 110 to rotate in turn causes projectile feed assembly 104 to rotate. Further, rotating mechanism 110 can include an interfacing rotating region 802 and an interfacing projectile advancing region 803 and user interfacing assembly 106 can include slide rack assembly 601 that can include an interfacer 804. Interfacer 804 and/or interfacing rotating region 802 can be designed such that the engagement of the interfacing rotating region 802 with interfacer 804 causes rotating mechanism 110 to rotate in turn causing projectile feed assembly 104 to rotate.

By way of example, referring to FIG. 8A, projectile feed assembly 104 housing projectiles 102 is illustratively depicted in a first position and, referring to FIG. 8B, interfacer 804 is illustratively depicted being received by interfacing rotating region 802 causing rotating mechanism 110 to turn thereby causing projectile feed assembly 104 to turn such that projectiles 102 are in a second position. Referring to FIG. 8C, after being received by interfacing rotating region 802, interfacer 804 can continue advancing into interfacing projectile advancing region 803 thereby allowing engagement mechanism 602 (not shown) to drive projectiles 102 from toy launcher 100, as described above.

The angle of rotation of rotation mechanism 110 and/or projectile feed assembly 104 can be based on the geometric configuration, sizing, and/or dimensions of receiving bodies 302 and/or projectile feed assembly 104. Further, the interaction of interfacing rotating region 802 and interfacer 804 can be designed to rotate rotation mechanism 110 and/or projectile feed assembly 104 a desired amount. For example, receiving interfacer 804 into interfacing rotating region 802 can cause projectile feed assembly 104 to rotate about 5 to 45 degrees.

Rotation mechanism 110 and/or projectile feed assembly 104 can be driven by a user applying force on and/or interacting with user interface 608 and/or user interface 608'. For example, slide rack assembly 601 can be manually operated by a user applying substantial enough force to drive user interface 608 in a forward and backward direction. As another example, slide rack assembly 601 can motorized such that it can translate in forward and backward direction when a user interacts with user interface 608' and/or interface 608.

It will be understood that rotation mechanism 110, projectile feed assembly 104 and/or slide rack assembly 601 can function substantially together, independent of one another, and/or by any other reasonable combination thereof. For example, rotation mechanism 110 and/or projectile feed assembly 104 can rotate without interaction with slide rack assembly 601. By way of example, rotation mechanism 110 and/or projectile feed assembly 104 can be turned by a first user input and/or by a motor while slide rack assembly can move back and forth by a second user input and/or by a motor.

It will be understood that accelerator 112 can include compressed air, a mechanical air compressor, an electro-mechanical air compressor, a user power air compressor, a piston assembly, and/or any other reasonable device and/or technique capable of pressurizing air. A mechanical and/or electro-mechanical air compressor may be activated when a user interacts with user interface 608' and/or interface 608. For example, a user could pull back on interface 608 causing the launcher to load and press interface 608' to launch a projectile.

It will be understood that any elements and/or components of the toy described herein can be further combined and/or separated without deviating from the scope of the invention.

Figure 9:
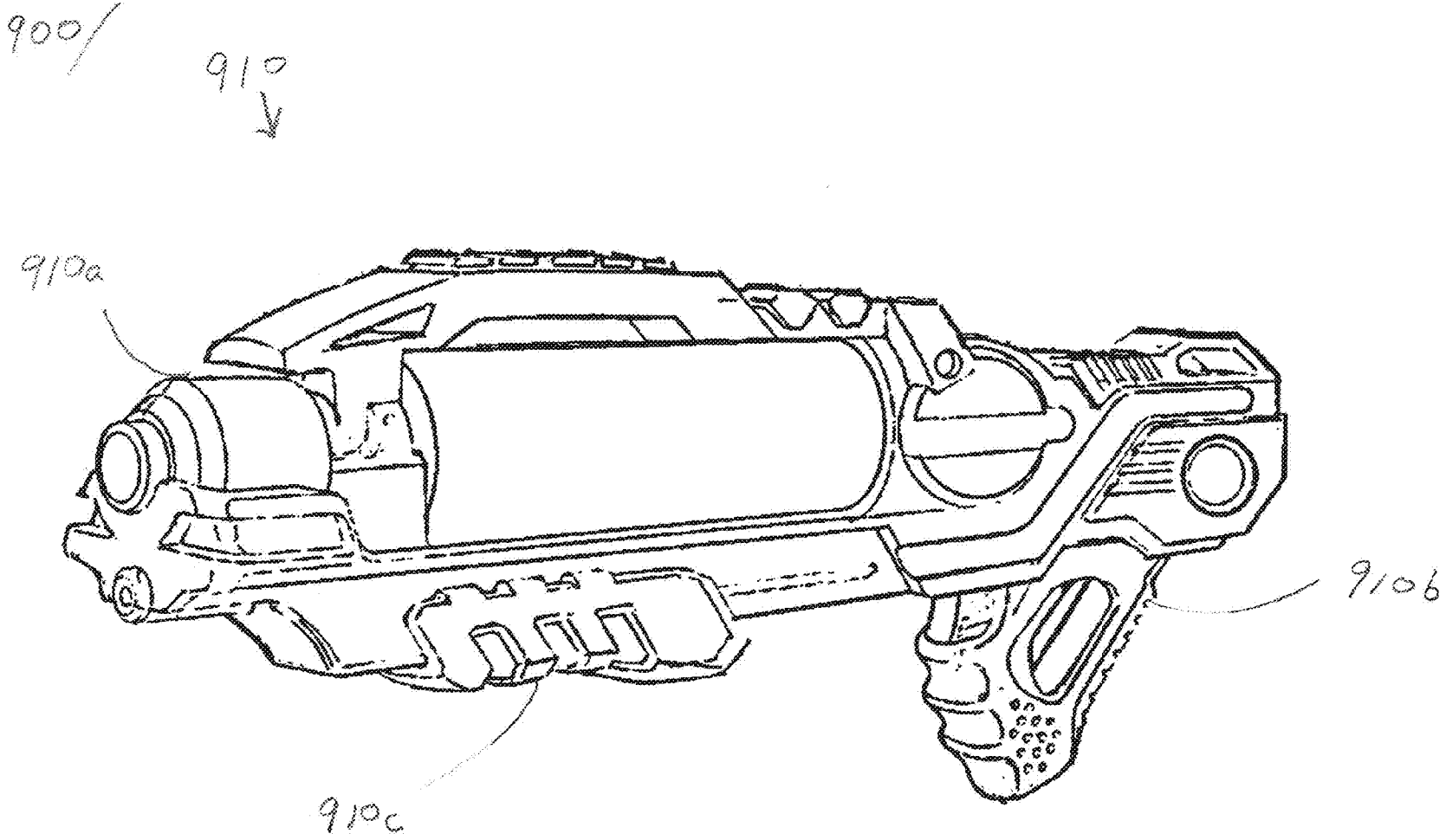
FIG. 9 is an exemplary embodiment of a toy launcher according to an exemplary embodiment of the present disclosure.

Turning to FIG. 9, an exemplary embodiment of a toy launcher is generally designated 900. Toy launcher 900 may comprise a housing 910 that includes a barrel portion 910*a* near an open forward end and a stock portion 910*b* near an enclosed rear end. A pump handle 910*c* is slidable along a bottom periphery of the housing 910 below barrel portion 910*a*. The housing 910 of toy launcher 900 may be formed of a single, for example, molded piece, or may be formed of one or more coupled components, such as housing halves joined by interfitting components (such as snap fit or interference fit), adhesion, heat welding, ultrasonic welding, fasteners, or the like. In embodiments, one or more accessories or features may be disposed or defined on housing 910, for example, a handle, one or more gripping portions, one or more ergonomically formed portions, a mounting rail, a sight or scope, an illumination source (such as a light bulb, LED, or laser), and/or one or more transparent portions such as a window, to name a few.

Figure 10:
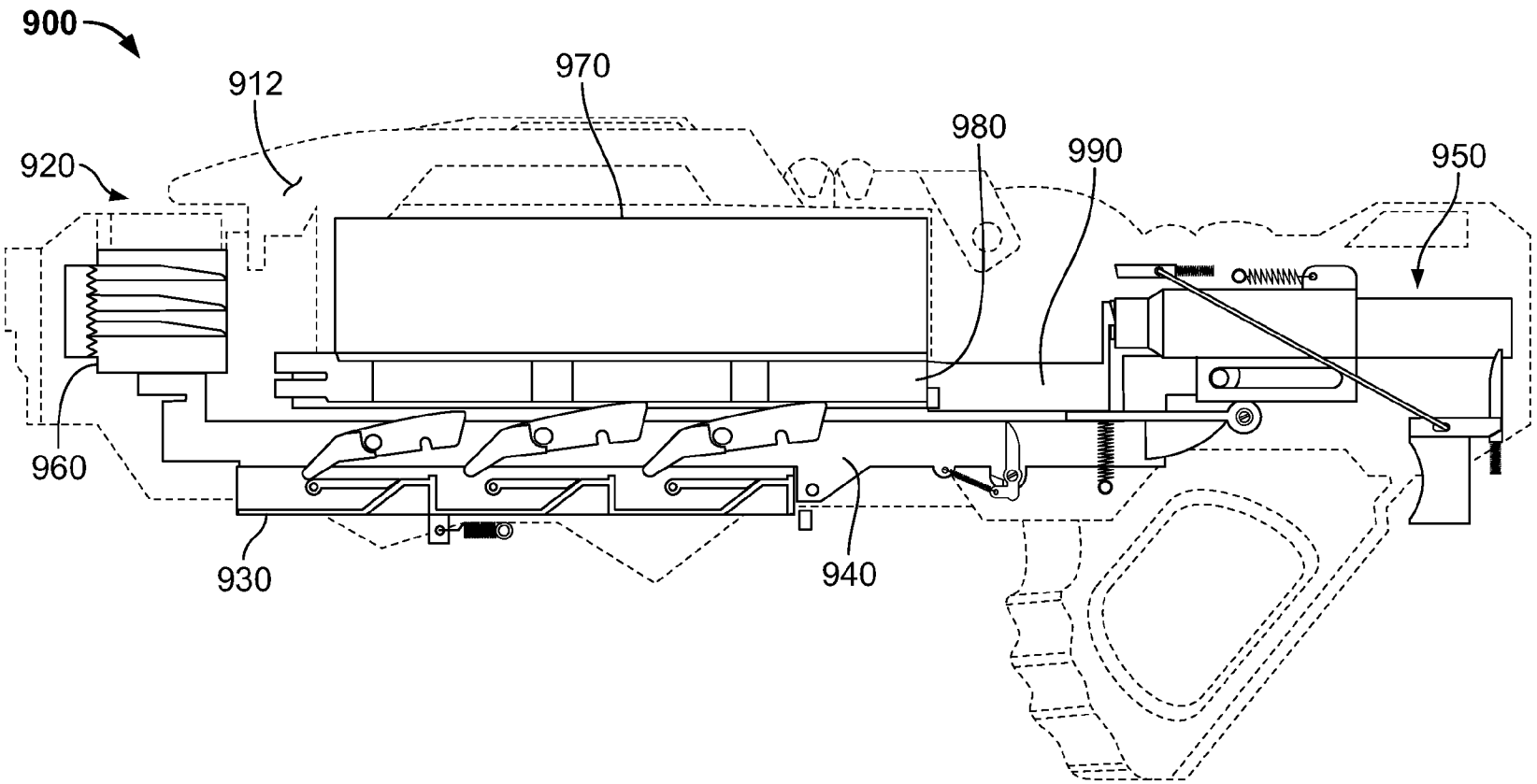
FIG. 10 is a side partial phantom view of an interior launch assembly of the toy launcher of FIG. 9.

With reference to FIG. 10, housing 910 has a hollow configuration such that an interior recess 912 therein can receive at least a portion of a launch assembly 920 and one or more projectiles 980 associated therewith. Launch assembly 920 may be affixed to housing 910 at one or more locations within interior recess 912 to inhibit relative movement of a respective portion of the launch assembly 920 and housing 910. In embodiments, launch assembly 920 may at least partially protrude through housing 910, or may be fully enclosed within the interior recess 912 of housing 910. In embodiments, launch assembly 920 may be removably disposed within interior recess 912 of housing 910, or may be integrally formed therewith.

As shown, launch apparatus 920 comprises a rack 930, a slidable frame 940, a launch mechanism 950, a rotation gear 960, a projectile feed 970 including one or more projectiles 980, and an elevator assembly 990. A barrel 918 (shown in FIG. 13F) is disposed between the launch mechanism 950 and a forward exit of the toy launcher 900 so that projectiles 980 are propelled substantially along the length of toy launcher 900 therethrough. Accordingly, barrel 918 may be a member having a complementary shape to projectiles 980, for example, an elongate tubular member. While barrel 918 is shown only in FIG. 13F of the accompanying figures for ease of illustration and understanding, it will be understood that barrel 918 is disposed in the interior recess 912 of toy housing 900 in the exemplary embodiments described herein. In embodiments, a launch assembly may include greater, fewer, and/or alternative components to those described above.

Rack 930 is movably coupled along a bottom portion of slidable frame 940 such that rack 930 and slidable frame 940 are configured for relative movement. Slidable frame 940 may be coupled with the pump handle 910*c* through housing 910 (not shown) such that longitudinal movement of pump handle 910*c* along housing 910 causes subsequent movement of rack 930 within interior recess 912.

Slidable frame 940 is disposed below a projectile feed 970 that includes one or more receiving chambers 972 configured to releasably retain one or more projectiles 980. In particular, a bottom-most receiving chamber 972 (at a 6 o'clock position from a front-facing perspective) is positioned vertically adjacent the slidable frame 940. It will be understood that projectile feed 970 may be substantially similar to projectile feed assembly 104 described above. Projectile feed 970 may be rotatably mounted to housing 910 within interior recess 912 such that projectile feed 970 is configured for rotation relative to both housing 910 and launch assembly 920. In particular, rotation gear 960 is rotationally coupled with projectile feed 970 such that rotation of rotation gear 960 causes subsequent rotation of projectile feed 970, as described further herein.

Slidable frame 940 is operably coupled with an elevator assembly 990 and a launch mechanism 950. As described herein, launch mechanism 950 is configured to apply one or more forces to one or more projectile 980 to cause a respective projectile 980 to be propelled through the forward distal end and away from toy launcher 900. Elevator assembly 990 is configured to sequentially position one or more of projectiles 980 from the projectile feed 970 into vertical alignment with the launch mechanism 950 for launching therefrom.

Figure 11:
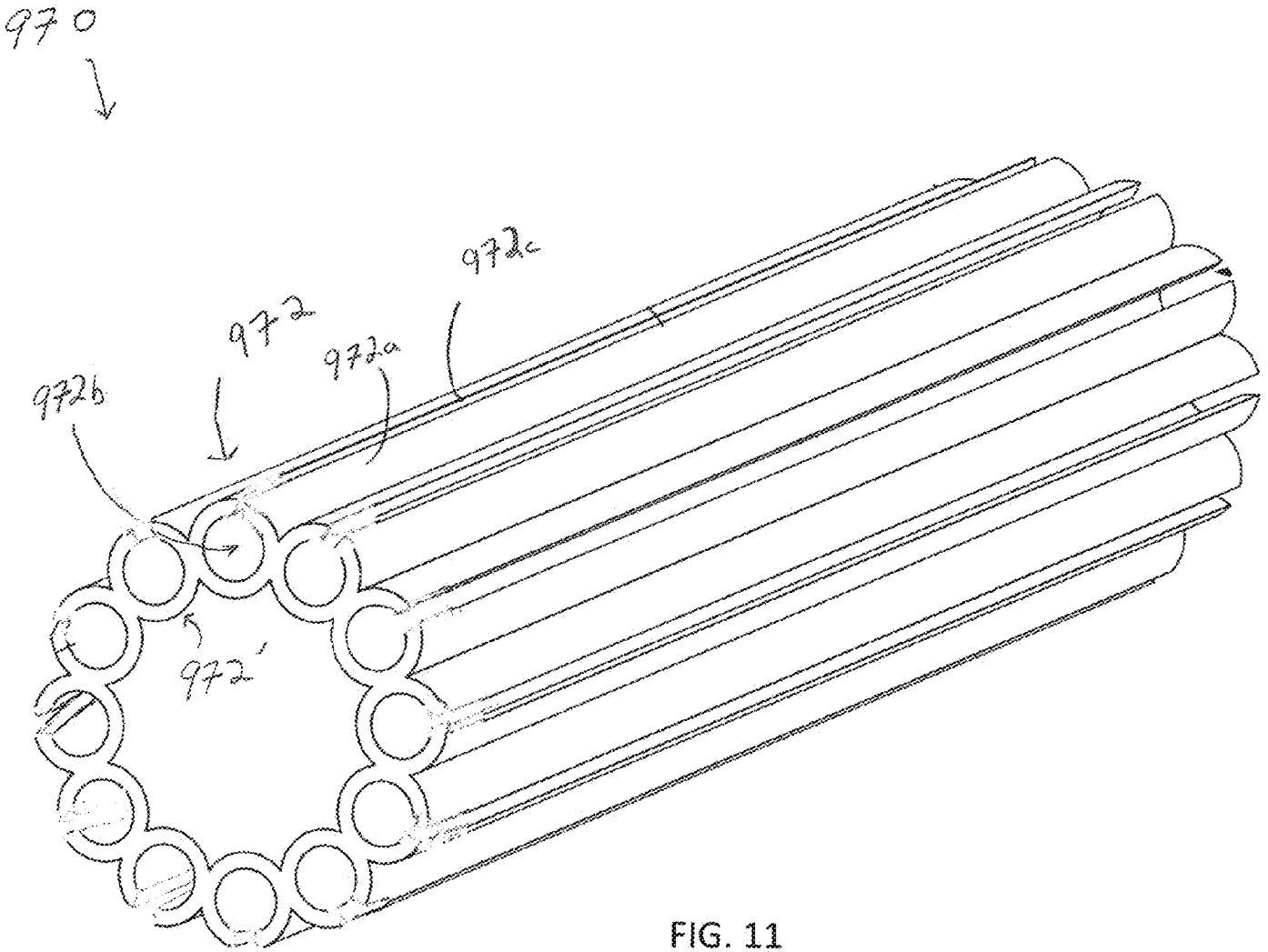
FIG. 11 is a detail perspective view of a projectile feed of the toy launcher of FIG. 9.
Figure 12:
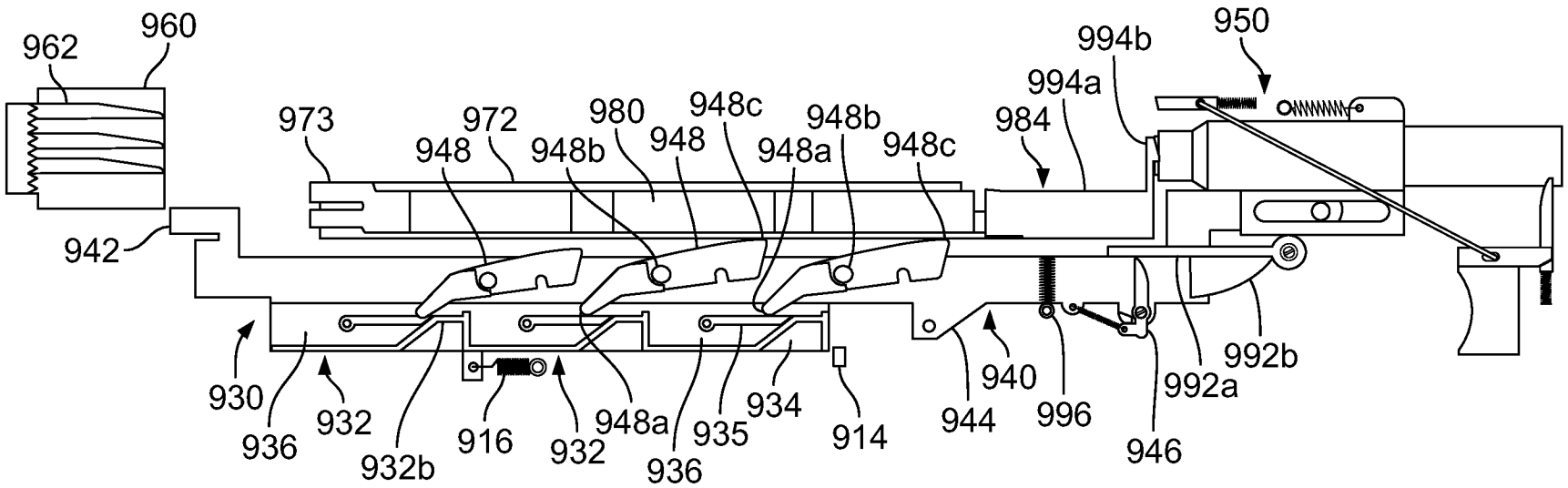
FIG. 12 is a side sectional view of the launch assembly of the toy launcher of FIG. 9.

Turning to FIGS. 11 and 12, the components of launch assembly 920 will be described in further detail.

As shown, projectile feed 970 is a circumferential arrangement of twelve coupled receiving chambers 972. In the following figures, only a receiving chamber 972 vertically adjacent the slidable frame 940 will be illustrated for ease of understanding. In embodiments, projectile feed 970 may be a plurality of any number of coupled receiving chambers 972 in any desirable arrangement.

As shown, each receiving chamber 972 includes a body 972*a* with a passage 972*b* extending therethrough. A channel 972*c* is formed at least partially along the body 972*a* of each receiving chamber 972 such that the channel 972*a* provides access to the passage 972*b* therealong. The passage 972*b* through each receiving chamber 972 is dimensioned to receive an engagement plug 973. Engagement plug 973 is disposed within the passage 972*b* forward of one or more projectiles 980 disposed therein. In embodiments, engagement plug 973 may be present in a receiving chamber 972 devoid of projectiles 980.

It will be understood that projectiles 980 may be substantially similar to projectiles 102 described above, in that projectiles 980 may be objects configured to move along through each receiving chamber 972 toward and through the open forward end of toy launcher 900. Accordingly, projectiles 980 may be, for example, darts, arrows, balls, and/or discs in any combination or separation, to name a few. Projectiles 980 may be formed of a lightweight and/or force-dampening material such as foam, rubber, or the like so that projectiles 980 are suitable for use in play and/or sport activities, for example, involving children. In this manner, projectiles 980 are configured to impact a target, such as a portion of a human body, animal, or in embodiments, an inanimate object, without causing discomfort, pain, and/or damage thereto. In embodiments, projectiles 980 may include one or more performance-enhancing and/or decorative features, for example, suction cups, fins, whistles and/or other sound generating devices, one or more fluid-retaining portions, dyes or other transferable colorants, and or collapsible portions, to name a few.

Still referring to FIG. 12, slidable frame 940 is an elongate member with a forward ledge defining an actuator 942, a central portion having a flange 944 extending downwardly therefrom, and a rear portion with an engagement claw 946 coupled thereto. A rear end of the slidable frame 940 includes a pin 949 slidable within a predetermined range of motion along a portion of launching mechanism 950, as described further herein. A plurality of engagement fingers 948 are rotationally coupled along slidable frame 940 between the actuator 942 and flange 944. Each engagement finger 948 includes a forward portion 948*a*, a pivot 948*b*, and a rear portion 948*c*. Each engagement finger 948 may include a biasing member, for example, a torsion spring, such that each engagement finger 948 is normally biased to rotate along the slidable frame 940 in a downward (clockwise, from the perspective shown) manner. In embodiments, one or more of engagement fingers 948 may include an additional and/or alternative feature to urge engagement fingers 948 toward a downward rotation, for example, a weighted portion.

As described above, rack 930 is configured for relative linear movement along at least a portion of slidable frame 940. Slidable rack 930 may have one or more hollow chambers 932 corresponding to each engagement finger 948 of slidable frame 940. Each chamber 932 is separated by a protrusion 934 with a pivot door 935 extending forwardly therefrom to define a recess 936 for receiving at least the forward portion 948*a* of each respective engagement finger 948. Pivot door 935 is pivotably attached along slidable rack 930 so that pivot door 935 can pivot at least upwardly with respect to protrusion 934, as described further herein. In the exemplary embodiment shown, slidable frame 940 includes three engagement fingers 948 and slidable rack 930 includes three corresponding chambers 932. In embodiments, a toy launcher may include any number of engagement fingers and/or chambers.

As shown in FIG. 12, a stop 914 may be disposed within recess 912 so that rack 930 is positioned for movement between a first, rearward position abutting the stop 914 as shown, to a second, forward position as described further herein. A rack spring 916 may be fixedly coupled between a forward portion of housing 910 and rack 930 so that rack 930 is normally biased toward the first, rearward position abutting stop 914 shown. In this manner, a user- or otherwise-supplied external force can be exerted on slidable rack 930, for example, by forward movement of pump handle 910*c* (FIG. 9) to overcome the biasing force maintained by rack spring 916 to cause rack 930 to travel forward from the first, rearward position.

Moving rearwardly along launch assembly 920, elevator assembly 990 includes an elevator mechanism 992 and an elevator chamber 994 positioned thereabove. An elevator spring 996 extends between the elevator chamber 994 and an interior surface of the housing 910. Elevator mechanism 992 includes an elevator platform 992*a* and an elevator cam 992*b* extending downwardly therefrom.

Elevator mechanism 992 is hingably coupled to housing 910 so that elevator mechanism 992 can pivot in a clockwise manner with respect to housing 910, as described herein. In embodiments, elevator mechanism 992 may include an engaging surface, for example, an underside of elevator platform 992*a*, for engaging another component of launch assembly 920, for example, slidable frame 940, so that elevator mechanism 992 is inhibited from counterclockwise movement beyond the resting position shown.

Elevator chamber 994 includes a tubular body 994*a* with a catch 994*b* extending upwardly therefrom. Elevator chamber 994 is dimensioned to receive one or more of projectiles 980 from projectile feed 970. Elevator chamber 994 is movable upwardly and downwardly with respect to the remainder of elevator assembly 990. As shown, elevator chamber 994 is aligned with the receiving chamber 972 vertically adjacent the slidable frame 940 in the resting, downward position shown. An elevator spring 996 is fixedly coupled between the elevator chamber 994 and a lower portion of housing 910 so that elevator spring 996 normally biases elevator chamber 994 toward the resting, downward position shown. In embodiments, elevator chamber 994 may engage another component of launch assembly 920, for example, slidable frame 940, so that elevator chamber 994 is inhibited from downward movement beyond the resting position shown. As shown, an elevator lock 997 is disposed above launch mechanism 950 and coupled with a portion thereof, for example, with a tether or cable. Elevator lock 997 is normally urged into a horizontal alignment with the elevator catch 994*b* by a catch spring 998, as described further herein.

Figure 14A:
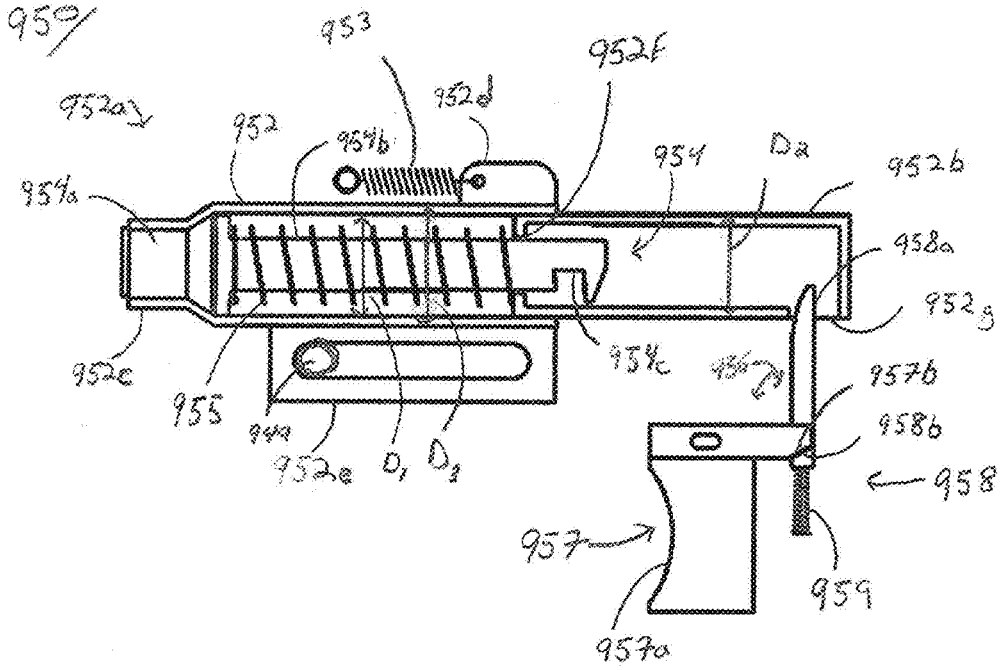
FIG. 14A is an enlarged cross-sectional view of the area of detail identified in FIG. 12.

Turning momentarily to FIG. 14A, the components of launch mechanism 950 are shown in detail in a first, resting position. Launch mechanism 950 comprises a fluid chamber 952, a piston 954 slidably movable within the fluid chamber 952, and a trigger mechanism 956.

Fluid chamber 952, as shown, is a generally tubular member formed of a forward portion 952*a* that is slidably movable about a tubular rear portion 952*b*. Accordingly, forward portion 952*a* may have an inner diameter $D_1$ that is larger than an outer diameter $D_2$ of rear portion 952*b*. A forward end of the forward portion 952*a* of fluid chamber 952 may be tapered to define a nozzle 952*c*. The forward portion 952*a* of fluid chamber 952 may also include an upper flange 952*d* and a lower flange 952*e* extending therefrom. A chamber spring 953 extends between upper flange 952*d* and a portion of housing 910 forward of fluid chamber 952 so that chamber spring 953 maintains a biasing force on the forward portion 952*a* toward the forward, extended configuration shown in FIG. 14A. Lower flange 952*e* defines an elongate slot for receiving the pin 949 at the rear end of slidable frame 940, as described herein.

Piston 954 is a rigid, elongate member that includes a plunger head 954*a* with a stem 954*b* extending rearwardly therefrom along the fluid chamber 952. Plunger head 954*a* may be dimensioned to approximate the inner diameter $D_1$ of the forward portion 952*a* of fluid chamber 952 so that plunger head 954*a* circumferentially engages the inner surface of forward portion 952*a* to form an at least partial seal therewith. An engagement detent 954*c*, for example, a notch, is disposed toward the rear end of stem 954*b* for engagement with a portion of trigger mechanism 956, as described further herein. A piston spring 955 may be coiled about a portion of the stem 954*b* of piston 954 between the plunger head 954*a* and the forward end of the rear portion 952*b* of fluid chamber 952. Piston spring 955 may maintain a forward biasing force on plunger head 954*a* so that piston 954 is normally urged toward the forward end of fluid chamber 952.

Trigger mechanism 956 includes a trigger slide 957 operably coupled with a trigger pawl 958 to cause a body portion 958*a* of trigger pawl 958 to move at least partially into an aperture 952*g* in the rear portion 952*b* of fluid chamber 952. A latch spring 959 may be coupled with trigger pawl 958 so that latch spring 959 maintains an upward biasing force to urge trigger pawl 958 vertically into the aperture 952*g* of the rear portion 952*b* of fluid chamber 952.

Trigger slide 957 may include a user engagement portion 957*a* upon which a rearward force may be exerted to cause trigger slide 957 to move rearwardly toward trigger pawl 958. A camming ledge 957*b* at the rear end of trigger slide 957 may be configured to slidably engage a slanted ledge 958*b* near the bottom end of trigger pawl 958 so that, upon contact with trigger pawl 958, further rearward movement of trigger slide 957 urges trigger pawl 958 to move downwardly so that the body portion 958*a* of trigger pawl 958 moves partially or completely out of engagement with the rear portion 952*b* of fluid chamber 952. Trigger slide 957 may be coupled, for example, by a tether or cable as shown, with a portion of elevator assembly 990, as described further herein.

Turning now to FIGS. 13A-13F, operation of the toy launcher 900 will be described. A user may grasp toy launcher 900 in an initial position as shown in FIG. 12, and proceed to push slidable frame 940 forwardly, which causes slidable rack 930 to overcome the biasing force exerted by rack spring 916 and move forwardly upon engagement of flange 944 with slide rack 930. As described above, a user may engage pump handle 910*c* (FIG. 9) to cause forward movement of slidable frame 940. As the slidable frame 940 approaches the rotation mechanism 960, actuator 942 may engage one of a plurality of circumferentially spaced cam ledges 962 disposed on rotation mechanism 960, causing subsequent rotation of the rotation mechanism 960 in a rotational direction CC. In embodiments, engagement of the actuator 942 with rotation mechanism 960 may cause clockwise or counterclockwise rotation. As described above, rotation mechanism 960 is rotationally coupled with projectile feed 970 (FIG. 12) so that turning of rotation mechanism 960 causes corresponding rotation of projectile feed 970 in the rotational direction CC (not shown). Thus, full forward movement of the slidable frame 940 causes a next circumferentially adjacent receiving chamber 972 to move into position vertically adjacent slidable frame 940. In this manner, a user may move slidable frame 940 forwardly, for example, after one or more projectiles 980 have been launched from a given receiving chamber 972, in response to an obstruction to one or more projectiles 980 launching from a given receiving chamber 972, in the event there are no more projectiles remaining in a given receiving chamber 972, and/or to provide a pleasing visual effect of rotation of projectile feed 970, to name a few.

Figure 13A:
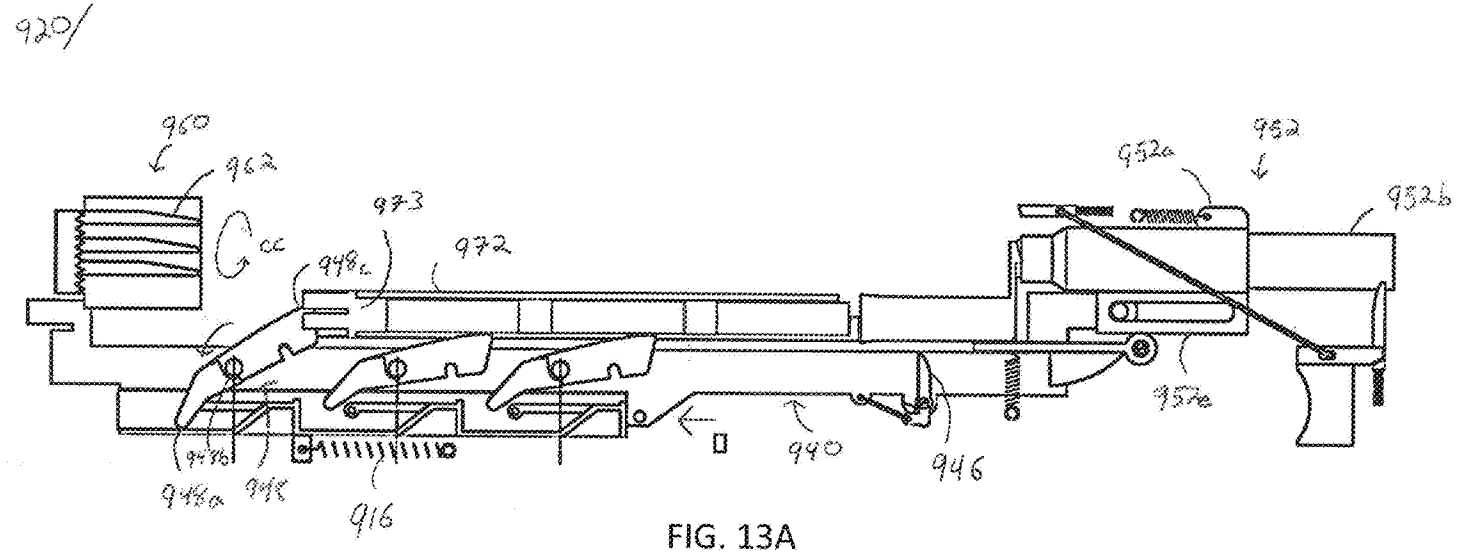
FIG. 13A is a first sequential view of the launch assembly of the toy launcher of FIG. 9.

Still referring to FIG. 13A, as the slidable frame 940 is moved toward the forward position shown therein, the forward-most engagement finger 948 is positioned to fall downwardly into a recess 936 of a respective chamber 932 of rack 930. Accordingly, the rear portion 948*c* of the respective engagement finger 948 tilts upwardly into alignment with the receiving chamber 972 vertically adjacent the slidable frame 940. As shown, the rear portion 948*c* of engagement finger 948 pivots upwardly into an abutting position with the engagement plug 973 of the receiving chamber 972. In this manner, the forward-most engagement finger 948 may at least partially extend through the channel 972*c* of the receiving chamber 972. As described further herein, engagement fingers 948 may be configured for rotational movement depending upon the relative position of engagement plug 973 and/or projectiles 980.

Figure 13B:
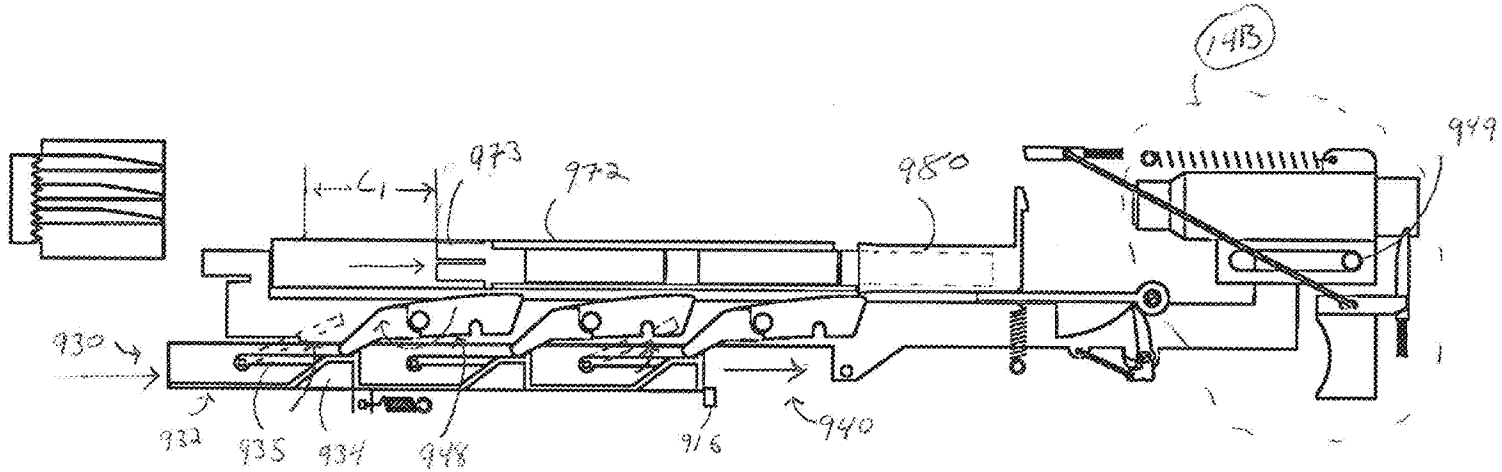
FIG. 13B is a second sequential view of the launch assembly of the toy launcher of FIG. 9.

Turning now to FIG. 13B, the user may pull slidable frame 940 rearwardly so that the front portion 948*a* of the front-most engagement finger 948 slides up the inclined surface of corresponding protrusion 934 of rack 930. As the engagement finger 948 is pulled rearwardly with slidable frame 940, the rear portion of the engagement finger 948*c* moves the engagement plug 973 rearwardly within the receiving chamber 972 so that projectiles 980 are also advanced rearwardly along the receiving chamber 972. The engagement plug 973 and projectiles 980 move rearwardly a distance $L_1$, which may correspond to a length of a projectile 980. In embodiments, engagement finger 948 may cause the engagement plug 973 and projectiles 980 to move a different distance rearwardly.

As shown, the engagement of the forward portion 948*a* of the forward-most engagement finger 948 with the pivot door 935 causes the pivot door 935 to momentarily pivot upwardly to provide a clearance to allow slidable passage of the forward portion 948 of the forward-most engagement finger 948 under the pivot door 935. After passage of the forward portion 948*a* of the engagement finger 948 thereby, pivot door 935 falls to its resting, horizontal position. In embodiments, pivot door 935 may be maintained in its resting, horizontal position with a ledge or stop.

As shown, rack 930 is inhibited from rearward travel past the stop 914 within interior recess 912. However, slidable frame 940 is free to continue moving rearwardly so that flange 944 passes under elevator mechanism 992 within interior recess 912. Engagement claw 946 may be subject to forcing by passing contact with the elevator cam 992*b*. Accordingly, engagement claw 946 may be pivotably coupled along the slidable frame 940 to allow a degree of motion from its resting position upon forcing, for example, to avoid damage to engagement claw 946 or another component of toy launcher 900. Engagement claw 946 may include a feature such as a cable or spring to assist in the return of engagement claw 946 to its pre-stressed condition and/or to limit the degree of movement of engagement claw 946 relative to slidable frame 940. In embodiments, elevator cam 992*b* may include a feature or geometry, for example a groove or channel, to allow engagement claw 946 to facilitate the passage of engagement claw 946 therealong and/or therethrough in a rearward direction. However, elevator cam 992*b* and engagement claw 946 are configured to interengage as elevator cam 992*b* passes along engagement claw 946 in a forward direction, described further herein.

Figure 14B:
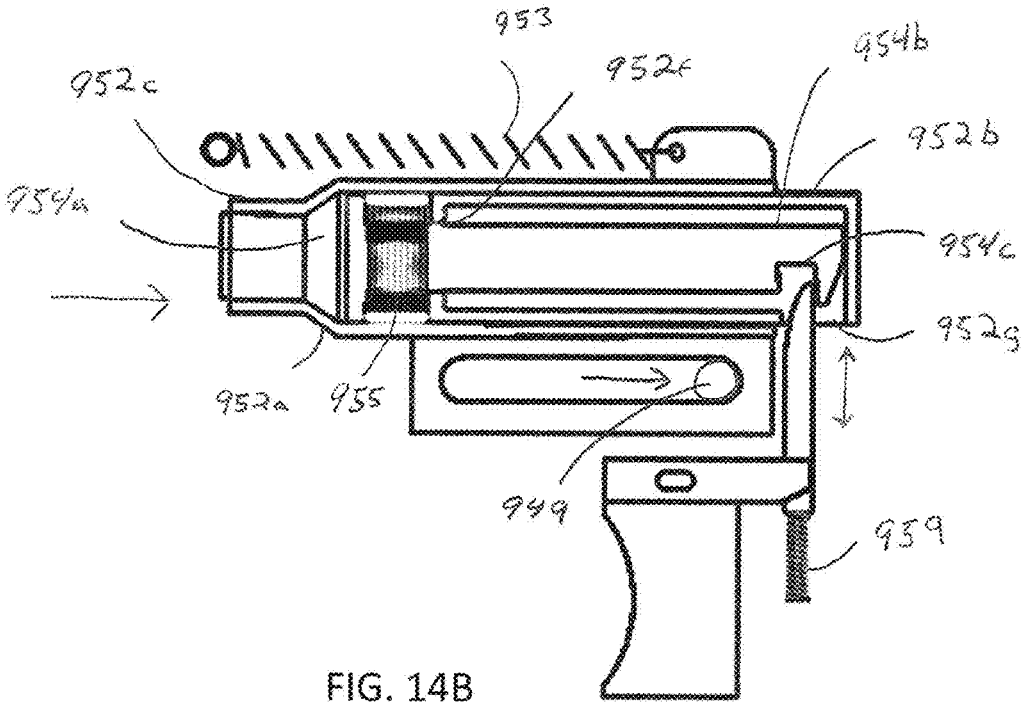
FIG. 14B is an enlarged cross-sectional view of the area of detail identified in FIG. 13B.

With additional reference to FIGS. 14A and 14B, showing the internal construction of the launching mechanism 950, continued rearward movement of the slidable frame 940 in the manner described above causes the pin 949 near the rear end of slidable frame 940 to contact the slot defined through the lower flange 952*e* of fluid chamber 952. Rearward movement of the pin 949 causes the forward portion 952*a* of fluid chamber 952 to move toward the rearward portion 952*b* of fluid chamber 952 as shown. As the forward portion 952*a* of fluid chamber 952 is configured to overlap the rear portion 952*b*, the overall length of fluid chamber 952 may be reduced as the forward portion 952*a* telescopes over the rear portion 952*b*.

With rearward movement of the forward portion 952*a* of fluid chamber 952, the head 954*a* of piston 954 is urged rearwardly by the interior surface of the nozzle 952*c*. Because the piston spring 955 is disposed between the plunger head 954*a* of piston 954 and the forward end of the stationary rearward portion 952*b* of fluid chamber 952, piston spring 955 is compressed as the forward portion 952*a* moves toward the rearward portion 952*b* of fluid chamber 952. In this manner, the biasing force exerted by piston spring 955 provides a resistance to rearward movement of the front portion 952*a* of fluid chamber 952, which must be overcome by a user by a rearward force applied on slidable frame 940 by the user in the manner described above. Further, the user must also overcome the biasing force exerted by the chamber spring 953, which expands as the forward portion 952*a* of fluid chamber 952 moves rearwardly and tends to pull the forward portion 952*a* forward toward its pre-stressed condition. In embodiments, chamber spring 953 and piston spring 955 may be disposed or configured such that each spring 953, 955 exerts a greater, similar, or lesser biasing force compared to the other.

As the piston 954 moves through the opening 952*f*, the camming surface on the rear end of piston 954 moves into engagement with the trigger pawl 958 to urge the trigger pawl 958 downwardly against the latch spring 959 so that that the piston 954 can continue to advance rearwardly. Once the engagement detent 954*c* has passed over the body portion 958*a* of the engagement latch 958, the latch spring 959 biases the trigger pawl 958 upwardly into engagement with the engagement detent 954*c*, as shown. In this manner, the trigger pawl 958 inhibits the piston spring 955 from expanding under its biasing force, and thereby maintains the piston 954 in the compressed, locked condition shown, with piston spring 955 having a stored potential energy to expand.

Figure 13C:
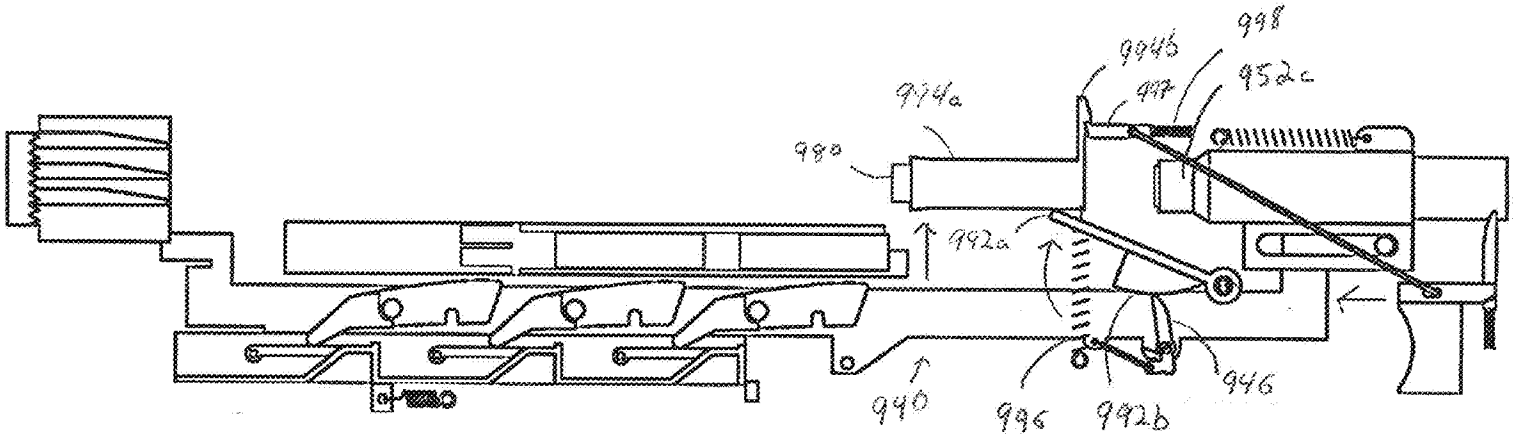
FIG. 13C is a third sequential view of the launch assembly of the toy launcher of FIG. 9.
Figure 13D:
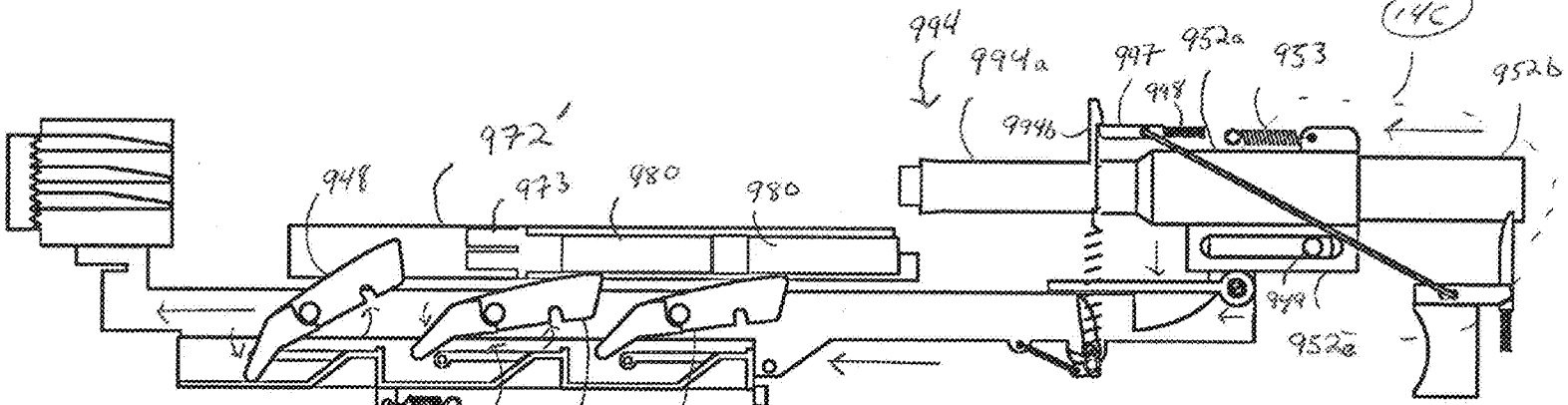
FIG. 13D is a fourth sequential view of the launch assembly of the toy launcher of FIG. 9.

Turning now to FIGS. 13C and 13D, following actuation of the launch mechanism 950 by compression of the piston spring 955 in the manner described above, the slidable frame 940 may be advanced forwardly by the user such that the engagement claw 946 slides along the elevator cam 992*b* to cause the elevator platform 992*a* to pivot upwardly with respect to slidable frame 940, as shown. Accordingly, elevator platform 992*a* tilts upwardly to cause the body 994*a* of elevator chamber 994, and projectile 980 disposed therein, to rise into a horizontal alignment with the nozzle 952*c* of the fluid chamber 952. In this position, the catch 994*b* of elevator chamber 994 engages the elevator lock 997 such that the elevator chamber 994 is maintained in alignment with the fluid chamber 952 under the biasing force of catch spring 998.

Figure 14C:
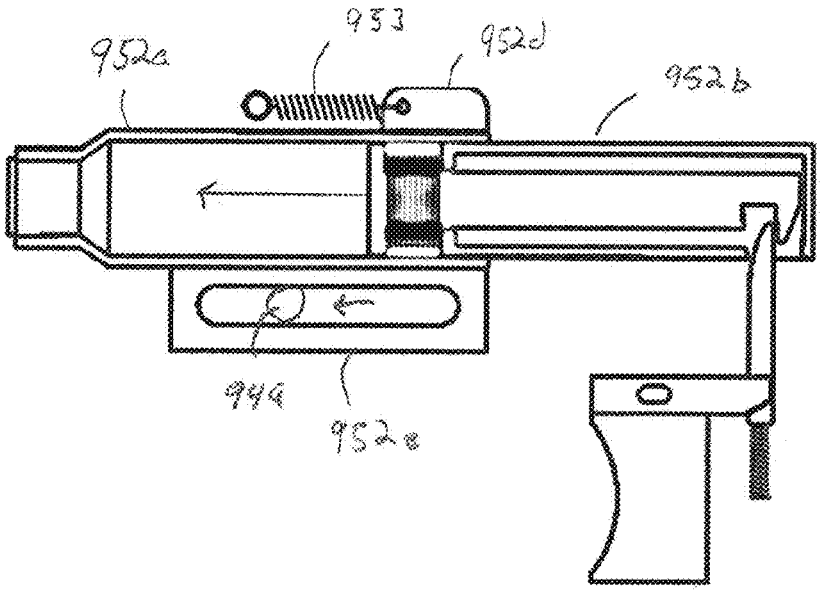
FIG. 14C is an enlarged cross-sectional view of the area of detail identified in FIG. 13D.

With additional reference to FIG. 14C, as the slidable frame 940 continues to move forward, disengagement of the pin 949 with the rear end of the slot defined in lower flange 952*e* of fluid chamber 952 allows the forward portion 952*a* to return to its forward, pre-stressed condition under the biasing force of chamber spring 953. In this manner, the forward portion 952*a* of fluid chamber 952 expands forward into an abutting relationship with the body 994*a* of elevator chamber 994, as shown.

Still referring to FIG. 13D, forward movement of the slidable frame 940 in the manner described above also results in disengagement of the engagement claw 946 with the elevator mechanism 992 as the engagement claw 946 is carried forwardly with the slidable frame 940. Accordingly, the elevator chamber 994, under the biasing force of elevator spring 996 and/or the force of gravity, falls toward its pre-stressed condition as shown. Elevator chamber 994 is maintained in the horizontally aligned and abutting position with respect to the fluid chamber 952 due to the continued engagement of the elevator catch 994*b* with elevator lock 997.

Figure 13E:
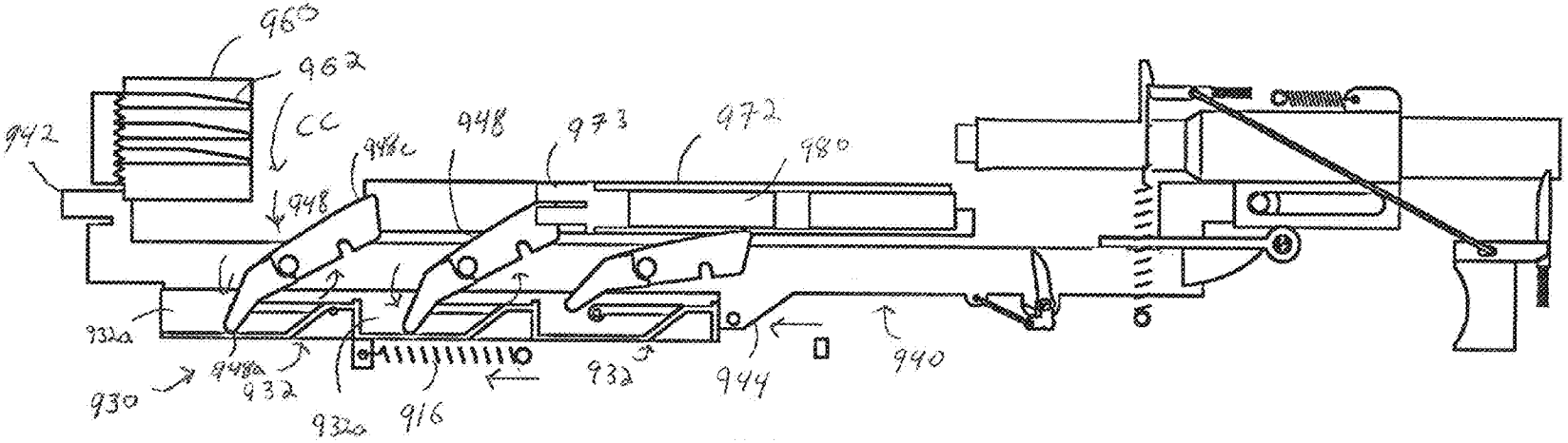
FIG. 13E is a fifth sequential view of the launch assembly of the toy launcher of FIG. 9.

Turning to FIG. 13E, upon further forward movement of the slidable frame 940, the actuator 942 at the forward end of the slidable frame 940 engages and moves along the cam ledges 962 of rotation mechanism 960 causing rotation thereof in a rotational direction CC. As described above, the projectile feed 970 is rotationally affixed to the rotation mechanism 960 so that the projectile feed 970 rotates in concert with the rotation mechanism 960 (not shown) to bring a next rotationally adjacent receiving chamber 972' into a vertical abutting relationship with the slidable frame 940.

As shown, receiving chamber 972' includes a pair of projectiles 980 disposed therein as compared to the three projectiles originally disposed in receiving chamber 972 (FIG. 13A). Receiving chamber 972' may have any number of projectiles 980 disposed therein subject to the size of receiving chamber 972', and may be deliberately loaded with such a number of projectiles 980 by a user, or may have been reduced from an original number of projectiles 980, for example, due to a previous launching of a projectile 980 by toy launcher 900. Accordingly, and as shown, the forward-most and second forward-most engagement fingers 948 slide across the respective pivot doors 935 and, once clear of the doors 935, rotate downwardly into the recesses 932*a* of respective chambers 932 of rack 930 as the slidable frame 940 advances forward with respect to receiving chamber 972'. In this manner, the forward portion 948*b* of the second forward-most engagement finger 948 is disposed in an abutting relationship forward of the engagement plug 973 in a similar manner to receiving chamber 972 shown in FIG. 13A. However, the rearmost engagement finger 948 is inhibiting from rotating downward by the presence of the forward-most projectile 980. In embodiments, it will be understood that forward extension of the slidable frame 940 will cause engagement of an engagement finger 948 with the engagement plug 973 disposed ahead of the forward-most projectile 980 within a given receiving chamber. In such embodiments, a toy launcher may have any number of engagement fingers and/or any number of projectiles.

Figure 13F:
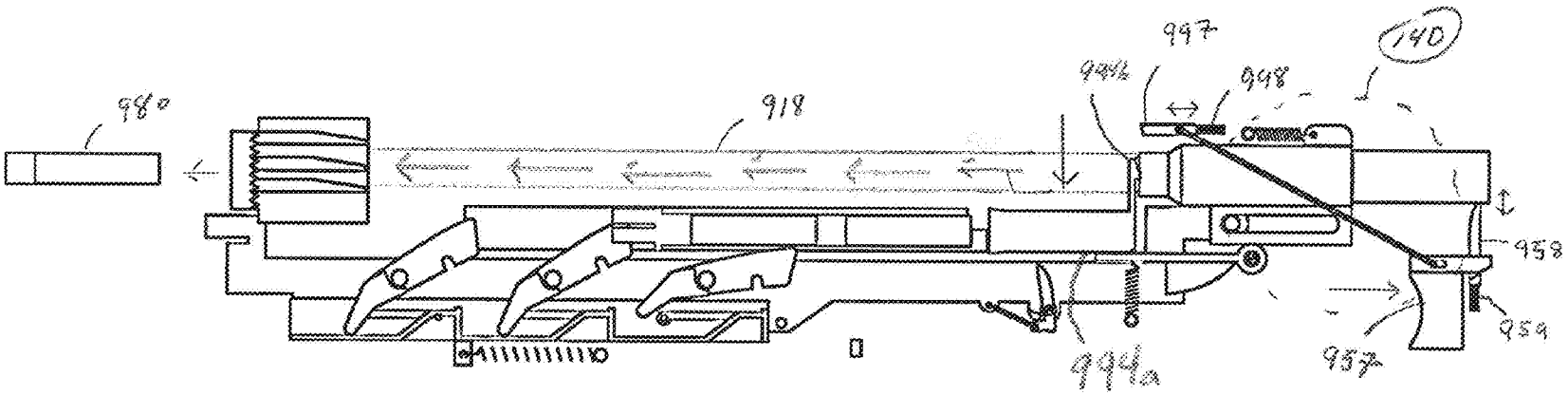
FIG. 13F is a sixth sequential view of the launch assembly of the toy launcher of FIG. 9.
Figure 14D:
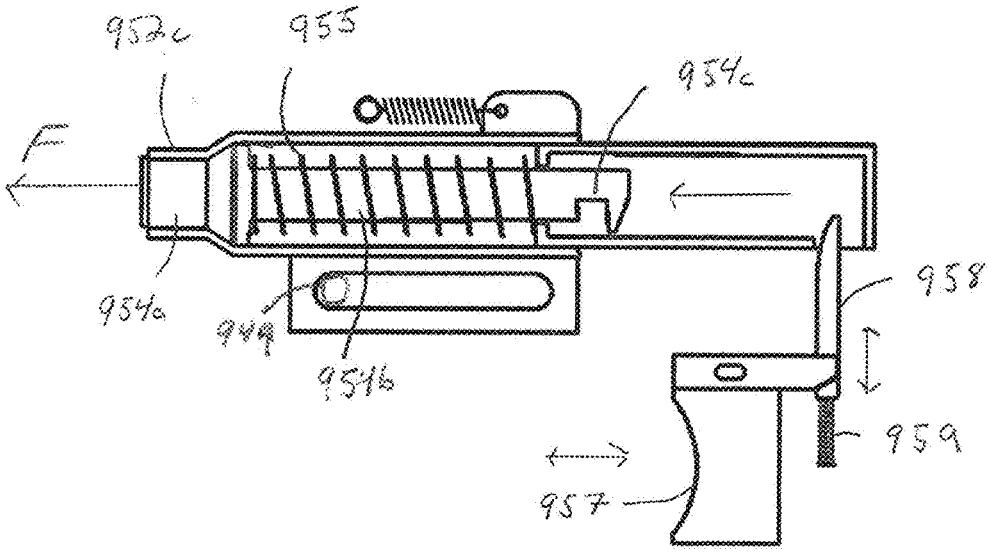
FIG. 14D is an enlarged cross-sectional view of the area of detail identified in FIG. 13F.

Turning now to FIG. 13F and FIG. 14D, a user may pull trigger slide 957 rearwardly such that the trigger pawl 958*a* is urged downwardly against the latch spring 959 to cause the trigger pawl 958 to move out of engagement with the engagement detent 954*c* of piston 954. With disengagement of the trigger pawl 958, piston spring 955 is free to expand along the forward portion 952*a* of fluid chamber 952. As the plunger head 954*a* is forced forwardly by the stored potential energy of the piston spring 955, plunger head 954*a* may create a pressure differential within at least the forward portion 952*a* of fluid chamber 952, for example, by compressing fluids disposed forwardly of the plunger head 952*a* into the nozzle 952*c*. In embodiments, such fluids may be one or more gases, for example, air, so that launch mechanism 950 is configured as a pneumatic pressurizing system. In embodiments, such fluids may include liquids so that launch mechanism is configured as a hydraulic pressurizing system.

As the compressed fluids enter the nozzle 952*c*, such fluids are directed into body 994*a* of the elevator chamber 994 such that a pressure differential is created about the projectile 980 disposed therein, for example, a pressure behind the projectile 980 generated by the forward motion of plunger head 954*a* may be greater than a pressure forward of the projectile 980. In this manner, the pressure differential causes a force F to propel the projectile 980 forwardly through the housing 910 to exit toy launcher 900. As shown, projectile 980 may travel along barrel 918 between elevator chamber 994 and a forward exit of toy launcher 900.

Still referring to FIG. 13F, rearward movement of the trigger slide 957 also causes the elevator lock 997 to move rearwardly against the bias of the catch spring 998 via the cable interconnecting the trigger slide 957 and elevator catch 994*b*. In this manner, upon rearward movement of trigger slide 957 to launch a projectile 980, elevator lock 997 is also caused to disengage from the elevator catch 994*b* so that the elevator chamber 994 returns to its pre-stressed condition in alignment with the receiving chamber 972'. Accordingly, catch spring 998 provides a biasing force against trigger slide 957 as well as elevator lock 997 that may be overcome by rearward movement of trigger slide 957.

Following launching of a projectile 980 from the toy launcher 900 in the manner described above, toy launcher 900 is in a condition similar to that shown in FIG. 13A such that operation of the toy launcher 900 as shown in FIGS. 13B-13F will result in the rearward-most projectile 980 in receiving chamber 972' to launch from toy launcher 900 in the manner described above.

It will be understood that, in embodiments, toy launcher 900 may be operated in a different manner than described above. As described above, toy launcher 900 may be operated by a user to cause rotation of projectile feed 970 following the launch of a single projectile 980 from a receiving chamber 972. In another embodiment, a user may actuate launch mechanism 950 (FIG. 13A-13B) and align elevator chamber 994 therewith (FIG. 13C-13D) such that a projectile 980 is readied for launch, but may choose not to advance slidable frame 940 forward to engage rotation mechanism 960 to cause rotation of projectile feed 970 (FIG. 13D-13E). In this manner, a user may launch a plurality of projectiles 980 from a single receiving chamber 972 before causing rotation of projectile feed 970.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. In embodiments, various components of toy launcher 900 may have a different configuration than that shown and described to achieve a similar function. Such changes may be made without departing from the spirit and scope of the invention.

The invention claimed is:

1. A toy dart launcher, comprising:

a housing defining an interior recess; and a launch assembly at least partially disposed within the interior recess and comprising:

a projectile feed rotatably disposed within the interior recess and comprising a plurality of receiving chambers each adapted to receive one or more projectiles therein;

a slidable frame having at least one engagement finger rotatably disposed thereon, the slidable frame movable with respect to the projectile feed so that the at least one engagement finger can engage and move at least one projectile through at least one receiving chamber; and a launch mechanism disposed rearwardly of the projectile feed and configured to create a pressure differential about the at least one projectile so that the at least one projectile can be launched from the housing.

2. The toy dart launcher of claim 1, wherein the launch mechanism comprises a fluid chamber with a piston and associated piston spring disposed therein.

3. The toy launcher of claim 2, wherein the piston includes a forward plunger head having an outer diameter that approximates an inner diameter of the fluid chamber so that movement of the piston within the fluid chamber causes fluids disposed in a direction of movement to be pressurized therein.

4. The toy launcher of claim 1, wherein each of the plurality of receiving chambers comprises a channel along an outer surface thereof for receiving a portion of the at least one engagement finger.

5. The toy launcher of claim 2, wherein the fluid chamber comprises a forward portion having a forward diameter and a rearward portion having a smaller, rearward diameter.

6. The toy launcher of claim 5, wherein the forward portion is movable relative to the rearward portion of the fluid chamber in a telescoping manner.

7. The toy launcher of claim 6, wherein the slidable frame is configured to engage and move the forward portion of the fluid chamber relative to the rearward portion of the fluid chamber.

8. The toy launcher of claim 1, wherein the launch assembly further comprises an elevator assembly configured to align the at least one projectile with the launch mechanism.

9. The toy launcher of claim 8, wherein the elevator assembly includes an elevator mechanism pivotably coupled to the housing in the interior recess and an elevator chamber movably disposed in the interior recess and configured to receive the at least one projectile.

10. The toy launcher of claim 9, wherein the elevator mechanism is configured to pivot upwardly and engage the elevator chamber to move the elevator chamber into vertical alignment with the launch mechanism.

11. The toy launcher of claim 10, wherein the slidable frame includes a claw protruding therefrom so that movement of the slidable frame causes the claw to engage and pivot the elevator mechanism upwardly within the interior recess.

12. The toy launcher of claim 1, wherein the launch assembly further comprises a rotation gear rotatably coupled with the projectile feed and operably coupled with the slidable frame so that movement of the slidable frame along the rotation gear causes subsequent rotation of the projectile feed.

13. The toy launcher of claim 12, wherein the rotation gear includes one or more cam ledges configured for engagement with a forward actuator of the slidable frame.

14. The toy launcher of claim 1, wherein the launch assembly further comprises a rack movably coupled along the slidable frame.

15. The toy launcher of claim 1, wherein the rack comprises a plurality of chambers that defines respective recesses with corresponding ledges extending horizontally thereabove.

16. The toy launcher of claim 1, wherein the respective recess of each of the plurality of chambers is configured to receive a portion of the at least one engagement finger and each of the corresponding ledges is configured to engage a portion of the at least one engagement finger so that relative movement of the rack and the slidable frame causes the at least one engagement finger to rotate in at least one of a first and second rotational direction.

17. A method of launching a projectile from a toy launcher, comprising:

(a) providing a toy assembly comprising a housing and a launch assembly at least partially disposed within the housing, the launch assembly comprising:

a projectile feed rotatably disposed within the housing and including a plurality of receiving chambers each adapted to receive at least one projectile to be movably disposed therein;

a slidable frame movable relative to the projectile feed; and a launch mechanism that includes a telescoping fluid chamber with a spring-actuated piston disposed therein;

(b) moving the slidable frame along the housing so that at least one engagement finger rotatably disposed on the slidable frame engages and moves a respective at least one projectile of the plurality of receiving chambers rearwardly along a receiving chamber of the plurality of receiving chambers of the projectile feed;

(c) moving the slidable frame along the housing so that a rear portion of the slidable frame engages and moves a forward portion of the fluid chamber rearwardly to telescope over a rearward portion of the fluid chamber and cause a spring associated with the actuated piston to compress; and (d) releasing the spring associated with the plunger so that the piston moves forwardly along the fluid chamber to cause a pressure differential to form about the respective at least one projectile from the plurality of receiving chambers and propel forwardly from the toy launcher.

* * * * *